US011692463B2

(12) United States Patent
Oikawa et al.

(10) Patent No.: US 11,692,463 B2
(45) Date of Patent: Jul. 4, 2023

(54) OIL PASSAGE SWITCHING VALVE AND VALVE TIMING CHANGING APPARATUS

(71) Applicant: MIKUNI CORPORATION, Tokyo (JP)

(72) Inventors: Chikara Oikawa, Kanagawa (JP); Kairi Horiuchi, Kanagawa (JP)

(73) Assignee: MIKUNI CORPORATION, Tokyo (JP)

( * ) Notice: Subject to any disclaimer, the term of this patent is extended or adjusted under 35 U.S.C. 154(b) by 123 days.

(21) Appl. No.: 16/989,842

(22) Filed: Aug. 10, 2020

(65) Prior Publication Data

US 2021/0062689 A1 Mar. 4, 2021

(30) Foreign Application Priority Data

Aug. 28, 2019 (JP) ..... 2019-155154
Apr. 8, 2020 (JP) ..... 2020-069446

(51) Int. Cl.
*F01L 1/344* (2006.01)
*F01L 1/46* (2006.01)
*F01L 1/047* (2006.01)

(52) U.S. Cl.
CPC ..... *F01L 1/3442* (2013.01); *F01L 1/047* (2013.01); *F01L 1/462* (2013.01);
(Continued)

(58) Field of Classification Search
CPC ..... F01L 1/3442; F01L 1/053; F01L 2001/34426; F01L 2001/34469; F01L 2820/043; F01L 2820/044; F01L 2820/01; F01L 2301/00; F01L 1/34409; F01L 2250/02; F01L 2800/05; F01L 1/047; F01L 1/462; F01L 1/46; F01L 1/344
(Continued)

(56) References Cited

U.S. PATENT DOCUMENTS 11,174,762 B1 * 11/2021 Kenyon ..... F01L 1/3442
2007/0261651 A1 * 11/2007 Suzuki ..... F01L 1/3442 123/90.17

(Continued)

FOREIGN PATENT DOCUMENTS

JP 2012184695 9/2012
JP 2012207671 10/2012

(Continued)

*Primary Examiner* — Devon C Kramer
*Assistant Examiner* — Kelsey L Stanek
(74) *Attorney, Agent, or Firm* — JCIPRNET

(57) ABSTRACT

An oil passage switching valve suitable for a valve timing changing apparatus includes: a valve body, opening or closing an oil passage of operating oil; an urging spring, urging to position the valve body to a position corresponding to the retard position in a pause state; and a switching element, positioning the valve body to a position corresponding to the retard position when a state quantity of the operating oil is in a first range, and switching a position of the valve body in response to the state quantity (pressure or temperature) of the operating oil while resisting an urging force of the urging spring to position the valve body to a position corresponding to the advance position when the state quantity of the operating oil is in a second range greater than the first range.

15 Claims, 36 Drawing Sheets

(52) U.S. Cl.
CPC ..... *F01L 2001/34426* (2013.01); *F01L 2820/043* (2013.01); *F01L 2820/044* (2013.01)

(58) Field of Classification Search
USPC ..... 123/90.17
See application file for complete search history.

(56) References Cited

U.S. PATENT DOCUMENTS

| | | | | |
|---|---|---|---|---|
| 2017/0218797 | A1* | 8/2017 | Takada | F16K 3/24 |
| 2020/0408115 | A1* | 12/2020 | Mitsutani | F01L 1/3442 |

FOREIGN PATENT DOCUMENTS

| | | |
|---|---|---|
| JP | 6252388 | 12/2017 |
| JP | 2018080594 | 5/2018 |

* cited by examiner

OIL PASSAGE SWITCHING VALVE AND VALVE TIMING CHANGING APPARATUS

CROSS-REFERENCE TO RELATED APPLICATION

This application claims the priority benefit of Japan application serial no. 2019-155154, filed on Aug. 28, 2019 and Japan application serial no. 2020-069446, filed on Apr. 8, 2020. The entirety of each of the above-mentioned patent applications is hereby incorporated by reference herein and made a part of this specification.

BACKGROUND

Technical Field

The invention relates to an oil passage switching valve for switching an oil passage of operating oil, and particularly relates to an oil passage switching valve and a valve timing changing apparatus suitable at the time of changing an opening/closing time (valve timing) of an intake valve or an exhaust valve in an internal combustion engine dedicated to power generation and mounted in a range extender vehicle and an oil passage switching valve and a valve timing changing apparatus suitable for an internal combustion engine of a motorcycle, etc.

Description of Related Art

It is known that a conventional range extender vehicle includes an engine dedicated for generating power, a power generator driven by the engine to generate power, a battery storing power generated by the power generator, and a drive motor rotationally driving wheels by power supplied from the battery, etc., and the engine includes a variable valve timing mechanism that changes the opening/closing timing of an intake valve and an electromagnetically driven hydraulic pressure control valve that adjusts the hydraulic pressure of operating oil. (for example, see Patent Document 1).

In the range extender vehicle, since the engine is designated for generating power, as valve timing, one of the advance position and the retard position is selected to perform binary switching, and it is not necessary to change continuously.

However, in such control, since an electromagnetically driven hydraulic pressure control valve is adopted, the cost of the engine is high, the control system is required, and, as a result, the cost of the entire vehicle is increased.

In addition, as a valve timing changing apparatus of an engine mounted in a motorcycle, a phase variable apparatus includes a holder fixed to a cam shaft, a driven member and a guide member held by the holder, a plurality of centrifugal weights interposed in a guide groove between the driven member and the guide member, and an urging member that urges the holder and the guide member in directions toward each other, and is adapted to supply a lubricant to sliding surfaces of the driven member, the guide member, the centrifugal weights, etc., (see Patent Document 2, for example).

In the phase variable apparatus, by increasing the centrifugal force acting on the centrifugal weights when the rotational velocity of the engine increases, the centrifugal weights move to relatively change the angular positions between the driven member and the guide member, and the valve timing is changed.

However, since the phase variable apparatus uses multiple centrifugal weights, the weight is higher, the size is greater, and the structure is complicated.

RELATED ART DOCUMENT(S)

Patent Document

[Patent Document 1] Japanese laid-open no. 2012-184695 A
[Patent Document 2] Japanese patent no. 6252388.

SUMMARY

The invention provides an oil passage switching valve and a valve timing changing apparatus suitable for engines mounted in vehicles including motorcycles, particularly for vehicles such as range extender vehicles, and pursuing a simple structure, a low cost, a light weight, and a small size, etc.

An oil passage switching valve according to the invention is suitable for a valve timing changing apparatus to switch an oil passage for supplying or discharging operating oil with respect to a retard chamber and an advance chamber to change a valve timing of an engine to a first angle position or a second angle position. The oil passage switching valve includes: a valve body, opening or closing an oil passage of the operating oil; an urging spring, urging to position the valve body to a position corresponding to the first angle position in a pause state; and a switching element, switching a position of the valve body in response to the state quantity of the operating oil while resisting an urging force of the urging spring to position the valve body to the position corresponding to the first angle position when a state quantity of the operating oil is in a first range, and to position the valve body to a position corresponding to the second angle position when the state quantity of the operating oil is in a second range greater than the first range.

In the oil passage switching valve, it may also be configured that the first angle position is a retard position, and the second angle position is an advance position.

In the oil passage switching valve, it may also be configured that the oil passage switching valve includes a sleeve that defines a supply port that supplies the operating oil, a discharge port that discharges the operating oil, a retard port that communicates with the retard chamber, and an advance port that communicates with the advance chamber, the valve body is slidably inserted into the sleeve to open or close oil passages between the supply port and each of the retard port and the advance port, and the urging spring is disposed in the sleeve to urge the valve body in a direction.

In the oil passage switching valve, it may also be configured that the valve body has a discharge oil passage that guides the operating oil to the discharge port.

In the oil passage switching valve, it may also be configured that the state quantity of the operating oil is pressure, the first range is a first pressure range, the second range is a second pressure range, and the switching element is a pressure receiving part disposed in the valve body to receive a pressure of the operating oil.

In the oil passage switching valve, it may also be configured that the valve body includes a first valve part that opens or closes an oil passage between the retard port and the supply port and a second valve part that opens or closes an oil passage between the advance port and the supply port, and the pressure receiving part includes a first pressure receiving part adjacent to the first valve part and a second pressure receiving part facing the first valve part, having a pressure receiving area greater than the first valve part, and adjacent to the second valve part.

In the oil passage switching valve, it may also be configured that a valve closing timing of the first valve part is set as simultaneous with a valve opening timing of the second valve part or later than the valve opening timing of the second valve part.

In the oil passage switching valve, it may also be configured that the valve closing timing of the first valve part is set as before the second valve part reaches a maximum valve opening stroke.

In the oil passage switching valve, it may also be configured that, in the valve body, an auxiliary pressure receiving part is disposed to receive an engine cold condition pressure greater than the second pressure range to position the valve body to a position deviated from the position corresponding to the second angle position, so as to select the first angle position when the pressure of the operating oil is the engine cold condition pressure.

In the oil passage switching valve, it may also be configured that the valve body includes a first valve part that opens or closes an oil passage between the retard port and the supply port and a second valve part that opens or closes an oil passage between the advance port and the supply port, and the pressure receiving part includes a first pressure receiving part adjacent to the first valve part and a second pressure receiving part facing the first valve part, having a pressure receiving area greater than the first valve part, and adjacent to the second valve part, and the auxiliary pressure receiving part has the same pressure receiving area with the second pressure receiving part, and is disposed between the first pressure receiving part and the second pressure receiving part to close the oil passage between the supply port and the advance port when receiving the engine cold condition pressure.

In the oil passage switching valve including the auxiliary pressure receiving part, it may also be configured that a valve closing timing of the first valve part is set as simultaneous with a valve opening timing of the second valve part or later than the valve opening timing of the second valve part.

In the oil passage switching valve including the auxiliary pressure receiving part, it may also be configured that the valve closing timing of the first valve part is set as before a timing at which the auxiliary pressure receiving part closes the oil passage between the supply port and the advance port.

In the oil passage switching valve, it may also be configured that the state quantity of the operating oil is temperature, the first range is a first temperature range, the second range is a second temperature range, and the switching element is an urging member whose urging force that urges the valve body changes in response to a temperature of the operating oil.

In the oil passage switching valve, it may also be configured that the urging member is disposed in the sleeve to resist the urging spring and apply the urging force to the valve body.

In the oil passage switching valve, it may also be configured that the urging member is formed by a memory alloy that contracts in the first temperature range and expands in the second temperature range to return to a memorized form.

In the oil passage switching valve, it may also be configured that the sleeve is formed to be fit with a member defining an oil passage through which operating oil of the engine passes.

A valve timing changing apparatus of the invention is a valve timing changing apparatus of an engine that changes opening and closing timings of an intake valve or an exhaust valve driven by a camshaft. The valve timing changing apparatus includes: a housing rotor, rotating on an axis of the camshaft; a vane rotor, rotating on the axis and cooperating with the housing rotor to define a retard chamber and an advance chamber; a fastening bolt, integrally fastening the vane rotor to the camshaft; and an oil passage switching valve, switching an oil passage that supplies or discharges operating oil with respect to the retard chamber and the advance chamber. As the oil passage switching valve, the oil passage switching valve with any one of the above configurations may be adopted.

In the valve timing changing apparatus, it may also be configured that the fastening bolt includes a fitting pore that fits the sleeve of the oil passage switching valve and an oil passage through which the operating oil passes.

DESCRIPTION OF THE EMBODIMENTS

Hereinafter, the embodiments of the invention will be described with reference to the accompanying drawings.

A valve timing changing apparatus including an oil passage switching valve according to the invention is suitable for an engine of a range extender vehicle EV.

Figure 1:
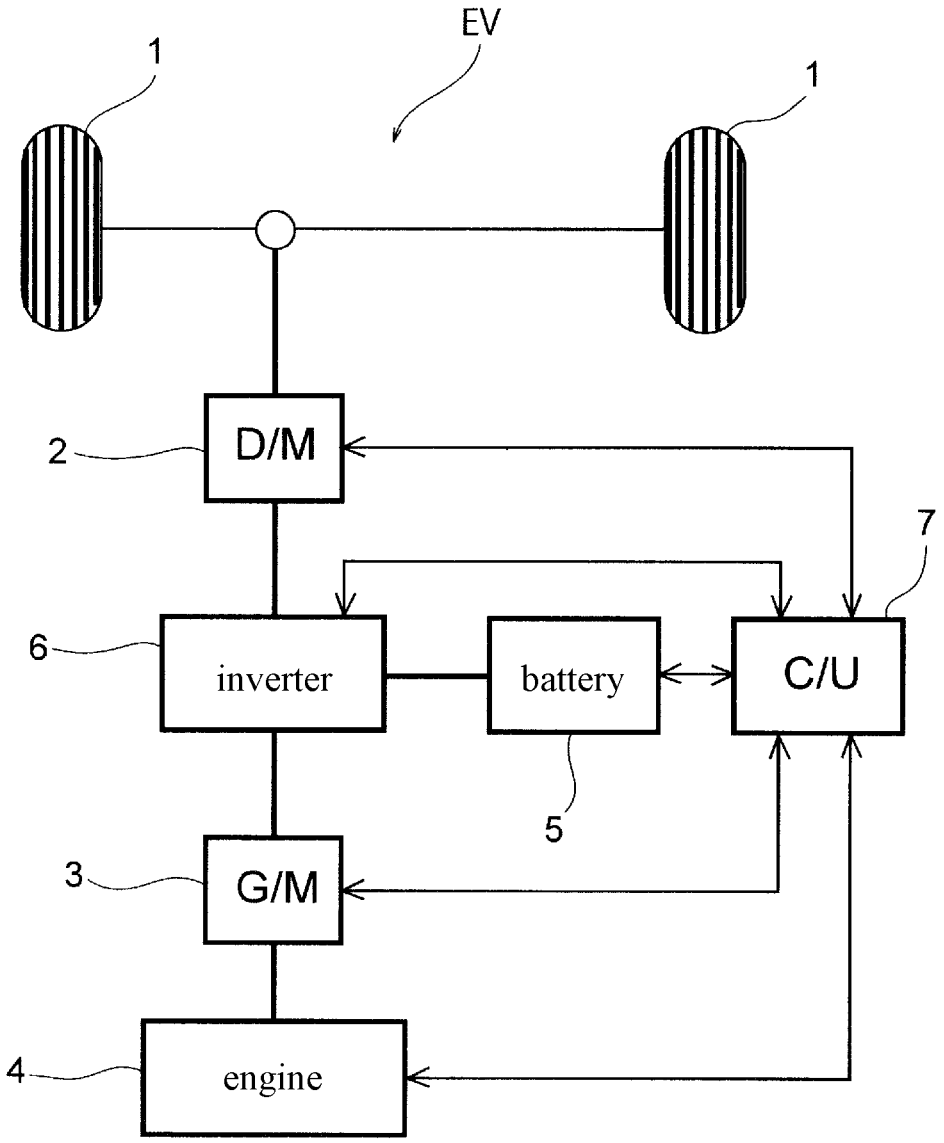
FIG. 1 is a view illustrating a configuration of a range extender vehicle in which an engine including a valve timing changing apparatus including an oil passage switching valve according to the invention is mounted.

As shown in FIG. 1, the range extender vehicle EV includes a drive motor 2 for driving drive wheels 1, a generator 3, an engine 4 dedicated to power generation, a battery 5, an inverter 6, and a control unit 7.

The drive motor 2 is a motor generator having a function of rotating and driving the drive wheels 1 via a differential mechanism as a drive source when the vehicle EV travels, as well as generating regenerative power when the vehicle EV decelerates.

The generator 3 is a motor generator having a function of a motor, and is driven by the engine 4 to generate power and serves as a starter for starting the engine 4 by supplying electric power from the battery 5 upon starting of the engine 4.

Figure 2:
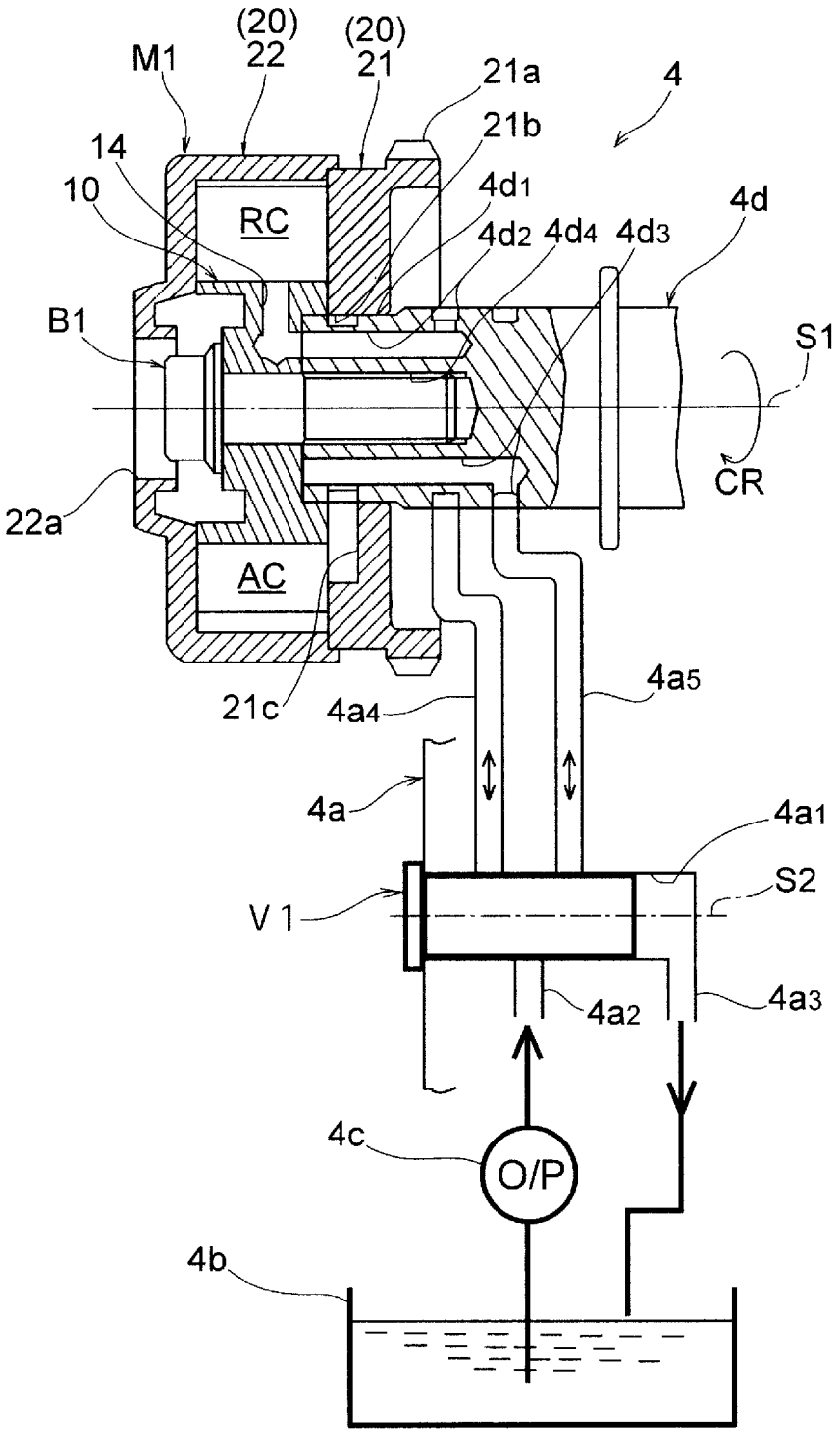
FIG. 2 is a view illustrating a configuration of a valve timing changing apparatus including an oil passage switching valve according to a first embodiment the invention.

The engine 4 is an internal combustion engine. In addition, as shown in FIG. 2, the engine 4 includes a main body 4*a* as a member that defines oil passages of a cylinder block and a cylinder head, etc., an oil pan 4*b* for storing operating oil, an oil pump 4*c* for circulating the operating oil, a camshaft 4*d* on the intake side and the exhaust side, an intake valve and an exhaust valve driven to open and close by the camshaft 4*d*, a valve timing changing apparatus M1 for changing the opening/closing time of the intake valve or the exhaust valve, an oil passage switching valve V1, etc.

The main body 4*a* includes a fitting hole 4*a*1 in which the oil passage switching valve V1 is fit, a supply oil passage 4*a*2, a discharge oil passage 4*a*3, a retard oil passage 4*a*4, an advance oil passage 4*a*5.

The cam shaft 4*d* is supported so as to rotate in the direction of an arrow sign CR herein and be rotatable about an axis S1 in the cylinder head, and drives to open and close the intake valve or the exhaust valve.

In addition, the camshaft 4*d* includes a cylindrical part 4*d*1, a retard oil passage 4*d*2 and an advance oil passage 4*d*3 that supply and discharge the operating oil, and a female screw part 4*d*4 into which a fastening bolt B1 is screwed.

The battery 5 is, for example, a lithium ion battery, charges power generated by the generator 3 and charges regenerative power generated by the drive motor 2 and discharges power for driving the drive motor 2 when the vehicle EV travels, and discharges, as a starter, power for driving the generator 3 upon starting of the engine 4.

The inverter 6 is interposed between the battery 5 and the drive motor 2 and between the battery 5 and the generator 3, and serves to supply power charged in the battery 5 to drive the motor 2 or the generator 3 or supply power generated by the generator 3 to the battery 5 or the drive motor 2 and supply regenerative power generated by the drive motor 2 to the battery 5.

The control unit 7 exerts control over the entire vehicle EV and, for example, exerts control in response to a first travel mode to a fourth travel mode as in the following.

In the first travel mode, during normal starting and traveling and when the remaining amount of the battery 5 is sufficient, the control unit 7 exerts control to stop the engine 4 and drive the drive motor 2 to travel by the power of the battery 5.

In the second travel mode, during normal starting and traveling and when the remaining amount of the battery 5 is low, the control unit 7 exerts control to start the engine 4 and drive the drive motor 2 to travel by using the of the battery 5 while charging the power generated by the generator 3 to the battery 5.

In the third travel mode, at the time when power is maximally supplied to travel during sudden acceleration and climbing uphill, the control unit 7 exerts control to start the engine 4 and drive the motor 2 by the power generated by the generator 3 and the power of the battery 5.

In the fourth travel mode, during deceleration and going downhill and at the time when the remaining amount of the battery 5 is sufficient, the control unit 7 exerts control to stop the engine 4, travel by utilizing inertia while charging the regenerative power generated by the generator 2 to the battery 5.

Accordingly, when the vehicle EV travels, since the engine 4 is used only to generate power for driving the generator 3, the operation modes of the engine 4 can be simply classified into two simple operating modes, which are a light load mode at the time of starting or low rotation speed and a medium/high load mode.

Therefore, the valve timing changing apparatus M1 of the engine 4 is capable of sufficiently coping with the situation even with the configuration of selecting a retard position as the first angle position and an advance position as the second angle position without the necessity of continuously changing the valve timing.

Figure 6:
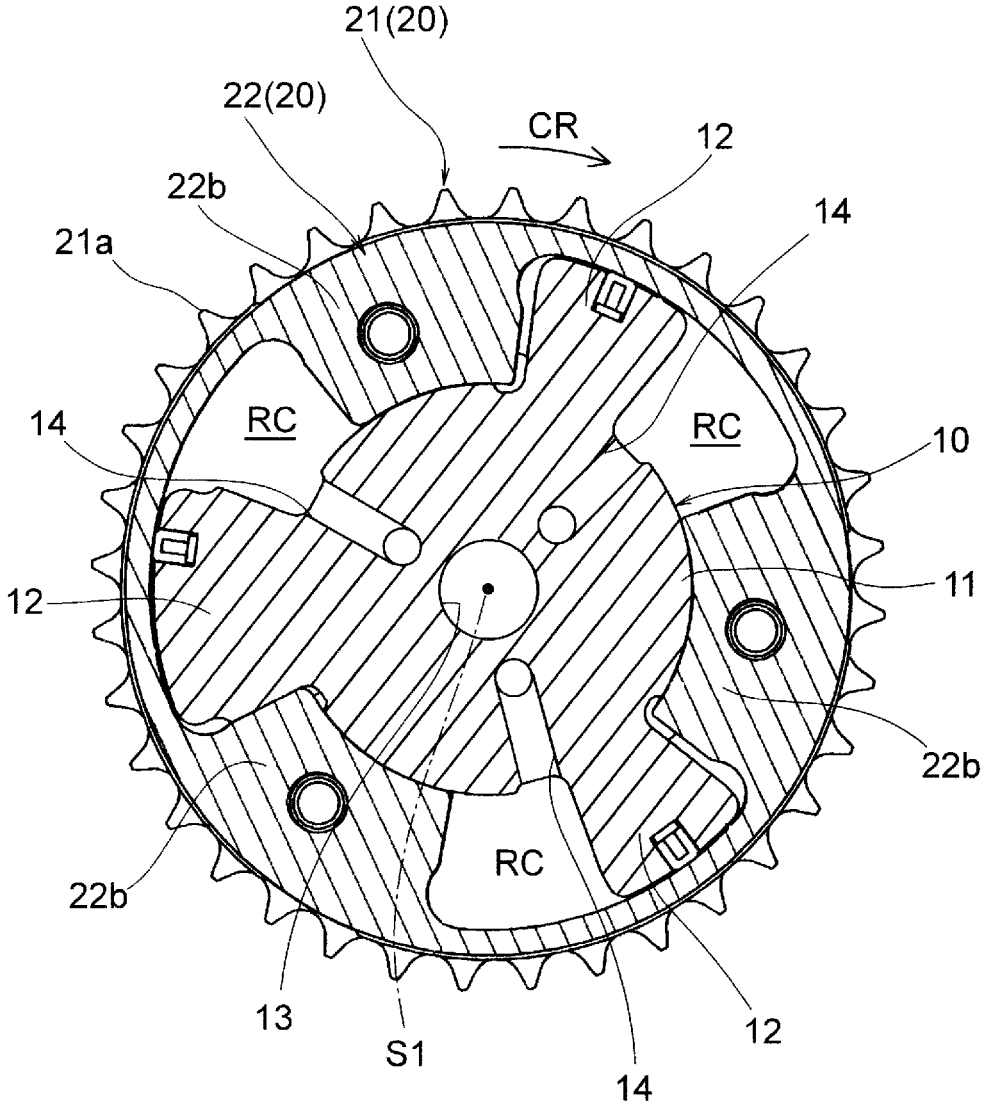
FIG. 6 is a cross-sectional view illustrating a position relation between a vane rotor and a housing rotor of the valve timing changing apparatus at the retard position.
Figure 8:
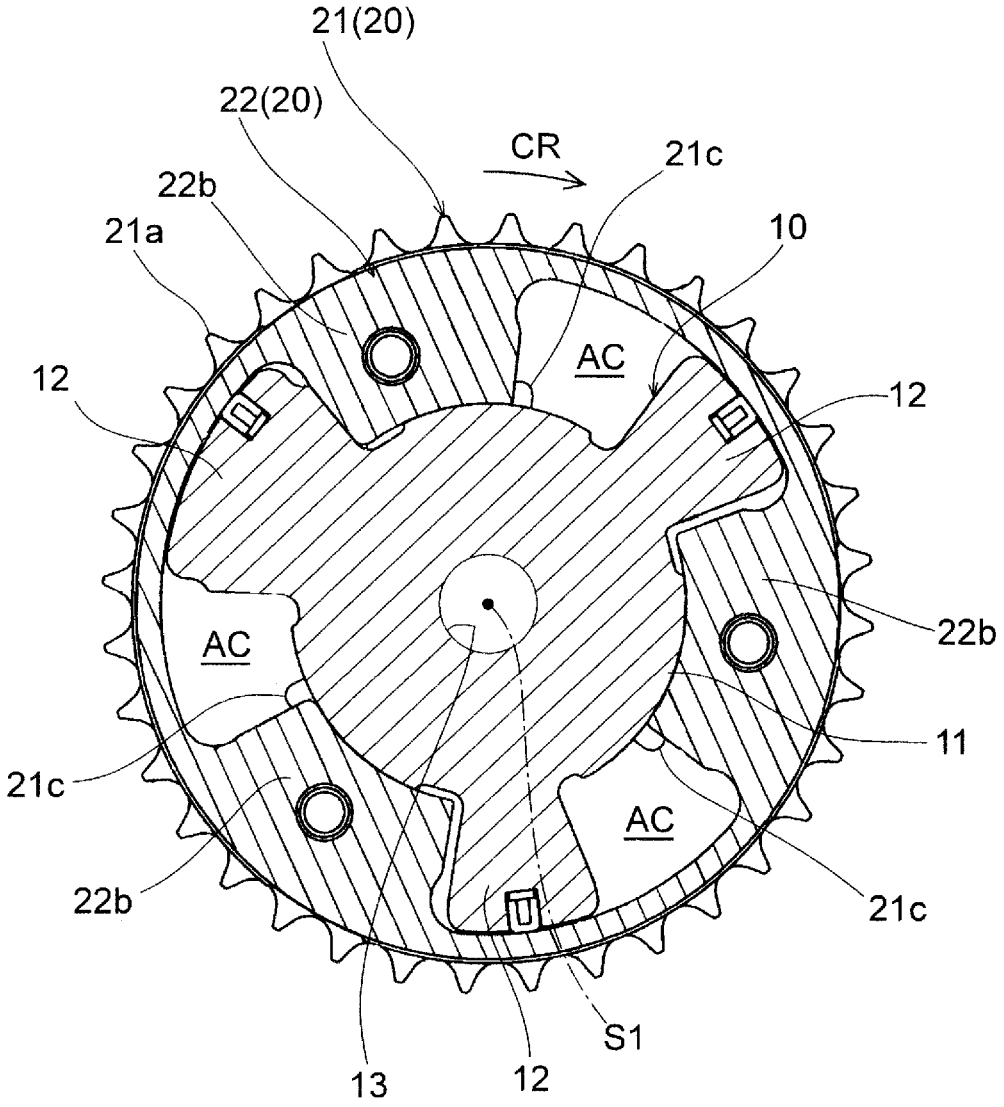
FIG. 8 is a cross-sectional view illustrating a position relation between the vane rotor and the housing rotor of the valve timing changing apparatus at the advance position.

The valve timing changing apparatus M1, as shown in FIGS. 2, 6, and 8, includes a vane rotor 10 integrally rotating with the cam shaft 4*d* on the same axis S1 and a housing rotor 20 accommodating the vane rotor 10 and relatively rotatable on the axis S1.

The vane rotor 10 includes a hub part 11 that is cylindrically shaped, three vane parts 12, a through hole 13, and three retard oil passages 14.

The housing rotor 20 has a two-part structure composed of a first housing rotor 21 that is substantially disc-shaped and a second housing rotor 22 that has a bottom and is cylindrically shaped, and the two parts are fastened to each other by screws.

The first housing rotor 21 includes a sprocket 21*a*, an inner peripheral surface 21*b* rotatably fit with the cylindrical part 4*d*1 of the camshaft 4*d*, and three advance oil passages 21*c* formed as grooves in a surface in close contact with the vane rotor 10.

The second housing rotor 22 includes an opening part 22*a* and three shoe parts 22*b*. The housing rotor 20 accommodates the vane rotor 10 to be relatively rotatable within a predetermined angle range, and is formed so that an accommodating chamber is divided into two, i.e., a retard chamber RC and an advance chamber AC, by the vane part 12 of the vane rotor 10. Then, the housing rotor 20 is linked with rotation of a crankshaft via a chain, etc., the oil passage switching valve V1 adjusts the operating oil in the retard chamber RC and the advance chamber AC, and the housing rotor 20 transmits the rotational drive force of the crankshaft to the camshaft 4*d* via the vane rotor 10.

Figure 3:
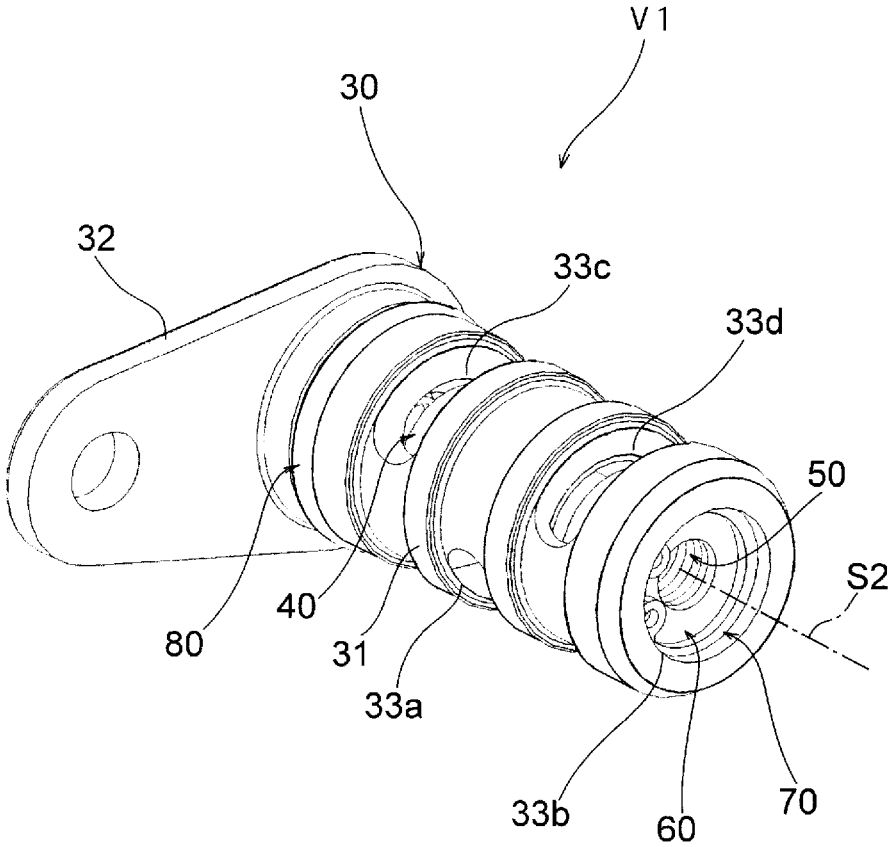
FIG. 3 is an oblique view illustrating the appearance of the oil passage switching valve according to the first embodiment of the invention.
Figure 4:
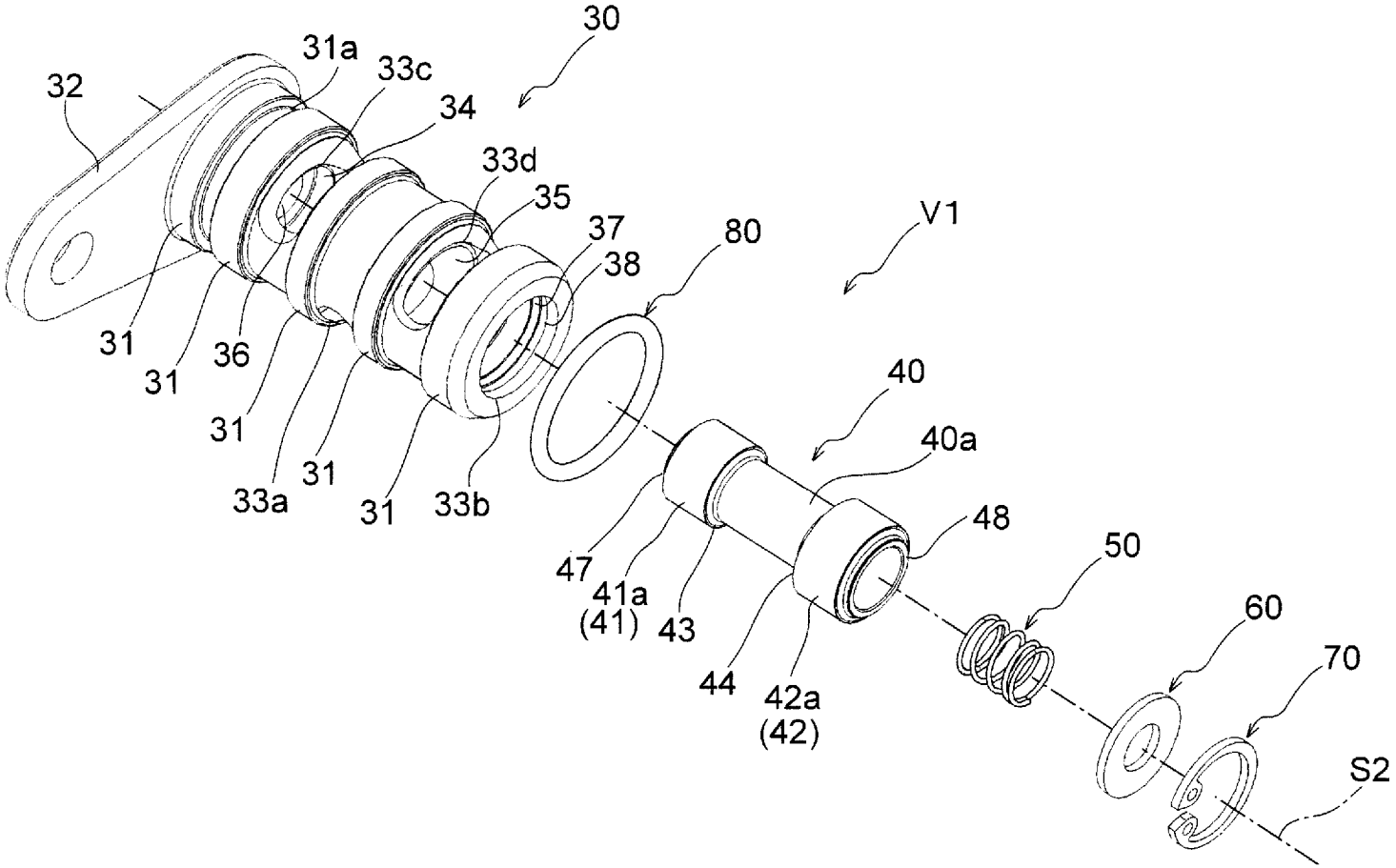
FIG. 4 is an exploded oblique view of the oil passage switching valve shown in FIG. 3.

The oil passage switching valve V1, as shown in FIG. 2, is attached to the main body 4*a* of the engine 4. As shown in FIG. 3 and FIG. 4, the oil passage switching valve V1 includes a sleeve 30 in a substantially cylindrical shape elongated in the direction of an axis S2, a valve body 40 that is in a substantially cylindrical shape elongated in the direction of the axis S2, an urging spring 50, a receiving member 60, a snap ring 70, and a seal member 80.

The sleeve 30 includes an outer peripheral surface 31, a seal groove 31*a* into which the seal member 80 is fit, a flange part 32 for fixing with the main body 4*a* by using a screw, a supply port 33*a*, a discharge part 33*b*, a retard port 33*c*, an advance port 33*d*, an inner peripheral surface 34 with a small diameter, an inner peripheral surface 35 with a large diameter 35, a receiving part 36, a receiving groove 37, a snap ring groove 38.

The outer peripheral surface 31 is formed as a cylindrical surface with the axis S2 as the center, and is in close contact to be fit with the fitting hole 4*a*1 of the main body 4*a*.

The supply port 33*a* is in communication with the supply oil passage 4*a*2.

The discharge port 33*a* is in communication with the discharge oil passage 4*a*3.

The retard port 33*c* is in communication with the retard oil passage 4*a*4 and in communication with the retard chamber RC via the retard oil passages 4*d*2 and 14.

The advance port 33*c* is in communication with the advance oil passage 4*a*5 and in communication with the advance chamber AC via the advance oil passages 4*d*3 and 21*c*.

The inner peripheral surface 34 is formed as a cylindrical surface with the axis S2 as the center, and is in close contact with the first valve part 41 of the valve body 40 to guide slidably.

The inner peripheral surface 35 is formed as a cylindrical surface with the axis S2 as the center, and is in close contact with the second valve part 42 of the valve body 40 to guide slidably.

The receiving part 36 serves to receive the first end part 47 of the valve body 40 to stop the valve body 40 in the position of the pause state.

The receiving groove 37 is formed to receive the receiving member 60 to restrict the movement toward the side of the valve body 40.

The snap ring groove 38 is formed to receive the snap ring 70 by a snap fit in the state in which the receiving member 60 is fit into the receiving groove 37.

Figure 5:
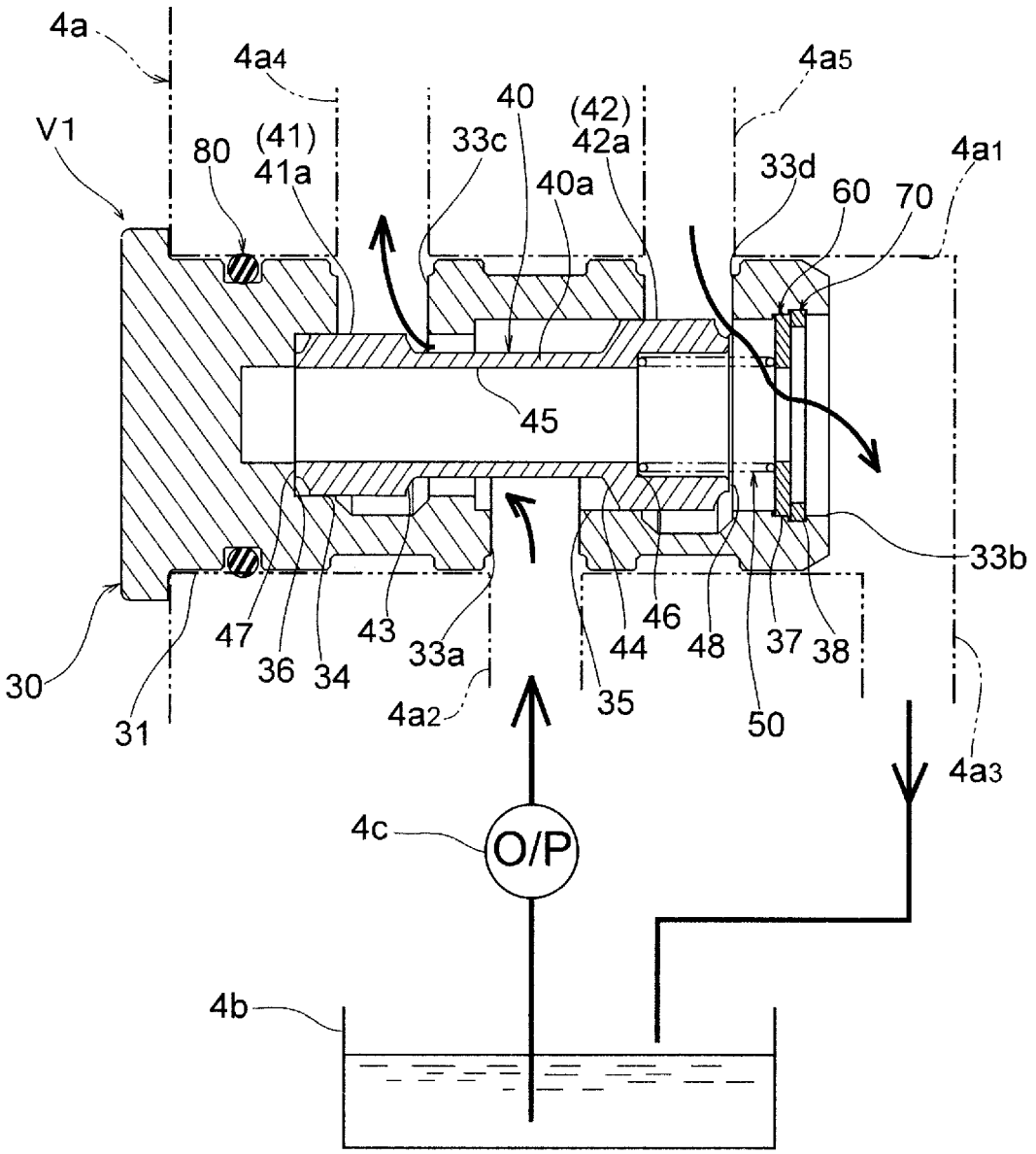
FIG. 5 is a view illustrating a state in which, in the oil passage switching valve according to the first embodiment, a valve body is at a position corresponding to a retard position (first angle position) and operating oil can be supplied to a retard chamber.

As shown in FIG. 5, the valve body 40 includes a cylindrical part 40*a*, the first valve part 41 with a small diameter, the second valve part 42 with a large diameter, a first pressure receiving part 43 and a second pressure receiving part 44 as the pressure receiving part, a through hole 45 as the discharge oil passage, a receiving part 46, a first end part 47, and a second end part 48.

The first valve part 41 is formed in a cylindrical shape with the axis S2 as the center to slide on the inner peripheral surface 34 of the sleeve 30, defines an outer peripheral surface 41*a* having an outer diameter that is substantially equal to or slightly smaller than the inner diameter of the inner peripheral surface 34, and opens and closes the oil passage between the retard port 33*c* and the supply port 33*a*.

The second valve part 42 is formed in a cylindrical shape with the axis S2 as the center to slide on the inner peripheral surface 35 of the sleeve 30, defines an outer peripheral surface 42*a* having an outer diameter that is substantially equal to or slightly smaller than the inner diameter of the inner peripheral surface 35, and opens and closes the oil passage between the advance port 33*d* and the supply port 33*a*.

The first pressure receiving part 43 is formed as an annular inclined surface adjacent to the first valve part 41, and receives a pressure P of the operating oil in the direction toward opening the first valve part 41 in the direction of the axis S2.

The second pressure receiving part 44 faces the first pressure receiving part 43 in the direction of the axis S2 and is formed as an annular inclined surface adjacent to the second valve part 42 to define a pressure receiving area greater than the pressure receiving area of the first pressure receiving part 41, and receives the pressure P of the operating oil in the direction toward opening the second valve part 42 in the direction of the axis S2.

That is, the first pressure receiving part 43 and the second pressure receiving part 44 are connected by the cylindrical part 40*a* whose outer diameter is smaller than the first valve part 41 and the second valve part 42.

Then, the first pressure receiving part 43 and the second pressure receiving part 44, as the pressure receiving part, function as a switching element that switches the position of the valve body 40 in response to the pressure P as the state quantity of the operating oil, while resisting the urging force of the urging spring 50.

Figure 7:
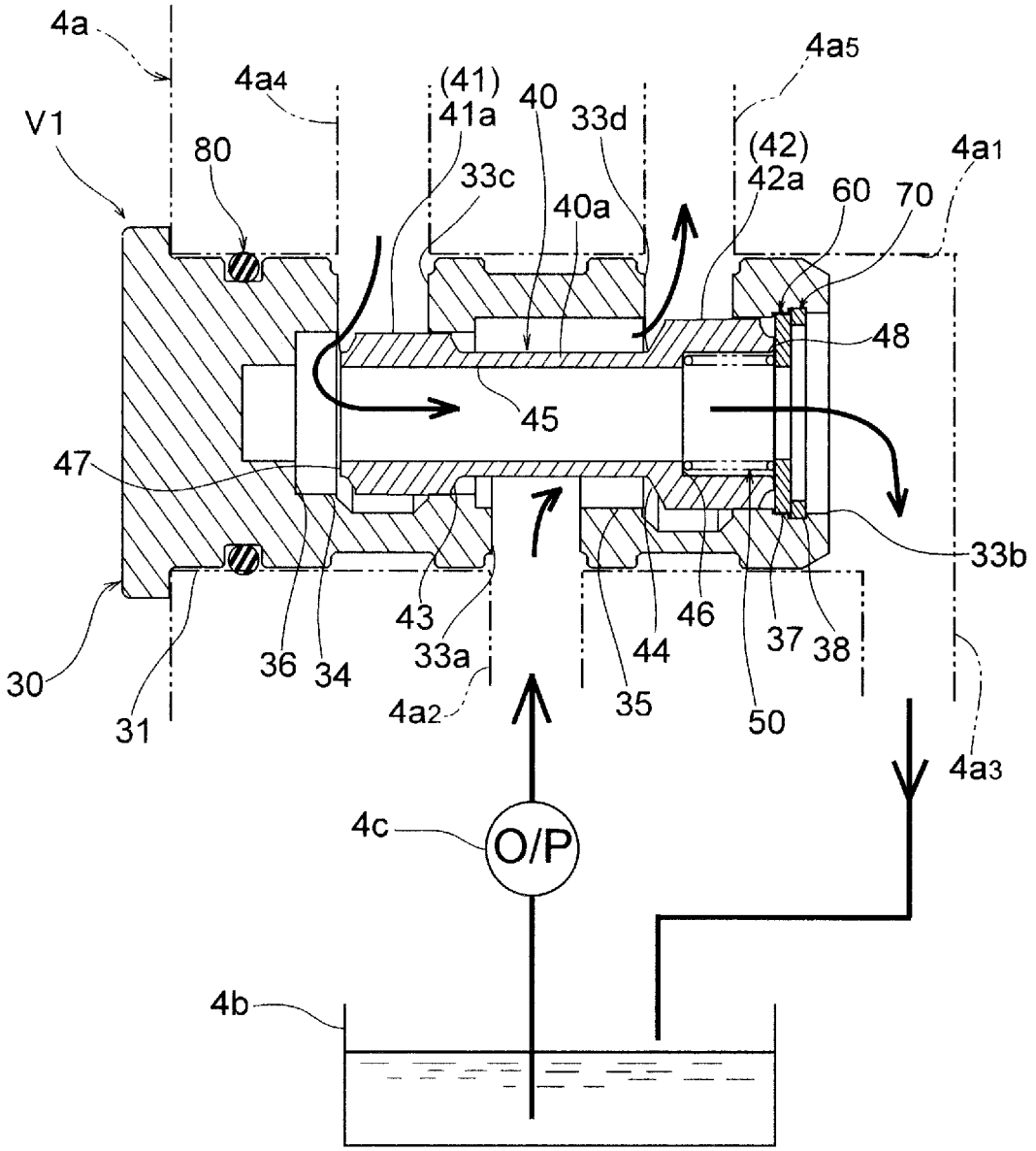
FIG. 7 is a view illustrating a state in which, in the oil passage switching valve according to the first embodiment, a valve body is at a position corresponding to an advance position (second angle position) and operating oil can be supplied to an advance chamber.

The through hole 45, as shown in FIG. 7, serves to discharge the operating oil in the retard chamber RC from the retard port 33*c* toward the discharge port 33*b* in the state in which the first valve part 41 closes the oil passage between the retard port 33*c* and the supply port 33*a*.

By enlarging a portion of the inner diameter of the through hole 45 toward the inner side in the direction of the axis S2 from the second end part 48 to receive an end part of the urging spring 50, the receiving part 46 is formed as an annular surface defined in an inner side region of the second valve part 42.

The first end part 47 detachably abuts against the receiving part 36 of the sleeve 30.

The second end part 48 detachably abuts against the receiving member 60 attached to the receiving groove 37 of the sleeve 30.

The urging spring 50 is a compression type coil spring, and is assembled so that one end part abuts against the receiving part 46 of the valve body 40, and the other end part abuts against the receiving member 60.

Then, at the time of the pause state and that the pressure P of the operating oil is in a first pressure range P1, the urging spring 50 applies an urging force that stops the valve body 40 at the position at which the first end part 47 of the valve body 40 abuts against the receiving part 36 of the sleeve 30, that is, the position corresponding to the retard position as the first angle position.

The receiving member 60 is formed as an annular-shaped circular disc, receives the other end part of the urging spring 50, and serves to receive the second end part 48 of the valve body 40 to stop the valve body 40 at the position of the maximum valve opening stroke.

The snap ring 70 is a C-shaped ring, and is fit into the snap ring groove 38 of the sleeve 30 by snap fit to restrict the receiving member 60 from falling.

The seal member 80 is an O-ring made of rubber, and is fit into the seal groove 31*a* of the sleeve 30 to seal between the main body 4*a* and the sleeve 30.

Then, in the case of starting the engine 4 mounted in the range extender vehicle EV, the operation of the valve timing changing apparatus M1 using the oil passage switching valve V1 will be described based on FIGS. 5 to 9.

Firstly, in the stopped state of the engine 4, the oil passage switching valve V1 is in the pause state. At this time, as shown in FIG. 5, the valve body 40 is urged toward a direction by the urging force of the urging spring 50, the first valve part 41 is in the open-valve state in which the oil passage between the retard port 33*c* and the supply port 33*a* is opened, and the second valve part 42 is in the close-valve state in which the oil passage between the advance port 33*d* and the supply port 33*a* is closed. At this time, the retard chamber RC is in the state in which the operating oil is supplied, and the advance chamber AC is in the state in which the operating oil is discharged.

In addition, in the stopped state of the engine 4, the valve timing, as shown in FIG. 6, is maintained at the retard position (here, the most retard position) as the first angle position. Here, in the stopped state of the engine 4, the valve timing may also be maintained at the retard position by using a lock mechanism shown in a valve timing changing mechanism M2 according to a second embodiment to be described in the following. At the time when the engine 4 is transitioned from the state in which the valve timing is at an intermediate position to the advance position when the engine 4 is operating to the stopped state, the valve timing is automatically returned to the retard position by a fluctuation torque and a friction torque transmitted from the camshaft 4*d*.

Figure 9:
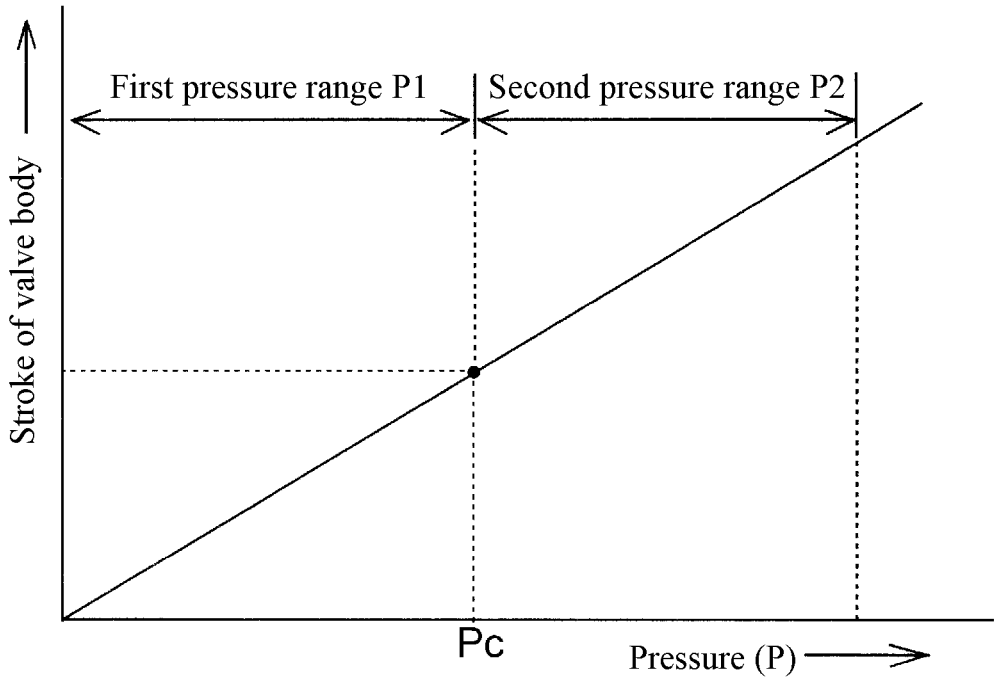
FIG. 9 is a graph illustrating a relation between the stroke of the valve body and the pressure of the operating oil as well as a first pressure range and a second pressure range.

Then, when the engine 4 is started, via the oil pump 4*c*, the pressure P of the operating oil is gradually increased, as shown in FIG. 9.

During the light load mode at the time of starting or low rotation speed of the engine 4, as shown in FIG. 9, the pressure P of the operating oil is within the range of the first pressure range P1 as a first range smaller than a switching pressure Pc.

At this time, the urging force of the urging spring 50 is greater than the difference between the pressures of the operating oil received by the second pressure receiving part 44 and the first pressure receiving part 43, i.e., the pressure that the pressure receiving part receives, and the valve body 40 is in the state in which the first valve body 41 is opened and the second valve body 42 is closed, as shown in FIG. 5. Therefore, the operating oil supplied through the supply port 33*a* is guided to the retard chamber RC through the retard port 33*c* and the retard oil passages 4*a*4, 4*d*2, and 14. Accordingly, the valve timing is maintained at the retard position shown in FIG. 6.

Here, while a range of 55 to 100 Kpa, for example, can be selected for the switching pressure Pc, the range is not limited such a range.

Meanwhile, during the intermediate/high load mode of the engine 4, as shown in FIG. 9, the pressure P of the operating oil is transitioned to the range of the second pressure range P2 as a second range greater than the switching pressure Pc.

At this time, the difference between the pressures of the operating oil received by the second pressure receiving part 44 and the first pressure receiving part 43, i.e., the pressure that the pressure receiving part receives, overcomes the urging force of the urging spring 50, and the valve body 40 is moved toward the direction of contracting the urging spring 50. As shown in FIG. 7, the first valve body 41 is changed to the close-valve state in which the oil passage between the retard port 33*c* and the supply port 33*a* is closed, and the second valve part 42 is in the open-valve state in which the oil passage between the advance port 33*d* and the supply port 33*a* is opened.

Therefore, the operating oil supplied through the supply port 33*a* is guided to the advance chamber AC through the advance port 33*d* and the advance oil passages 4*a*5, 4*d*3, and 21*c*. Meanwhile, the operating oil in the retard chamber RC is guided to the discharge port 33*b* through the retard oil passages 14, 4*d*2, and 4*a*4, the retard port 33*c*, and the through hole 45, and is returned to the oil pump 4*b* through the discharge oil passage 4*a*3.

Accordingly, as shown in FIG. 8, the valve timing is changed to and maintained at the advance position (here, the most advance position) as the second angle position.

Accordingly, with the first pressure receiving part 43 and the second pressure receiving part 44, as the switching element, disposed in the valve body 40 switching the position of the valve body 40 in response to the pressure P of the operating oil while resisting the urging force of the urging spring 50, the valve body 40 is positioned to the position corresponding to the retard position at the time when the pressure P of the operating oil is in the first pressure range P1, and the valve body 40 is positioned to the position corresponding to the advance position at the time when the pressure P of the operating oil is in the second pressure range P2 greater than the first pressure range P1.

According to the oil passage switching valve V1 with the above configuration, the driving force of the valve body 40 is not the conventional electromagnetic force, but a force according to the pressure P of the operating oil. Therefore, compared with the electromagnetically driven switching valve in the conventional technology, the simple structure, the low cost, the light weight, the small size, etc., can be attained.

Here, since the urging spring 50 is disposed in the sleeve 30, the oil passage switching valve V1 can be miniaturized by consolidating the components.

In addition, since the valve body 40 has the through hole 45 as the discharge oil passage that guides the operating oil to the discharge port 33*b*, compared with the case where the discharge oil passage is arranged on another route, the valve body 40 can be miniaturized by consolidating the configuration.

In the oil passage switching valve V1 according to the first embodiment, during the oil passage switching operation from the state shown in FIG. 5 to the state shown in FIG. 7, the valve body 40 may also be arranged to vibrate reciprocally to result in a cleaning mode.

Figure 10:
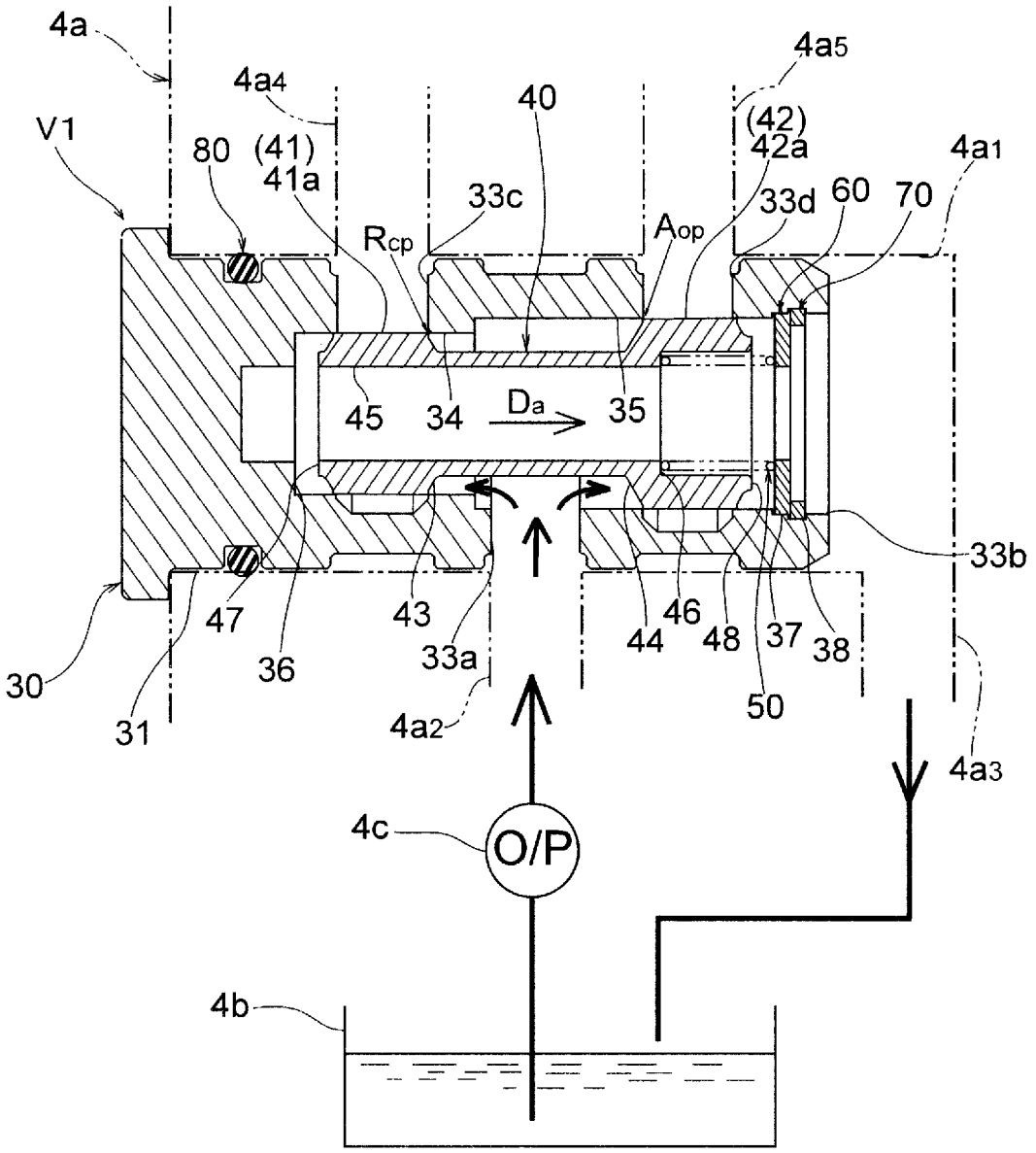
FIG. 10 is a cross-sectional view illustrating a state in which, in the oil passage switching valve according to the first embodiment, the valve closing timing of a first valve part and the valve opening timing of a second valve part are set to be as simultaneous.

Specifically, as shown in FIG. 10, at the time when the valve body 40 resists the urging force of the urging spring 50 to move in the sleeve 30, the lap margin between the outer peripheral surface 41*a* and the inner peripheral surface 34 and the lap margin between the outer peripheral surface 42*a* and the inner peripheral surface 35, etc., are set, so that a timing Rcp at which the outer peripheral surface 41*a* of the first valve part 41 starts closely contacting the inner peripheral surface 34 of the sleeve 30 facing the first pressure receiving part 43 is simultaneous with a timing Aop at which the outer peripheral surface 42*a* of the second valve part 42 starts leaving the inner peripheral surface 35 of the sleeve 30 facing the second pressure receiving part 44.

That is, the valve closing timing Rcp of the first valve part 41 is set as simultaneous with the valve opening timing Aop of the second valve part 42.

Figure 11:
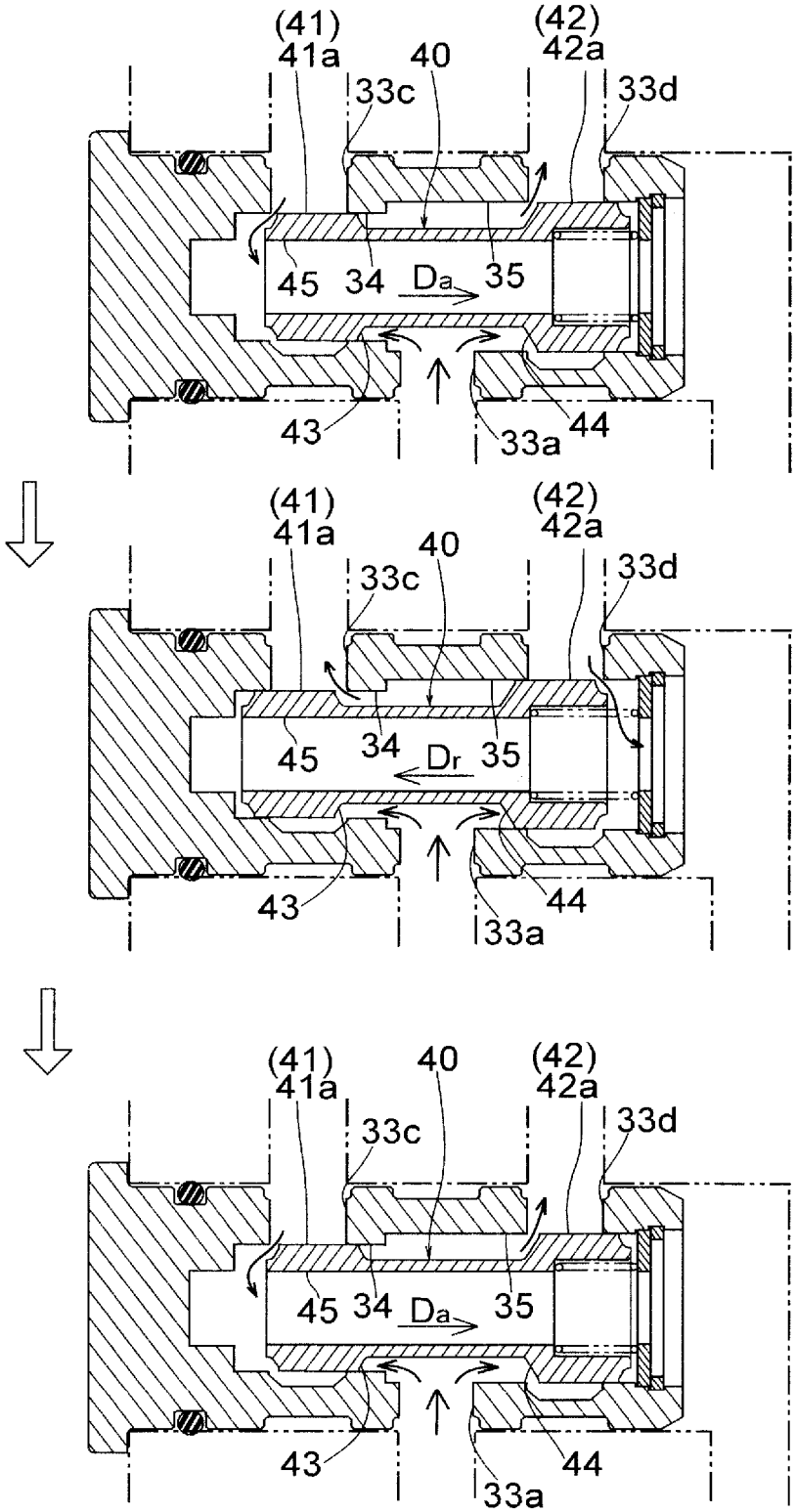
FIG. 11 is a view illustrating a state in which, in the oil passage switching valve according to the first embodiment, the valve body generates reciprocal vibrations.

According to the configuration, together with the rising of the pressure P of the operating oil guided through the supply oil passage 4*a*2, as shown in FIG. 11, when the valve body 40 resists the urging force of the urging spring 50 to move in an advance direction Da, the first valve 41 is closed to close the oil passage between the retard port 33*c* and the supply port 33*a* and the second valve 42 is opened to open the oil passage between the advance port 33*d* and the supply port 33*a*, and the pressure of the operating oil acting on the second pressure receiving part 44 is temporarily lowered.

That is, with lowering of a pressure Pv of the operating oil acting on the valve body 40, the valve body 40 is moved toward the retard direction Dr due to the urging force of the urging spring 50 to the position at which the pressure Pv of the operating oil and the urging force of the urging spring 50 are balanced, the first valve body 41 is opened to release the oil passage between the retard port 33*c* and the supply port 33*a*, and the second valve part 42 is closed to close the oil passage between the advance port 33*d* and the supply port 33*a*.

Together with that the pressure Pv of the operating oil acting on the valve body 40 rises again, the valve body 40 resists the urging force of the urging spring 50 to move in the advance direction Da, the first valve body 41 is closed to close the oil passage between the retard port 33*c* and the supply port 33*a*, the second valve part 42 is opened to open the oil passage between the advance port 33*d* and the supply port 33*a*, and the pressure of the operating oil acting on the second pressure receiving part 44 is temporarily lowered.

Figure 13:
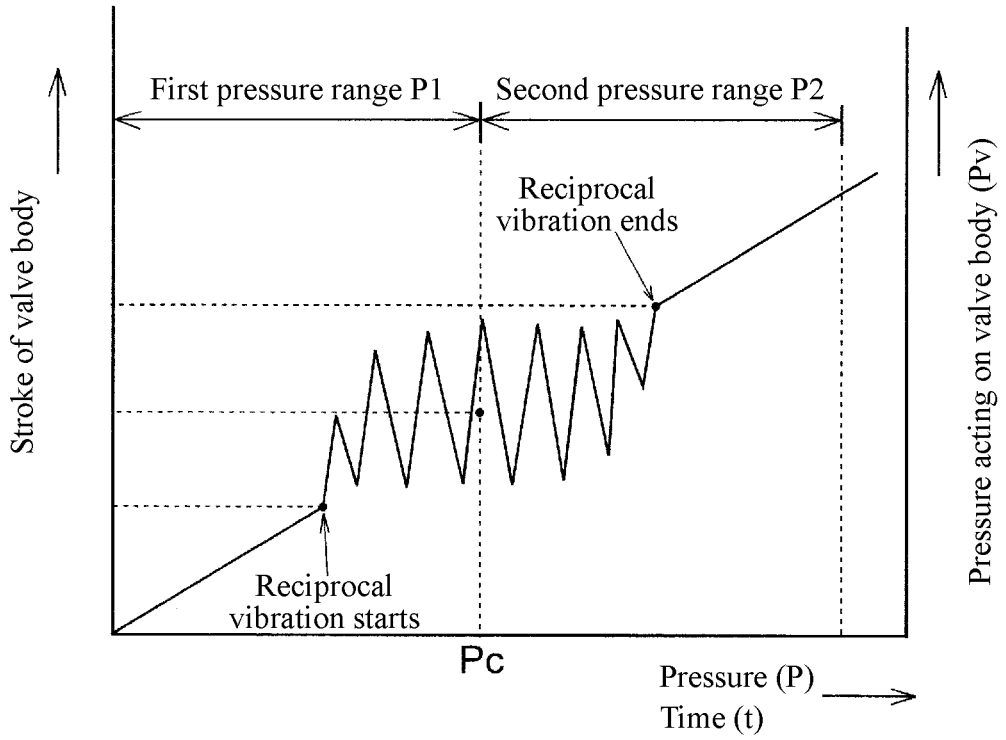
FIG. 13 is a graph illustrating a relation among the pressure of the operating oil acting on a pressure receiving part of the valve body and the stroke and the reciprocal vibration of the valve body through time.

Accordingly, at the time when the valve body 40 is switched to the position corresponding to the advance position from the position corresponding to the retard position, as shown in FIG. 13, the reciprocal movement toward the advance direction Da and the retard direction Dr is repeated several times with the fluctuations of the pressure Pv of the operating oil acting on the valve body 40. That is, since the valve 40 slides in the sleeve 30 in the form of a spool valve, the reciprocal vibration is generated without a hitting sound, a shock, etc.

Then, when the pressure P of the operating oil exceeds a predetermined level, the reciprocal vibration is ceased from occurring, and the valve body 40 reaches the maximal opening stroke and stops, as shown in FIG. 7. At this time, as shown in FIGS. 8 and 13, the valve timing is maintained at the advance position (here, the most advance position) as the second angle position. Meanwhile, at the time when the valve body 40 is moved from the position corresponding to the advance position to the position corresponding to the retard position, the valve body 40 is moved smoothly without generating reciprocal vibration.

Figure 12:
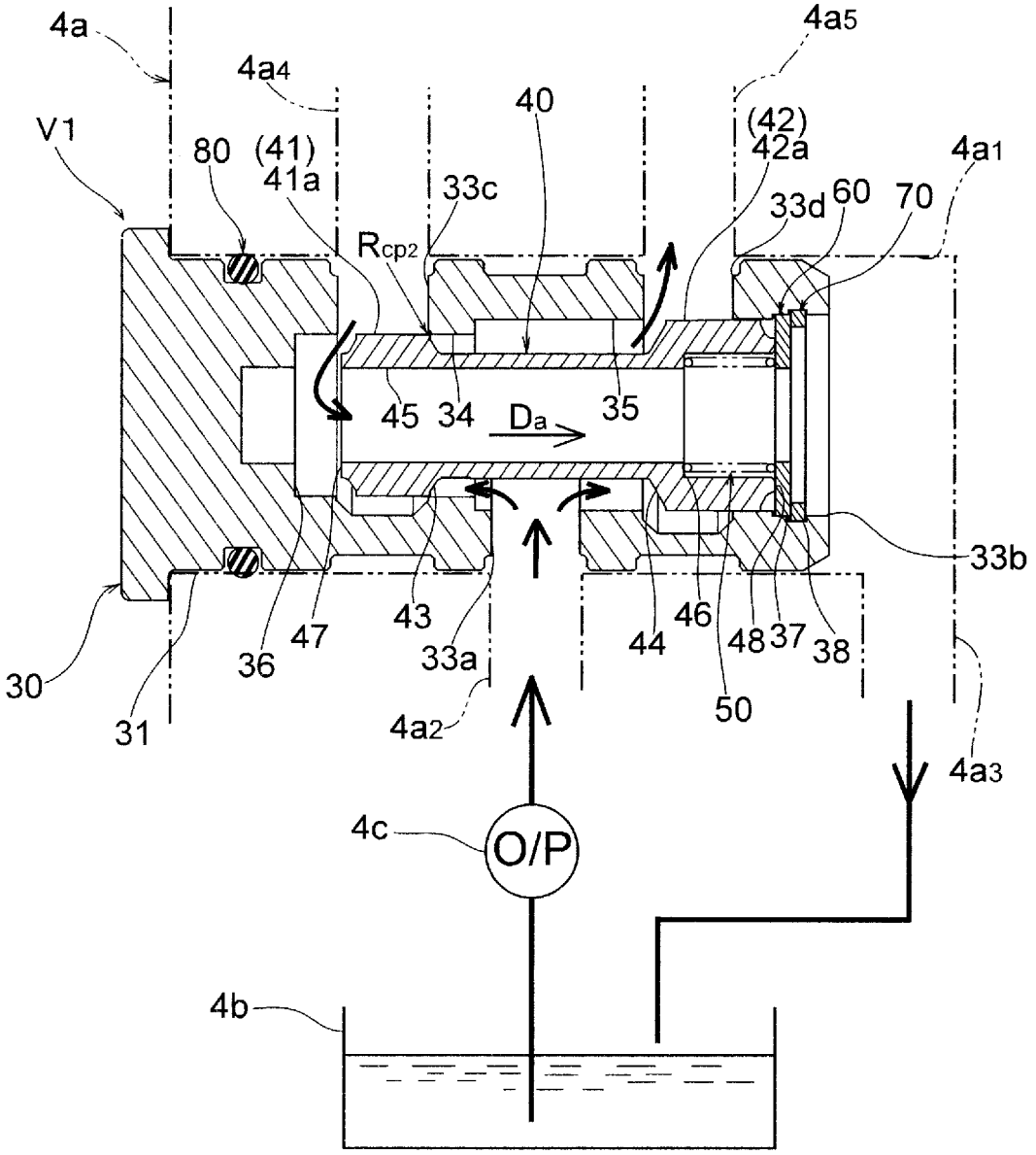
FIG. 12 is a cross-sectional view illustrating a state in which, in the oil passage switching valve according to the first embodiment, the valve closing timing of the first valve part is set as later than the valve opening timing of the second valve part and before the second valve part reaches a maximum valve opening stroke.

Besides, the valve closing timing of the first valve part 41 may also be set as later than the valve opening timing Aop of the second valve part 42. For example, as shown in FIG. 12, a valve closing timing Rcp2 of the first valve part 41 may also be set, at the latest, as before the second valve part 42 abuts against the receiving member 60 to reach the maximum valve opening stroke.

Even in such configuration, as described above, the reciprocal vibration of the valve body 40 can be generated without a hitting sound, a shock, etc.

In addition, the amplitude of the reciprocal vibration can be adjusted by appropriately choosing the lap margin between the outer peripheral surface 41*a* and the inner peripheral surface 34 and the lap margin between the outer peripheral surface 42*a* and the inner peripheral surface 35 in the relation between the valve body 40 and the sleeve 30.

As described above, by generating reciprocal vibration in the valve body 40, foreign matters in the valve body 40 can be discharged or crushed, and the cleaning mode for preventing an operation failure due to entrapment of the foreign matters, etc., can be provided.

Accordingly, even if there is no electromagnetic driving source that drives the valve body as in the conventional art, the cost, etc., can be reduced, and the reliability of the oil passage switching valve V1 can be increased.

FIG. 14 to FIG. 17 illustrate an oil passage switching valve V2 according to the second embodiment of the invention. The same configuration as that in the above embodiment will be labeled with the same reference symbol, and the descriptions thereof will be omitted.

Figure 14:
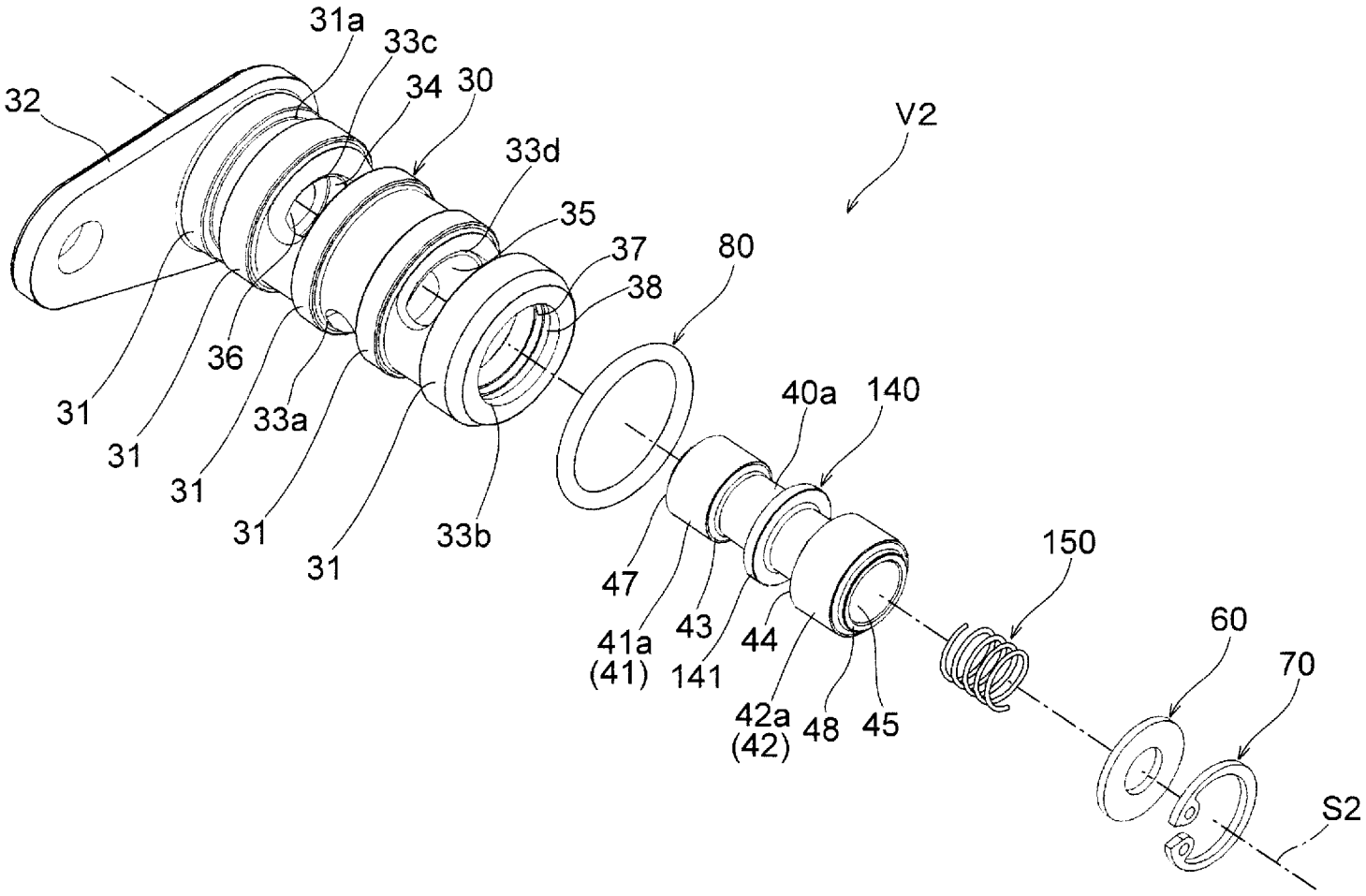
FIG. 14 is an exploded oblique view illustrating an oil passage switching valve according to a second embodiment of the invention.

The oil passage switching valve V2 is attached to the main body 4*a* of the engine 4. As shown in FIG. 14, the oil passage switching valve V1 includes the sleeve 30 in a substantially cylindrical shape elongated in the direction of the axis S2, the valve body 140 that is in a substantially cylindrical shape elongated in the direction of the axis S2, the urging spring 150, the receiving member 60, the snap ring 70, and the seal member 80.

As shown in FIGS. 14 to 17, the valve body 140 includes the cylindrical part 40*a*, the first valve part 41, the second valve part 42, the first pressure receiving part 43 and the second pressure receiving part 44 as the pressure receiving part, the through hole 45, the receiving part 46, the first end part 47, the second end part 48, and an auxiliary pressure receiving part 141.

Between the first pressure receiving part 43 and the second pressure receiving part 44, the auxiliary pressure receiving part 141, when viewed from the direction of the axis S2, has a pressure receiving area same as the second pressure receiving part 44, and is formed in an annular shape having the same outer diameter as the outer diameter of the second valve part 42.

Figure 15:
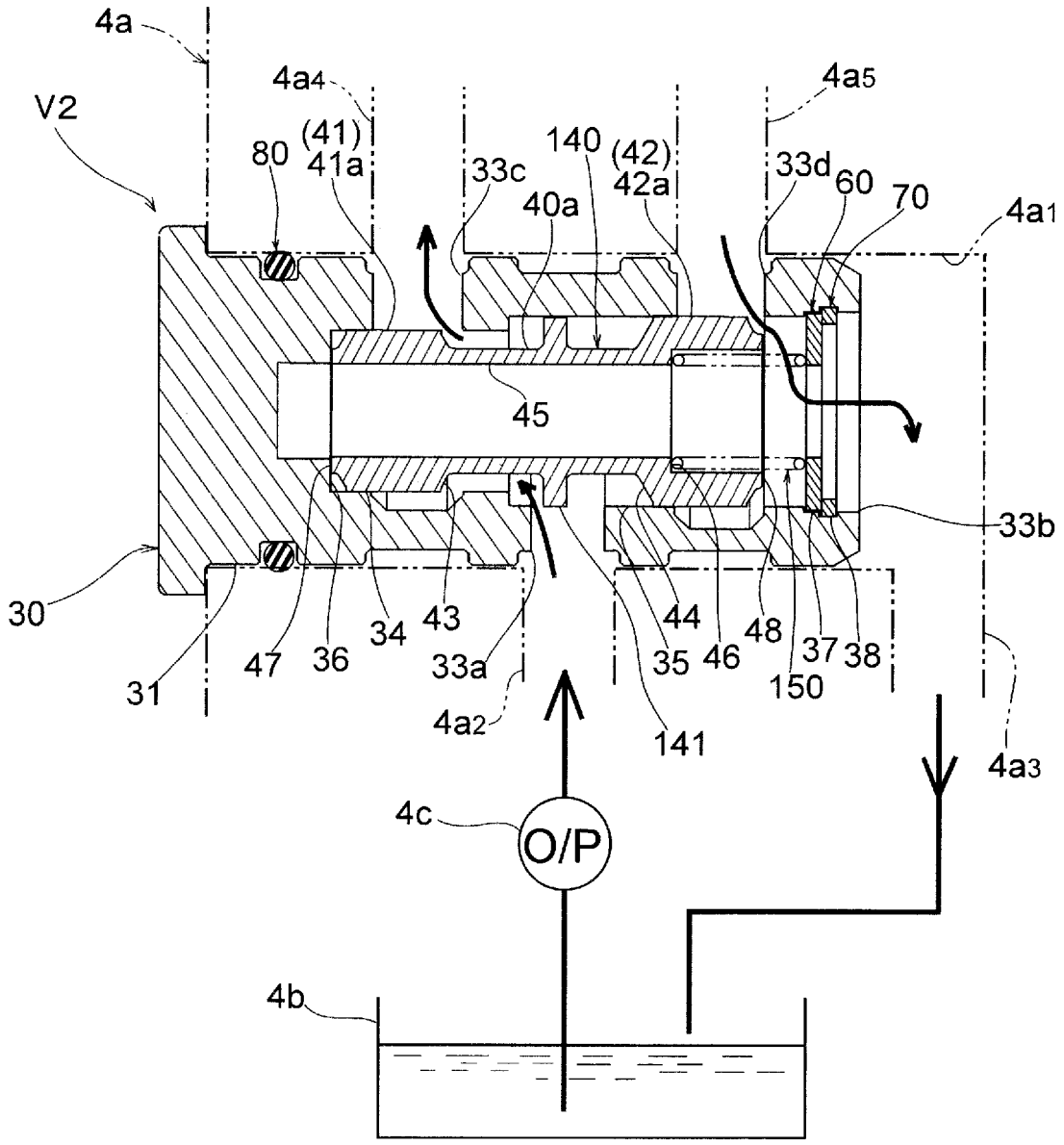
FIG. 15 is a view illustrating a state in which, in the oil passage switching valve according to the second embodiment, a valve body is at a position corresponding to a retard position (first angle position) and operating oil can be supplied to a retard chamber.
Figure 16:
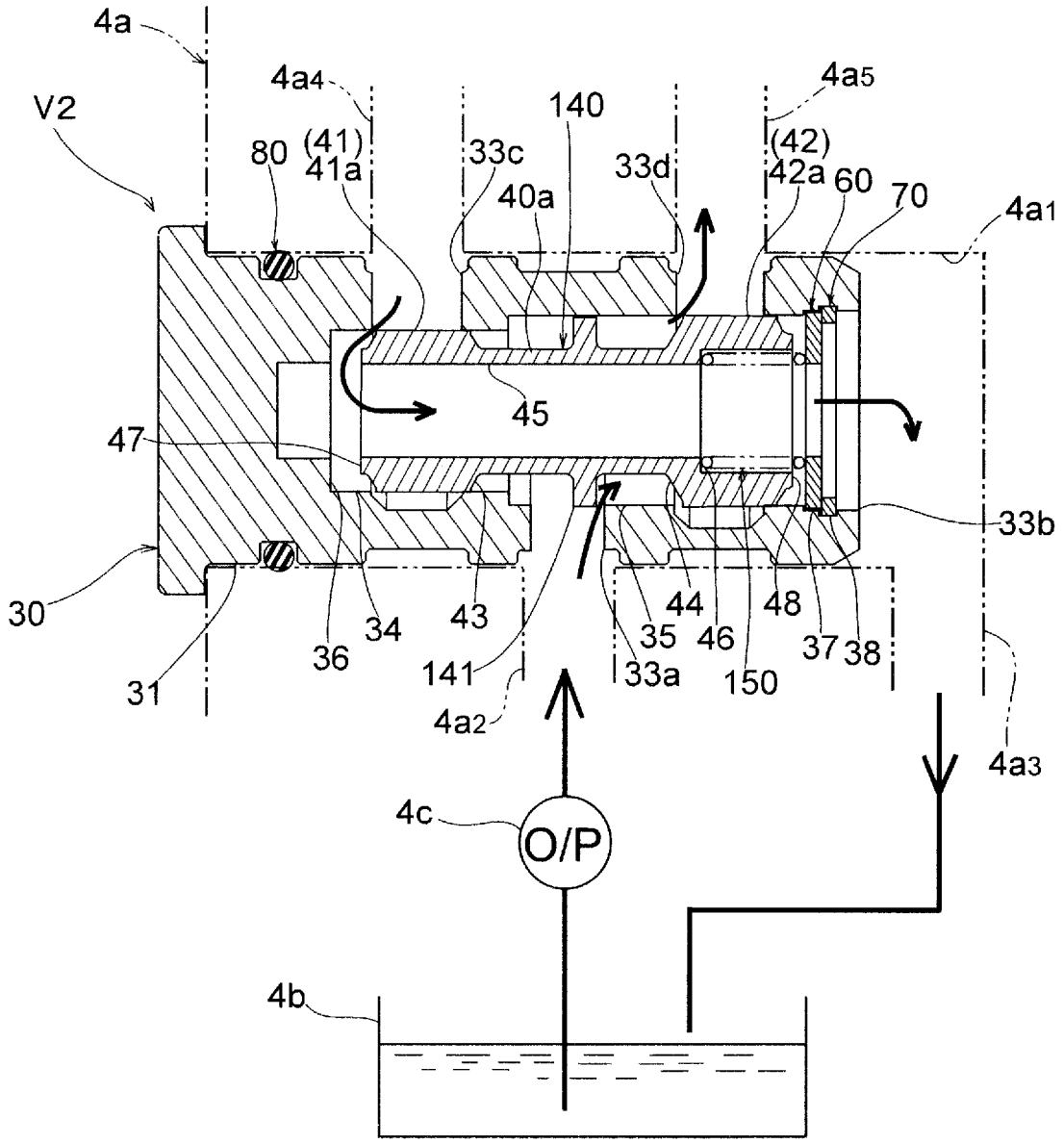
FIG. 16 is a view illustrating a state in which, in the oil passage switching valve according to the second embodiment, a valve body is at a position corresponding to an advance position (second angle position) and operating oil can be supplied to an advance chamber.
Figure 17:
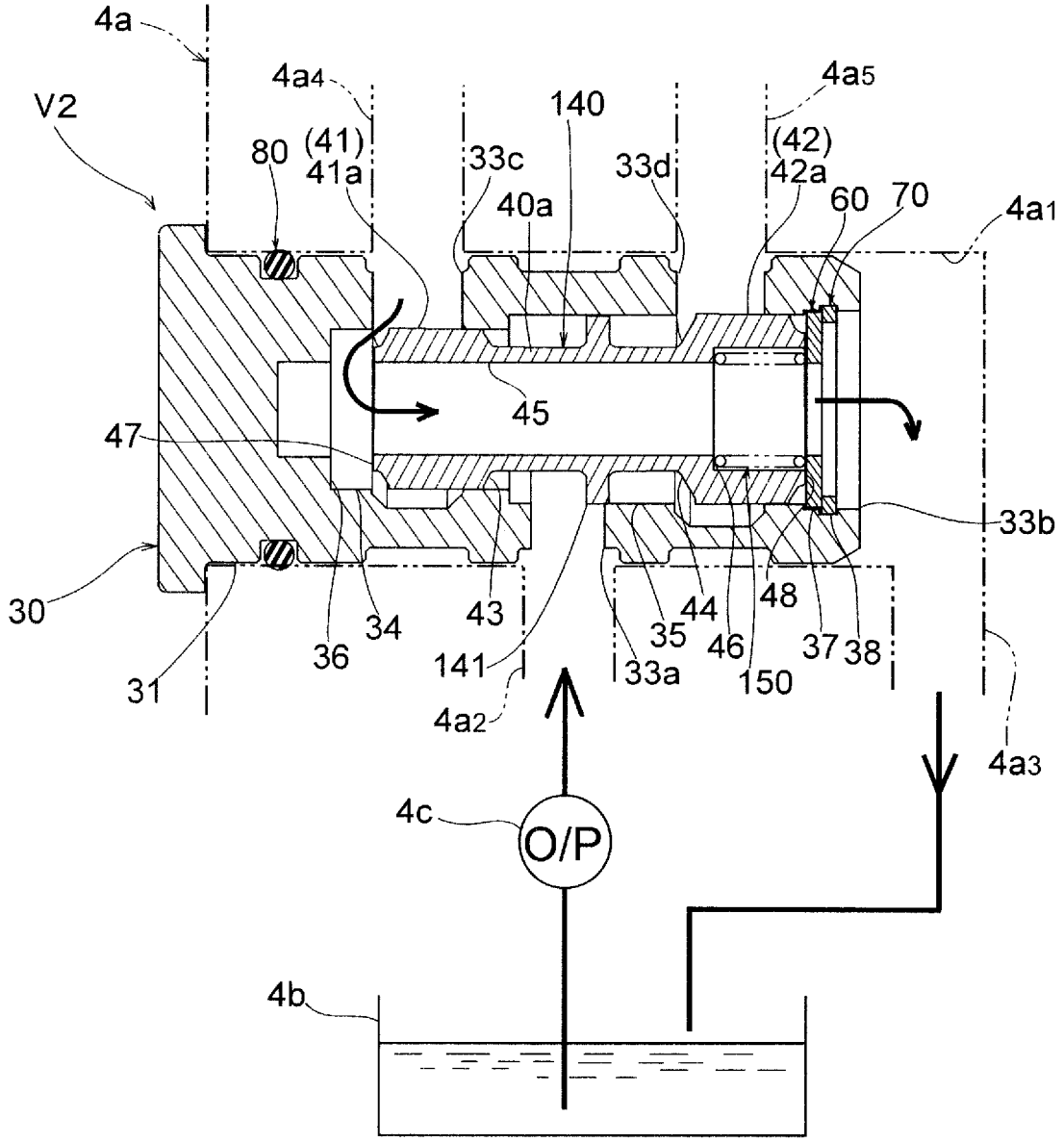
FIG. 17 is a view illustrating a state in which, in the oil passage switching valve according to the second embodiment, at the time when the pressure of the operating oil is an engine cold condition pressure greater than the second pressure range, an auxiliary pressure receiving part receives the engine cold condition pressure, the valve body is at a position that cuts off supply of the operating oil to the advance chamber, and the retard position (first angle position) is selected.

In addition, the auxiliary pressure receiving part 141 is formed so as to be positioned in a region facing the supply port 33*a* in the state in which the first end part 47 of the valve body 140 abuts against the receiving part 36 to open the oil passage between the retard port 33*c* and the supply port 33*a*, as shown in FIG. 15, open the oil passage between the advance port 33*d* and the supply port 33*a* when the second end part 48 of the valve body 140 leaves the receiving member 60 to be positioned in a region facing the supply port 33*a*, as shown in FIG. 16, and closely contact the inner peripheral surface 35 in the state in which the second end part 48 of the valve body 140 abuts against the receiving member 60 to block the oil passage between the advance port 33*d* and the supply port 33*a*, as shown in FIG. 17.

The urging spring 150 is a compression type coil spring, and is assembled so that one end part abuts against the receiving part 46 of the valve body 140, and the other end part abuts against the receiving member 60.

Then, at the time of the pause state and that the pressure P of the operating oil is in the first pressure range P1, the urging spring 150 applies an urging force for stopping at the position at which the first end part 47 of the valve body 140 abuts against the receiving part 36 of the sleeve 30, that is, the position corresponding to the retard position as the first angle position.

In addition, when the pressure P of the operating oil is in the second pressure range P2, the urging spring 150 applies an urging force that maintains the valve body 140 at a position at which the second end part 48 of the valve body 140 is separate from the receiving member 60, and when the pressure P of the operating oil receives the engine cold condition pressure greater than the second pressure range P2, the urging spring 150 applies an urging force so that the second end part 48 of the valve body 140 abuts against the receiving member 60.

Then, in the case of starting the engine 4 mounted in the range extender vehicle EV, the operation of the valve timing changing apparatus M1 using the oil passage switching valve V2 will be described based on FIGS. 15 to 17.

Firstly, in the stopped state of the engine 4, the oil passage switching valve V2 is in the pause state. At this time, as shown in FIG. 15, the valve body 140 is urged toward a direction by the urging force of the urging spring 150, the first valve part 41 is in the open-valve state in which the oil passage between the retard port 33*c* and the supply port 33*a* is opened, the second valve part 42 is in the close-valve state in which the oil passage between the advance port 33*d* and the supply port 33*a* is closed, and the auxiliary pressure receiving part 141 is in the state of facing the supply port 33*a*.

At this time, the retard chamber RC is in the state in which the operating oil is supplied, and the advance chamber AC is in the state in which the operating oil is discharged.

In addition, in the stopped state of the engine 4, the valve timing, as shown in FIG. 6, is maintained at the retard position as the first angle position. Here, in the stopped state of the engine 4, the valve timing may also be maintained at the retard position by using the lock mechanism shown in the valve timing changing mechanism M2 according to the second embodiment to be described in the following. At the time when the engine 4 is transitioned from the state in which the valve timing is at an intermediate position to the advance position when the engine 4 is operating to the stopped state, the valve timing is automatically returned to the retard position by a fluctuation torque and a friction torque transmitted from the camshaft 4*d*.

Then, when the engine 4 is started, via the oil pump 4*c*, the pressure P of the operating oil is gradually increased, as shown in FIG. 9.

During the light load mode at the time of starting or low rotation speed of the engine 4, as shown in FIG. 9, the pressure P of the operating oil is within the range of the first pressure range P1 as a first range smaller than a switching pressure Pc.

At this time, the urging force of the urging spring 150 is greater than the difference between the pressures of the operating oil received by the second pressure receiving part 44 and the first pressure receiving part 43, i.e., the pressure that the pressure receiving part receives, and the valve body 140 is in the state in which the first valve body 41 is opened and the second valve body 42 is closed, as shown in FIG. 15.

Therefore, the operating oil supplied through the supply port 33*a* is guided to the retard chamber RC through the retard port 33*c* and the retard oil passages 4*a*4, 4*d*2, and 14. Accordingly, the valve timing is maintained at the retard position shown in FIG. 6.

Meanwhile, during the intermediate/high load mode of the engine 4, as shown in FIG. 9, the pressure P of the operating oil is transitioned to the range of the second pressure range P2 as a second range greater than the switching pressure Pc.

At this time, the difference between the pressures of the operating oil received by the second pressure receiving part 44 and the first pressure receiving part 43, i.e., the pressure that the pressure receiving part receives, overcomes the urging force of the urging spring 150, and the valve body 140 is moved toward the direction of contracting the urging spring 150. As shown in FIG. 16, the first valve body 41 is changed to the close-valve state in which the oil passage between the retard port 33*c* and the supply port 33*a* is closed, and the second valve part 42 is in the open-valve state in which the oil passage between the advance port 33*d* and the supply port 33*a* is opened. The auxiliary pressure receiving part 141 is still in the state of facing the supply port 33*a*.

Therefore, the operating oil supplied through the supply port 33*a* is guided to the advance chamber AC through the advance port 33*d* and the advance oil passages 4*a*5, 4*d*3, and 21*c*. Meanwhile, the operating oil in the retard chamber RC is guided to the discharge port 33*b* through the retard oil passages 14, 4*d*2, and 4*a*4, the retard port 33*c*, and the through hole 45, and is returned to the oil pump 4*b* through the discharge oil passage 4*a*3.

Accordingly, as shown in FIG. 8, the valve timing is changed to and maintained at the advance position as the second angle position.

Here, when the engine 4 is in the engine cold state, the viscosity of the operating oil is greater than that in the engine warming state. Therefore, the pressure P of the operating oil is changed to the engine cold condition pressure greater than the second pressure range P2 even though the engine 4 is at a low rotation speed.

Under such environment, when the engine 4 is started, the difference between the engine cold condition pressures that the first pressure receiving part 43 and the auxiliary pressure receiving part 141 receive overcomes the urging force of the urging spring 150, so the valve body 140 is moved until the second end part 48 of the valve body 140 abuts against the receiving member 60.

Accordingly, the auxiliary pressure receiving part 141 closely contacts the inner peripheral surface 35 to close the oil passage between the supply port 33*a* and the advance port 33*d*. Therefore, at the time of starting the engine 4, the operating oil is prevented from being supplied to the advance chamber AC.

At this time, the retard chamber RC is changed to the state of communicating with the discharge port 33*b* through the retard oil passages 14, 4*d*2, and 4*a*4, the retard port 33*c*, and the through hole 45. Although the operating oil is not supplied to the retard chamber RC, the valve timing is automatically positioned to the retard position by a fluctuation torque and a friction torque transmitted from the camshaft 4*d*. Therefore, the valve timing is maintained at the retard position shown in FIG. 6.

Then, when the engine 4 enters the engine warming state, the viscosity of the operating oil is lowered and the pressure becomes normal.

Then, in response to the pressure P of the operating oil, the valve body 140 is switched to one of the position corresponding to the retard position shown in FIG. 15 and the position corresponding to the advance position shown in FIG. 16.

Accordingly, with the first pressure receiving part 43 and the second pressure receiving part 44, as the switching element, disposed in the valve body 140 switching the position of the valve body 140 in response to the pressure P of the operating oil while resisting the urging force of the urging spring 150, the valve body 140 is positioned to the position corresponding to the retard position at the time when the pressure P of the operating oil is in the first pressure range P1, and the valve body 140 is positioned to the position corresponding to the advance position at the time when the pressure P of the operating oil is in the second pressure range P2 greater than the first pressure range P1.

In addition, when the pressure P of the operating oil is the engine cold condition pressure greater than the second pressure range P2, the auxiliary pressure receiving part 141 receives the engine cold condition pressure to position the valve body 140 at a position deviated from the position corresponding to the second angle position, so as to select the retard position as the first angle position.

According to the oil passage switching valve V2 with the above configuration, the driving force of the valve body 140 is not the conventional electromagnetic force, but a force according to the pressure P of the operating oil. Therefore, compared with the electromagnetically driven switching valve in the conventional technology, the simple structure, the low cost, the light weight, the small size, etc., can be attained.

Here, since the urging spring 150 is disposed in the sleeve 30, the oil passage switching valve V2 can be miniaturized by consolidating the components.

In addition, since the valve body 140 has the through hole 45 as the discharge oil passage that guides the operating oil to the discharge port 33*b*, compared with the case where the discharge oil passage is arranged on another route, the valve body 140 can be miniaturized by consolidating the configuration.

In addition, with the auxiliary pressure receiving part 141, at the time of engine cold condition, since the valve timing is maintained at the retard position without moving to the advance position, the ability to start the engine 4 can be ensured.

In the oil passage switching valve V2 according to the second embodiment, during the oil passage switching operation from the state shown in FIG. 15 to the state shown in FIG. 16, the valve body 140 may also be arranged to vibrate reciprocally to result in the cleaning mode.

Figure 18:
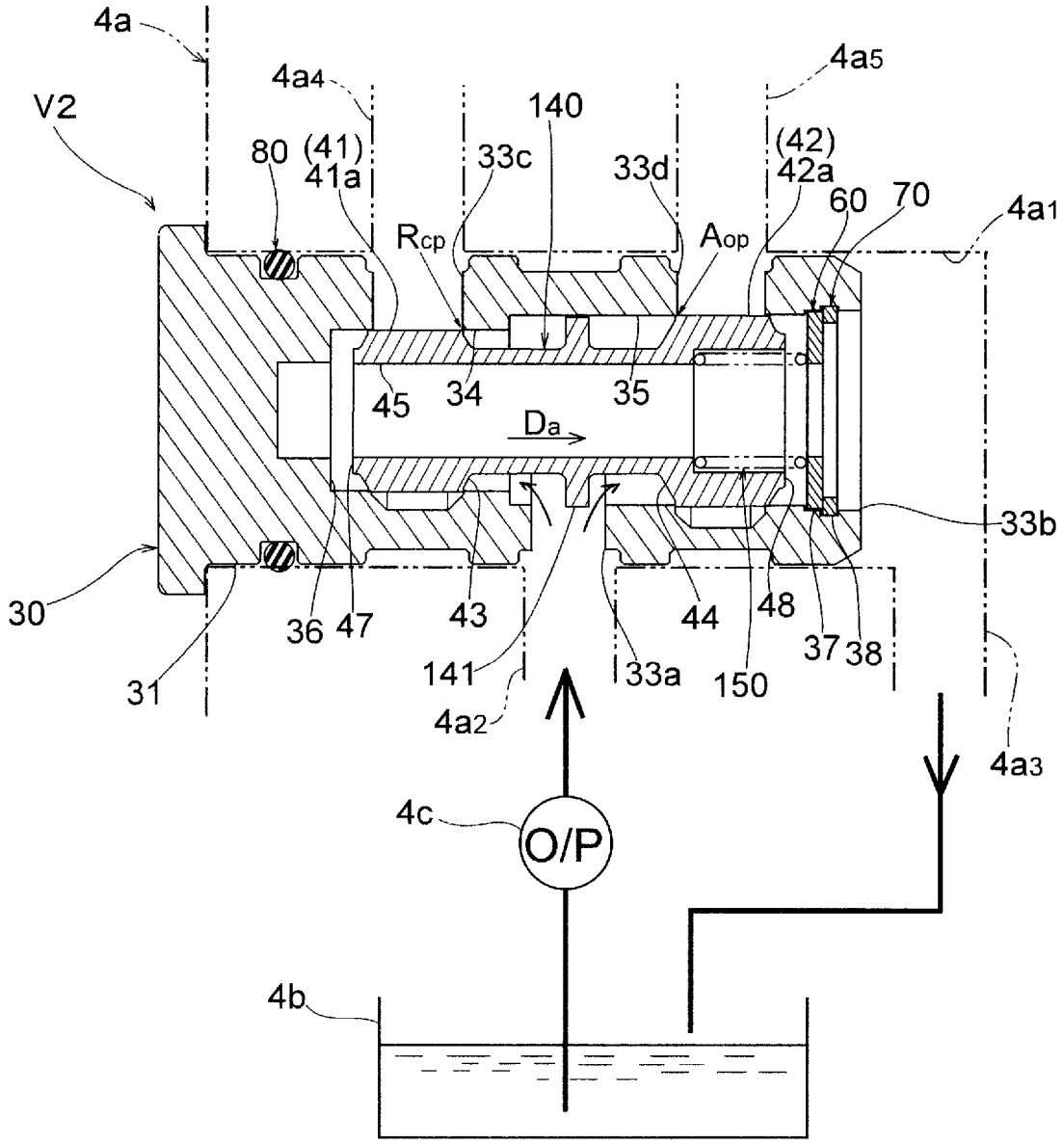
FIG. 18 is a cross-sectional view illustrating a state in which, in an oil passage switching valve according to a second embodiment, the valve closing timing of a first valve part and the valve opening timing of a second valve part are set to be as simultaneous.

Specifically, as shown in FIG. 18, at the time when the valve body 140 resists the urging force of the urging spring 150 to move in the sleeve 30, the lap margin between the outer peripheral surface 41*a* and the inner peripheral surface 34 and the lap margin between the outer peripheral surface 42*a* and the inner peripheral surface 35, etc., are set, so that the timing Rcp at which the outer peripheral surface 41*a* of the first valve part 41 starts closely contacting the inner peripheral surface 34 of the sleeve 30 facing the first pressure receiving part 43 is simultaneous with the timing Aop at which the outer peripheral surface 42*a* of the second valve part 42 starts leaving the inner peripheral surface 35 of the sleeve 30 facing the second pressure receiving part 44.

That is, the valve closing timing Rcp of the first valve part 41 is set as simultaneous with the valve opening timing Aop of the second valve part 42.

Figure 19:
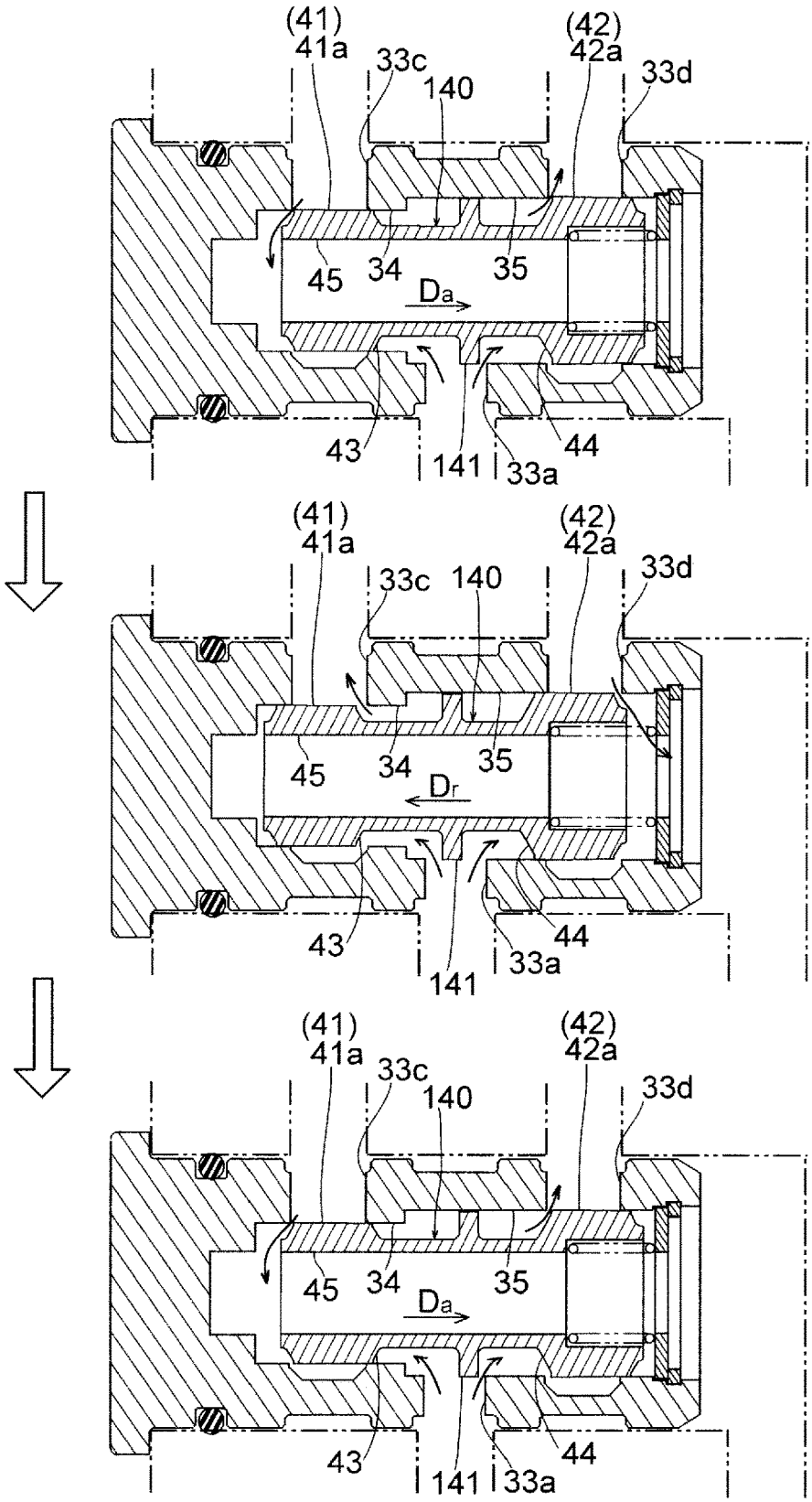
FIG. 19 is a view illustrating a state in which, in the oil passage switching valve according to the second embodiment, the valve body generates reciprocal vibrations.

According to the configuration, together with the rising of the pressure P of the operating oil guided through the supply oil passage 4*a*2, as shown in FIG. 19, when the valve body 140 resists the urging force of the urging spring 150 to move in the advance direction Da, the first valve 41 is closed to close the oil passage between the retard port 33*c* and the supply port 33*a* and the second valve 42 is opened to open the oil passage between the advance port 33*d* and the supply port 33*a*, and the pressure of the operating oil acting on the second pressure receiving part 44 is temporarily lowered.

That is, with lowering of a pressure Pv of the operating oil acting on the valve body 140, the valve body 140 is moved toward the retard direction Dr due to the urging force of the urging spring 150 to the position at which the pressure Pv of the operating oil and the urging force of the urging spring 150 are balanced, the first valve body 41 is opened to release the oil passage between the retard port 33*c* and the supply port 33*a*, and the second valve part 42 is closed to close the oil passage between the advance port 33*d* and the supply port 33*a*.

Together with that the pressure pv of the operating oil acting on the valve body 140 rises again, the valve body 140 resists the urging force of the urging spring 150 to move in the advance direction Da, the first valve body 41 is closed to close the oil passage between the retard port 33*c* and the supply port 33*a*, the second valve part 42 is opened to open the oil passage between the advance port 33*d* and the supply port 33*a*, and the pressure of the operating oil acting on the second pressure receiving part 44 is temporarily lowered.

Accordingly, at the time when the valve body 140 is switched to the position corresponding to the advance position from the position corresponding to the retard position, as shown in FIG. 13, the reciprocal movement toward the advance direction Da and the retard direction Dr is repeated several times with the fluctuations of the pressure Pv of the operating oil acting on the valve body 140. That is, since the valve 140 slides in the sleeve 30 in the form of a spool valve, the reciprocal vibration is generated without a hitting sound, a shock, etc.

Then, when the pressure P of the operating oil exceeds a predetermined level, the reciprocal vibration is ceased from generating, and the valve body 140 stops at the position corresponding to the advance position shown in FIG. 16. At this time, as shown in FIGS. 8 and 13, the valve timing is maintained at the advance position (here, the most advance position) as the second angle position. Meanwhile, at the time when the valve body 140 is moved from the advance position to the retard position, the valve body 140 is moved smoothly without generating reciprocal vibration.

Figure 20:
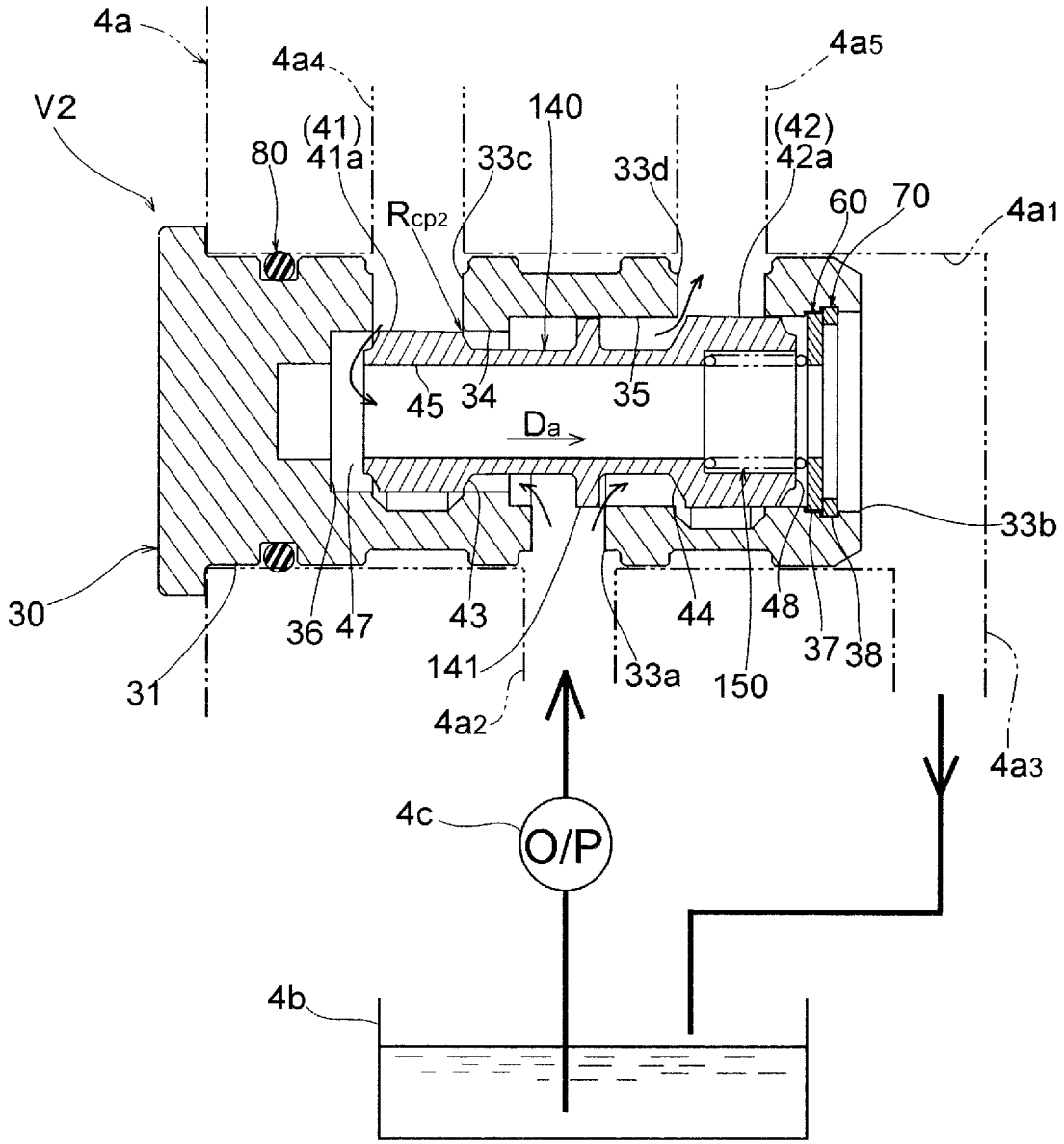
FIG. 20 is a cross-sectional view illustrating a state in which, in the oil passage switching valve according to the second embodiment, the valve closing timing of the first valve part is set as later than the valve opening timing of the second valve part and before the timing at which an auxiliary pressure receiving part closes an oil passage between a supply port and an advance port.

Besides, the valve closing timing of the first valve part 41 may also be set as later than the valve opening timing Aop of the second valve part 42. For example, as shown in FIG. 20, the valve closing timing Rcp2 of the first valve part 41 may also be set, at the latest, as before the timing at which the auxiliary pressure receiving part 141 blocks the oil passage between the supply port 33*a* and the advance port 33*d*.

Even in such configuration, as described above, the reciprocal vibration of the valve body 140 can be generated without a hitting sound, a shock, etc.

In addition, as described above, the amplitude of the reciprocal vibration can be adjusted by appropriately choosing the lap margin between the outer peripheral surface 41*a* and the inner peripheral surface 34 and the lap margin between the outer peripheral surface 42*a* and the inner peripheral surface 35 in the relation between the valve body 140 and the sleeve 30.

As described above, by generating reciprocal vibration in the valve body 140, foreign matters in the valve body 140 can be discharged or crushed, and the cleaning mode for preventing an operation failure due to entrapment of the foreign matters, etc., can be provided.

Accordingly, even if there is no electromagnetic driving source that drives the valve body as in the conventional art, the cost, etc., can be reduced, and the reliability of the oil passage switching valve V2 can be increased.

FIG. 21 to FIG. 24 illustrate an oil passage switching valve V3 according to the third embodiment of the invention. The same configuration as that of the above embodiment will be labeled with the same reference symbol, and the descriptions thereof will be omitted.

Figure 21:
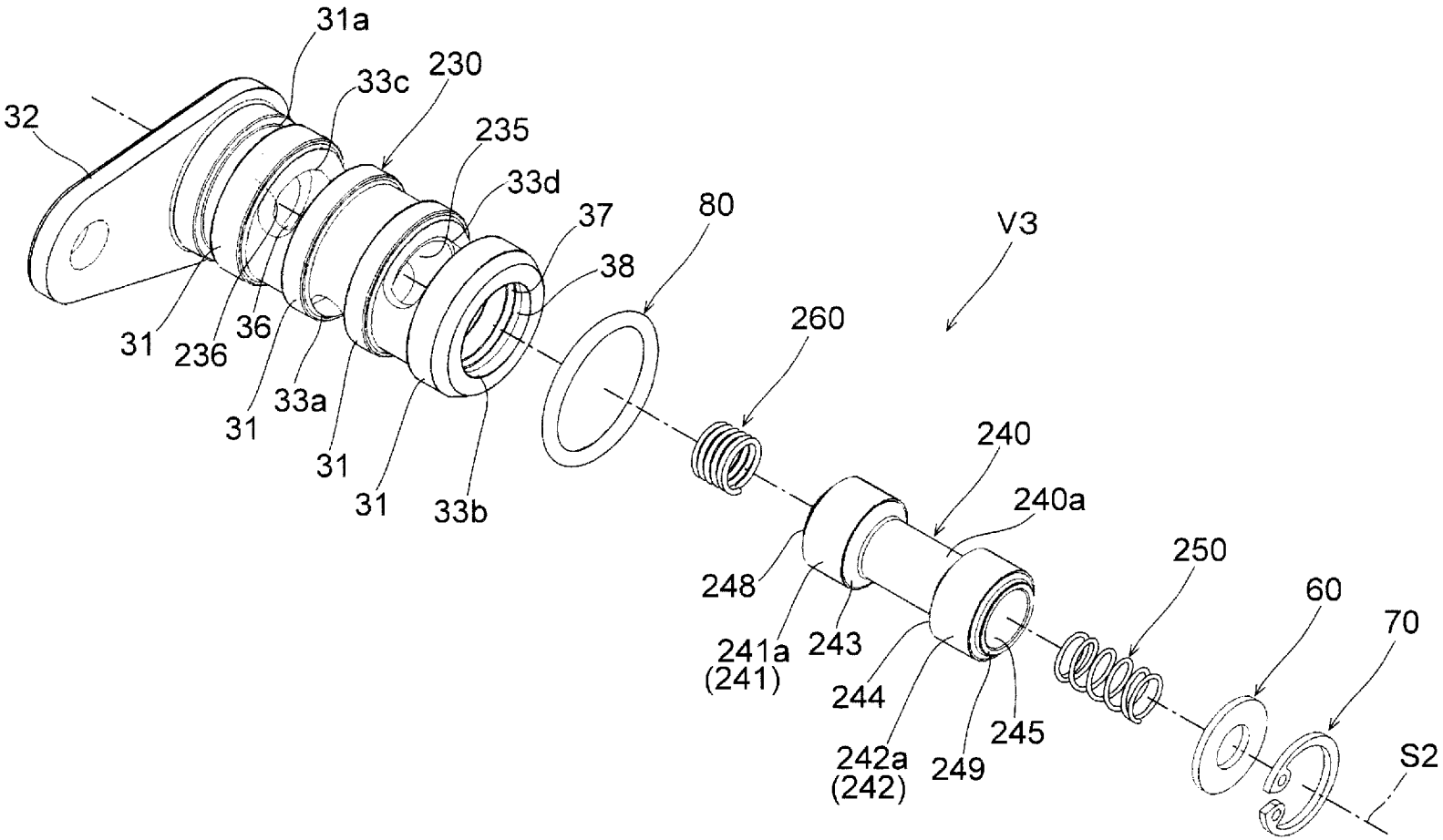
FIG. 21 is an exploded oblique view illustrating an oil passage switching valve according to a third embodiment of the invention.

The oil passage switching valve V3 is attached to the main body 4*a* of the engine 4. As shown in FIG. 21, the oil passage switching valve V3 includes a sleeve 230 in a substantially cylindrical shape elongated in the direction of the axis S2, a valve body 240 that is in a substantially cylindrical shape elongated in the direction of the axis S2, an urging spring 250, the receiving member 60, the snap ring 70, the seal member 80, and an urging member 260.

The sleeve 230 includes the outer peripheral surface 31, the seal groove 31*a* into which the seal member 80 is fit, the flange part 32 for fixing with the main body 4*a* by using a screw, the supply port 33*a*, the discharge part 33*b*, the retard port 33*c*, the advance port 33*d*, the receiving part 37, the receiving groove 37, the snap ring groove 38, an inner peripheral surface 235, and a receiving part 236.

The inner peripheral surface 235 is formed as a cylindrical surface with the axis S2 as the center, and is in close contact with a first valve part 241 and a second valve part 242 of the valve body 240 to guide slidably.

The receiving part 236 abuts against and stops an end part of the urging member 260.

The valve body 240 includes a cylindrical part 240*a*, the first valve part 241, the second valve part 242, an annular inclined surface part 243, an annular inclined surface part 244, a through hole 245, a receiving part 246, a receiving part 247, a first end part 248, and a second end part 249.

The first valve part 241 is formed in a cylindrical shape with the axis S2 as the center to slide on the inner peripheral surface 235 of the sleeve 230, defines an outer peripheral surface 241*a* having an outer diameter that is substantially equal to or slightly smaller than the inner diameter of the inner peripheral surface 235, and opens and closes the oil passage between the retard port 33*c* and the supply port 33*a*.

The second valve part 242 is formed in a cylindrical shape with the axis S2 as the center to slide on the inner peripheral surface 235 of the sleeve 230, defines an outer peripheral surface 242*a* having an outer diameter that is substantially equal to or slightly smaller than the inner diameter of the inner peripheral surface 235, and opens and closes the oil passage between the advance port 33*d* and the supply port 33*a*.

The annular inclined surface part 245 is formed to be adjacent to the first valve part 241. The annular inclined surface part 244 has the same area as the annular inclined surface 243 and is formed to be adjacent to the second valve part 242.

That is, the annular inclined surface part 243 and the annular inclined surface part 244 are connected with the cylindrical part 240*a* whose outer diameter is smaller than those of the first valve part 241 and the second valve part 242 and are disposed so as to face each other to sandwich the supply port 33*a* in the direction of the axis S2.

Therefore, the pressure P of the operating oil entering from the supply port 33*a* acts on the annular inclined surface part 243 and the annular inclined surface part 244 in directions opposite to each other to be cancelled out, and does not act as a force that moves the valve body 240 in the direction of the axis S2.

Figure 23:
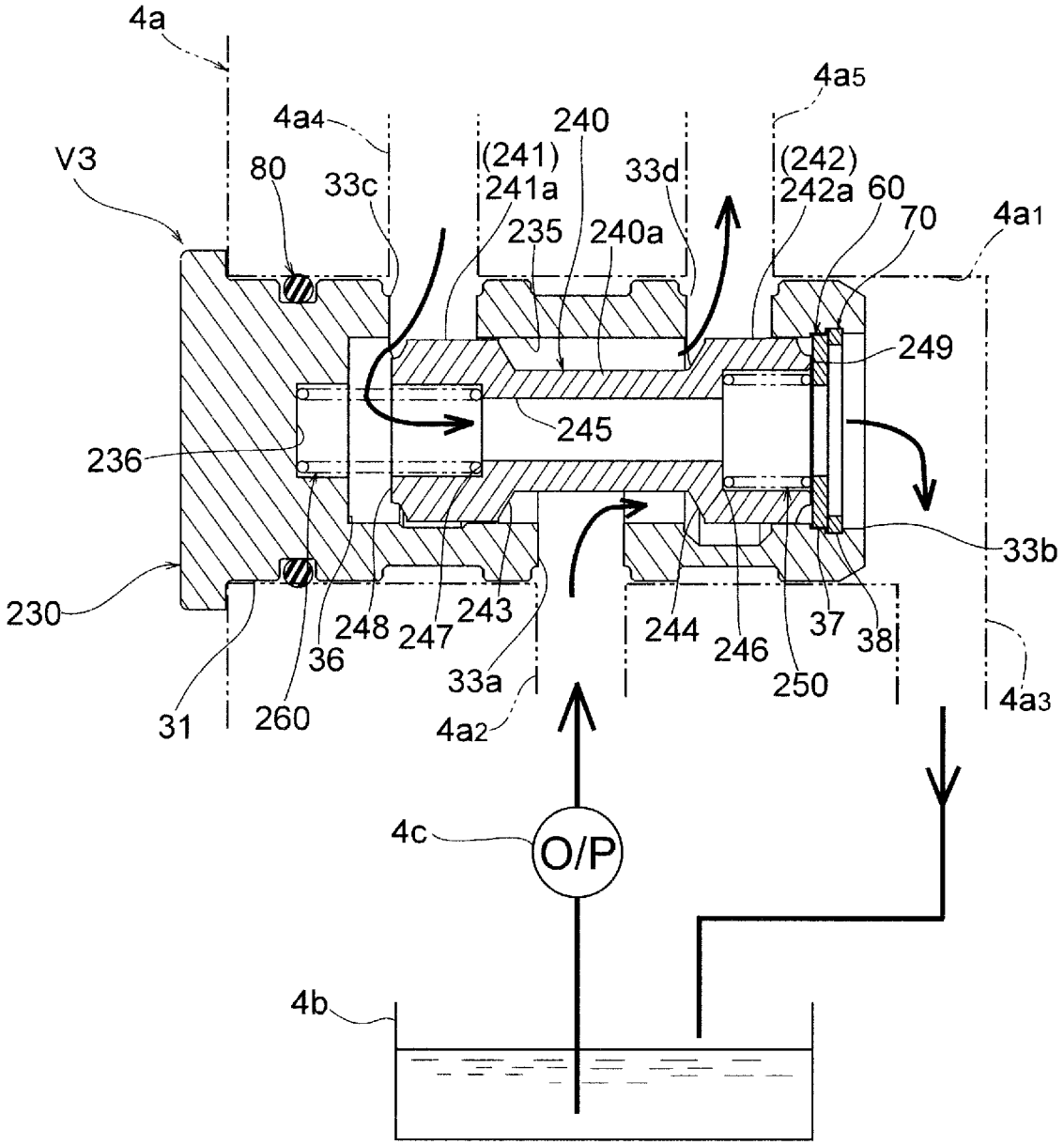
FIG. 23 is a view illustrating a state in which, in the oil passage switching valve according to the third embodiment, a valve body is at an advance position (second angle position) and the operating oil can be supplied to an advance chamber.

The through hole 245, as shown in FIG. 23, serves to discharge the operating oil in the retard chamber RC from the retard port 33*c* toward the discharge port 33*b* in the state in which the first valve part 241 closes the oil passage between the retard port 33*c* and the supply port 33*a*.

By enlarging a portion of the inner diameter of the through hole 245 toward the inner side in the direction of the axis S2 from the second end part 249, the receiving part 246 is formed as an annular surface defined in an inner side region of the second valve part 242 to receive an end part of the urging spring 250.

By enlarging a portion of the inner diameter of the through hole 245 toward the inner side in the direction of the axis S2 from the first end part 248, the receiving part 247 is formed as an annular surface defined in an inner region of the first valve part 241 to receive the other end part of the urging member 260.

The first end part 248 detachably abuts against the receiving part 36 of the sleeve 230.

The second end part 249 detachably abuts against the receiving member 60 attached to the receiving groove 37 of the sleeve 230.

The urging spring 250 is a compression type coil spring, and is assembled so that one end part abuts against the receiving part 246 of the valve body 240, and the other end part abuts against the receiving member 60.

Then, at the time of the pause state and that a temperature T of the operating oil is in a first temperature range T1, the urging spring 250 applies an urging force for stopping at the position at which the first end part 248 of the valve body 240 abuts against the receiving part 36 of the sleeve 230, that is, the position corresponding to the retard position as the first angle position and overcomes the urging force of the urging member 260.

The urging member 260 is formed in a coil shape by using a shape memory alloy, one end part of the urging member 260 abuts against the receiving part 236 of the sleeve 230, and the other end part of the urging member 260 is assembled so as to abut against the receiving part 247 of the valve body 240 or disposed inside the sleeve 230 to apply an urging force to the valve body 240 and resist the urging spring 250.

Then, the urging member 260 expands and contracts in the direction of the axis S2 under the influence of the temperature of the operating oil via the valve body 240, and is changed so that the urging force that urges the valve body 240 changes in response to the temperature T of the operating oil. Therefore, it is preferable that the valve body 240 is formed by a material having high thermal conductivity.

That is, the urging member 260 functions as a switching element that switches the position of the valve body 240 in response to the temperature T as the state quantity of the operating oil while resisting the urging force of the urging spring 250.

Figure 22:
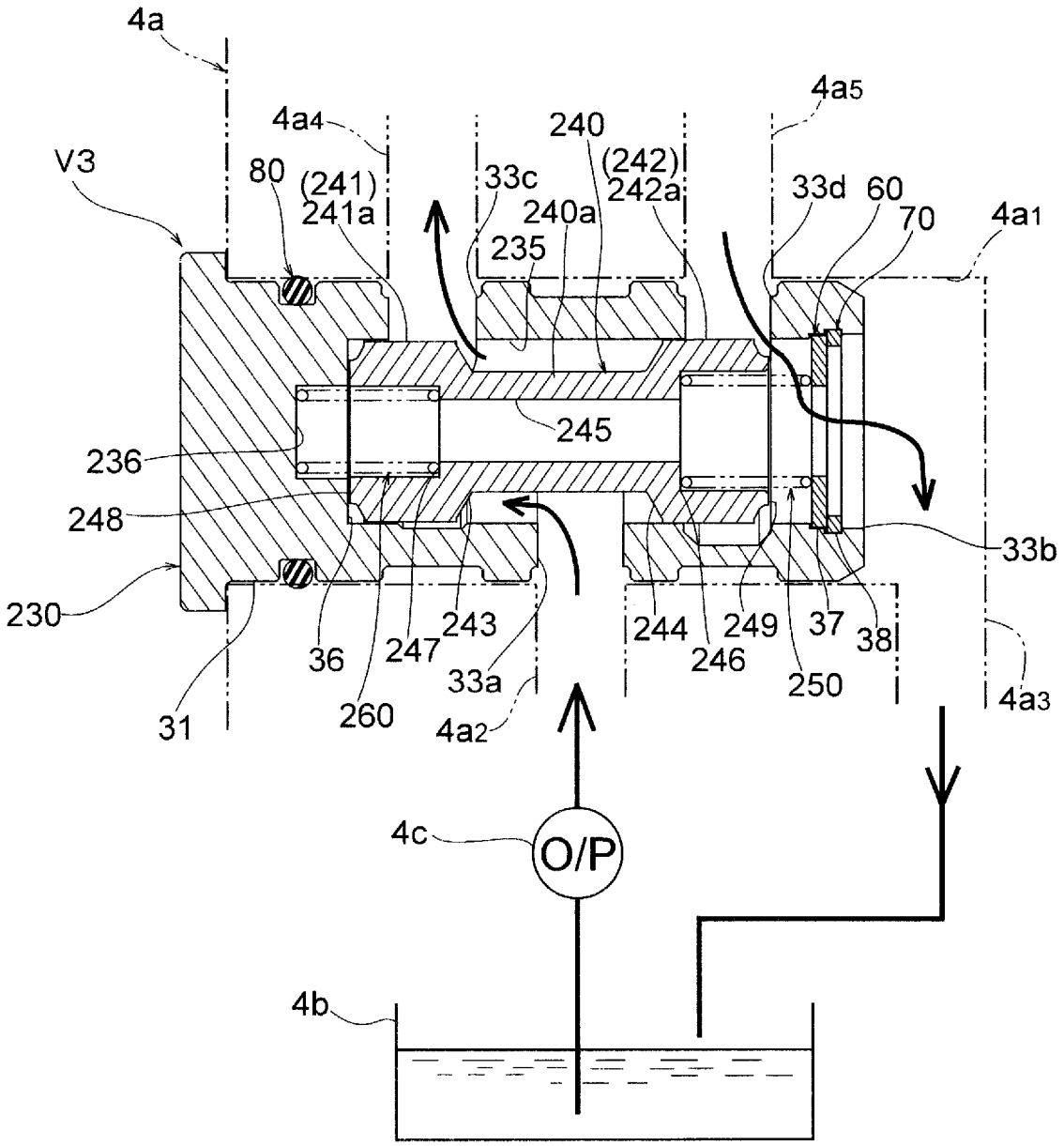
FIG. 22 is a view illustrating a state in which, in the oil passage switching valve according to the third embodiment, a valve body is at a position corresponding to a retard position (first angle position) and operating oil can be supplied to a retard chamber.
Figure 24:
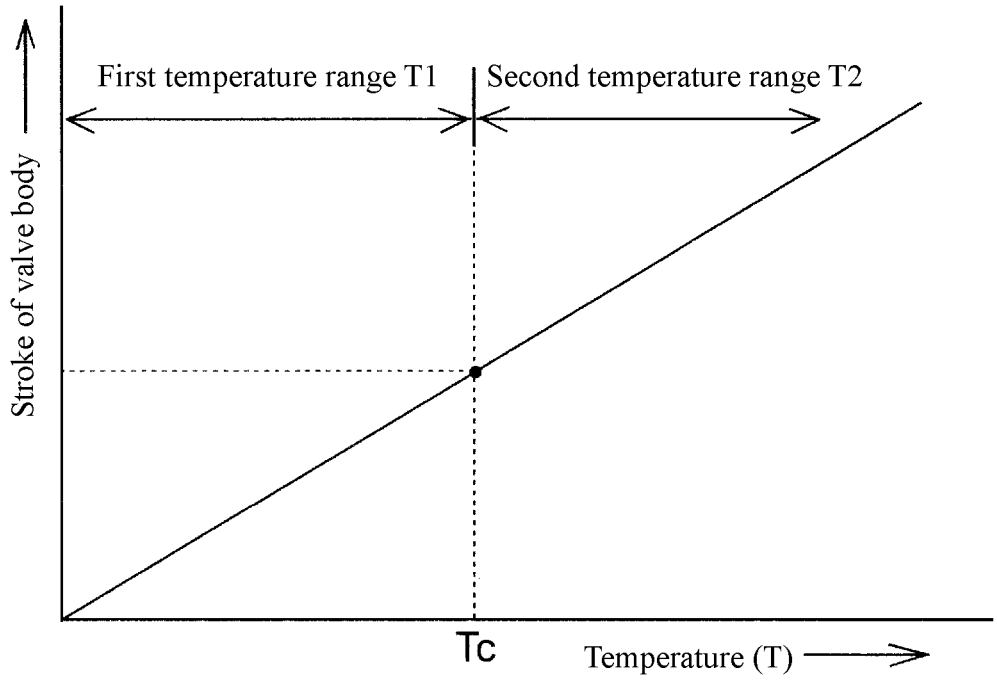
FIG. 24 is a graph illustrating a relation between the stroke of the valve body and the temperature of the operating oil as well as a first temperature range and a second temperature range.

Specifically, at the time of the pause state and that the temperature T of the operating oil is in the first temperature range T1 as shown in FIG. 24, the urging member 260 is changed to the contracted state as shown in FIG. 22, and the urging spring 250 applies an urging force for stopping the valve body 240 at the position at which the first end part 248 of the valve body 240 abuts against the receiving part 36 of the sleeve 230, that is, the position corresponding to the retard position as the first angle position.

Here, a switching temperature Tc may be set near 60 degrees, but the value is not limited thereto and may be suitably set in response to the specification of the engine 4 that is used.

Meanwhile, at the time when the temperature T of the operating oil is in the second temperature range T2 higher than the first temperature range T1, as shown in FIG. 23, the urging member 260 overcomes the urging force of the urging spring 250 to expand until the memorized form and applies an urging force for stopping the valve body 240 at the position at which the second end part 249 of the valve body 240 abuts against the receiving member 60, that is, the position corresponding to the advance position as the second angle position.

Then, in the case of starting the engine 4 mounted in the range extender vehicle EV, the operation of the valve timing changing apparatus M1 using the oil passage switching valve V3 will be described based on FIGS. 22 to 24.

Firstly, in the stopped state of the engine 4, the oil passage switching valve V3 is in the pause state. At this time, as shown in FIG. 22, the valve body 240 is urged toward a direction by the urging force of the urging spring 250, the first valve part 241 is in the open-valve state in which the oil passage between the retard port 33*c* and the supply port 33*a* is opened, and the second valve part 242 is in the close-valve state in which the oil passage between the advance port 33*d* and the supply port 33*a* is closed. At this time, the retard chamber RC is in the state in which the operating oil is supplied, and the advance chamber AC is in the state in which the operating oil is discharged.

In addition, in the stopped state of the engine 4, the valve timing, as shown in FIG. 6, is maintained at the retard position as the first angle position. Here, in the stopped state of the engine 4, the valve timing may also be maintained at the retard position by using the lock mechanism shown in the valve timing changing mechanism M2 according to the second embodiment to be described in the following. At the time when the engine 4 is transitioned from the state in which the valve timing is at an intermediate position to the advance position when the engine 4 is operating to the stopped state, the valve timing is automatically returned to the retard position by a fluctuation torque and a friction torque transmitted from the camshaft 4*d*.

Then, when the engine 4 is started, accompanying with the warming of the entire engine 4 as well as the increase in load, the temperature T of the operating oil gradually increases, as shown in FIG. 24.

During the light load mode at the time of starting or low rotation speed of the engine 4, as shown in FIG. 24, the temperature T of the operating oil is within the range of the first temperature range T1 as a first range smaller than the switching temperature Tc.

At this time, the urging force of the urging spring 250 is greater than the urging force that the urging member 260 applies, and the valve body 240 is in the state in which the first valve body 241 is opened and the second valve body 242 is closed, as shown in FIG. 22.

Therefore, the operating oil supplied through the supply port 33*a* is guided to the retard chamber RC through the retard port 33*c* and the retard oil passages 4*a*4, 4*d*2, and 14. Accordingly, the valve timing is maintained at the retard position shown in FIG. 6.

Meanwhile, during the intermediate/high load mode of the engine 4, as shown in FIG. 24, the temperature T of the operating oil is transitioned to the range of the second pressure range P2 as a second range higher than the switching temperature Tc.

At this time, the urging member 260 overcomes the urging force of the urging spring 250 to expand to the memorized form and abut against the receiving member 60 of the valve body 240, and, as shown in FIG. 23, the first valve body 241 is changed to the close-valve state in which the oil passage between the retard port 33*c* and the supply port 33*a* is closed, and the second valve part 242 is changed to the open-valve state in which the oil passage between the advance port 33*d* and the supply port 33*a* is opened.

Therefore, the operating oil supplied through the supply port 33*a* is guided to the advance chamber AC through the advance port 33*d* and the advance oil passages 4*a*5, 4*d*3, and 21*c*. Meanwhile, the operating oil in the retard chamber RC is guided to the discharge port 33*b* through the retard oil passages 14, 4*d*2, and 4*a*4, the retard port 33*c*, and the through hole 245, and is returned to the oil pump 4*b* through the discharge oil passage 4*a*3.

Accordingly, as shown in FIG. 8, the valve timing is changed to and maintained at the advance position as the second angle position.

Accordingly, with the urging member 260 as the switching element switching the position of the valve body 240 in response to the temperature T of the operating oil while resisting the urging force of the urging spring 250, the valve body 240 is positioned to the position corresponding to the retard position at the time when the temperature T of the operating oil is in the first temperature range T1, and the valve body 240 is positioned to the position corresponding to the advance position at the time when the temperature T of the operating oil is in the second temperature range T2 higher than the first temperature range T1.

According to the oil passage switching valve V3 with the above configuration, the driving force of the valve body 240 is not the conventional electromagnetic force, but a force according to the temperature T of the operating oil. Therefore, compared with the electromagnetically driven switching valve in the conventional technology, the simple structure, the low cost, the light weight, the small size, etc., can be attained.

Here, since the urging spring 250 and the urging member 260 are disposed in the sleeve 230, the oil passage switching valve V3 can be miniaturized by consolidating the components.

In addition, since the valve body 240 has the through hole 245 as the discharge oil passage that guides the operating oil to the discharge port 33*b*, compared with the case where the discharge oil passage is arranged on another route, the valve body 240 can be miniaturized by consolidating the configuration.

FIG. 25 to FIG. 33 illustrate the valve timing changing apparatus M2 according to the second embodiment and the oil passage switching valve V3 according to the fourth embodiment of the invention. The same configuration as that of the above embodiments will be labeled with the same reference symbol, and the descriptions thereof will be omitted.

Figure 25:
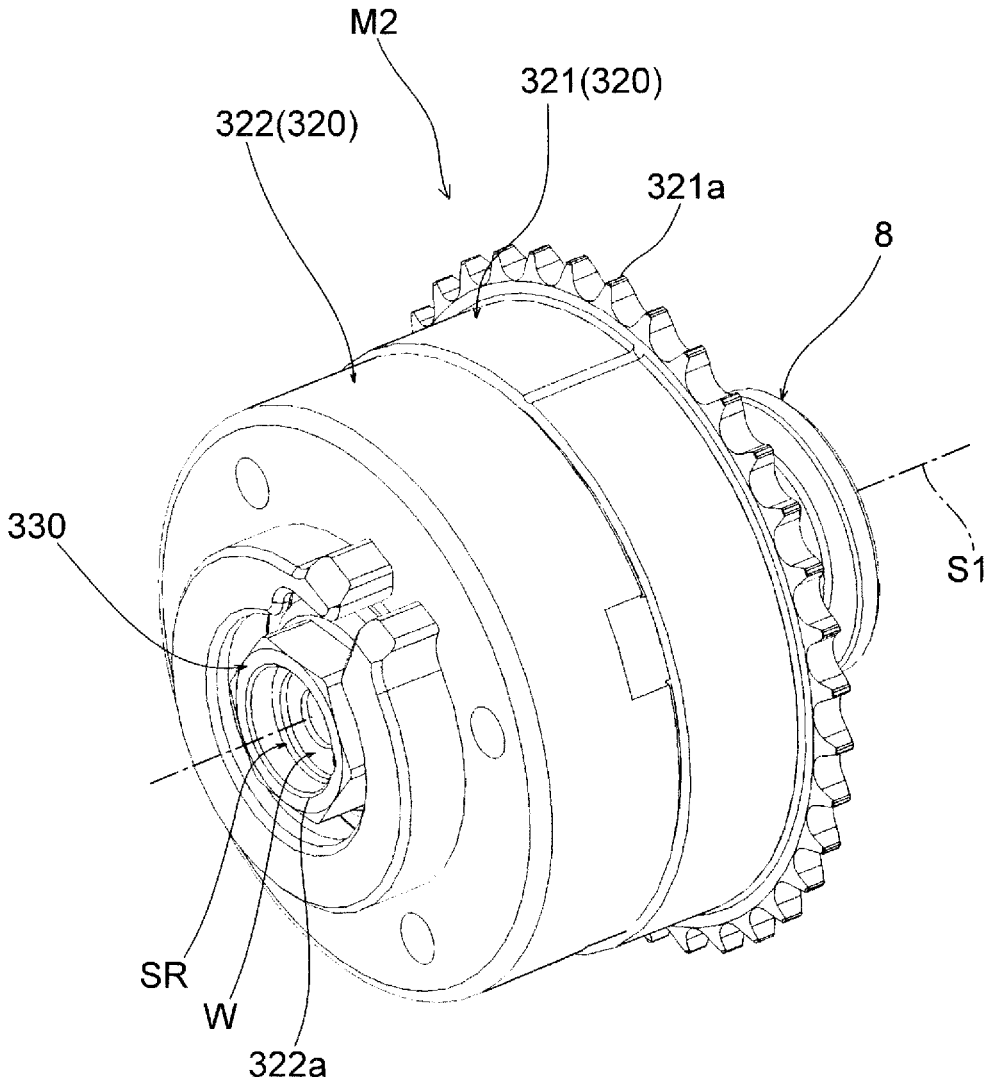
FIG. 25 is an oblique view illustrating the appearance of a valve timing changing apparatus including the oil passage switching valve according to the second embodiment the invention.
Figure 26:
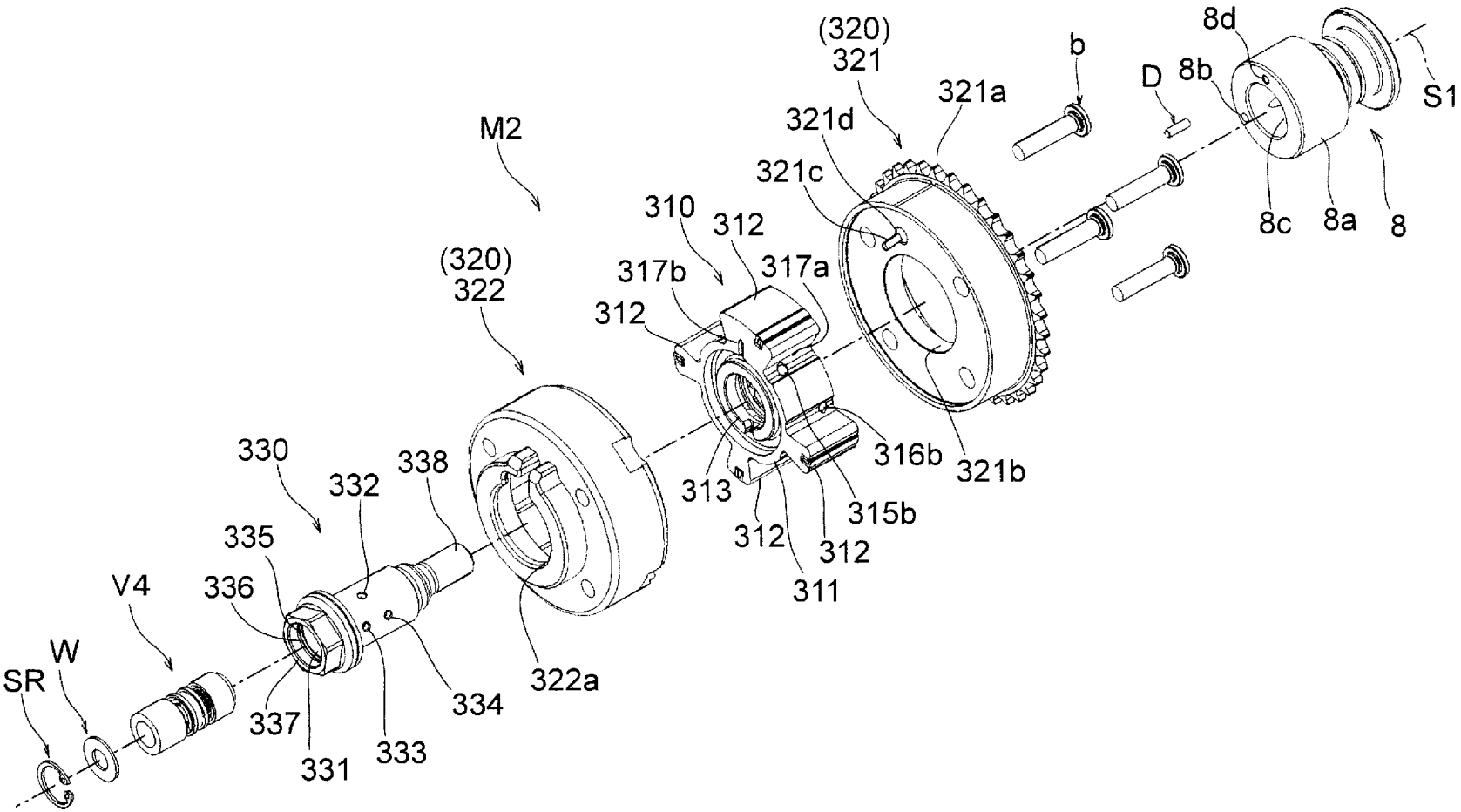
FIG. 26 is an exploded oblique view illustrating the valve timing changing apparatus shown in FIG. 25 in the exploded state when viewed from a direction.
Figure 27:
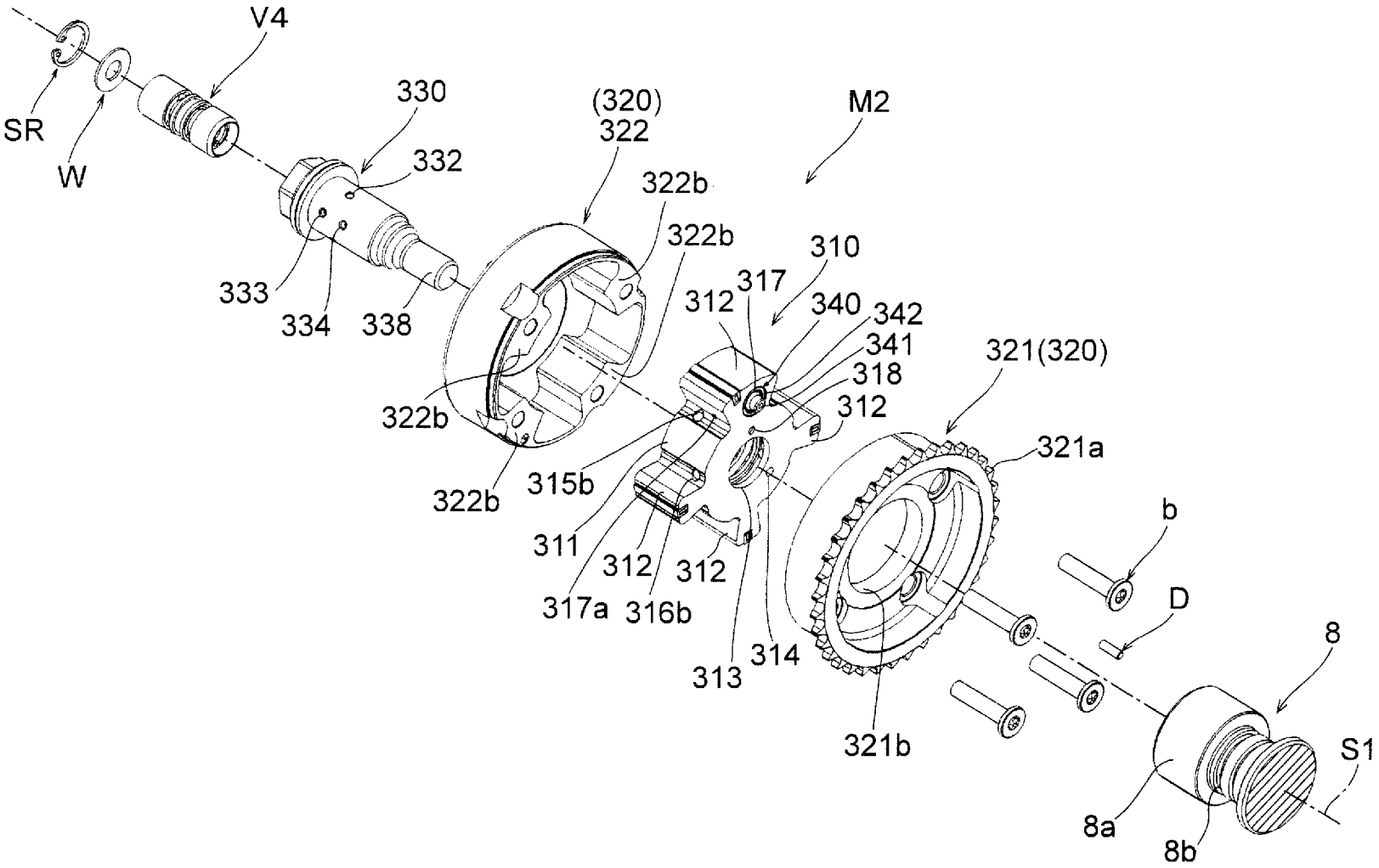
FIG. 27 is an exploded oblique view illustrating the valve timing changing apparatus shown in FIG. 25 in the exploded state when viewed from another direction.

As shown in FIGS. 25 to 27, the valve timing changing apparatus M2 includes a vane rotor 310 integrally rotating with a camshaft 8 on the same axis S1, a housing rotor accommodating the vane rotor 310 and relatively rotatable on the axis S1, a fastening bolt 330 fastening the vane rotor 310 with the camshaft 8, a lock mechanism 340, the oil passage switching valve V4 installed inside the fastening bolt 330, a pressing member W, and a stop ring SR.

Figure 29:
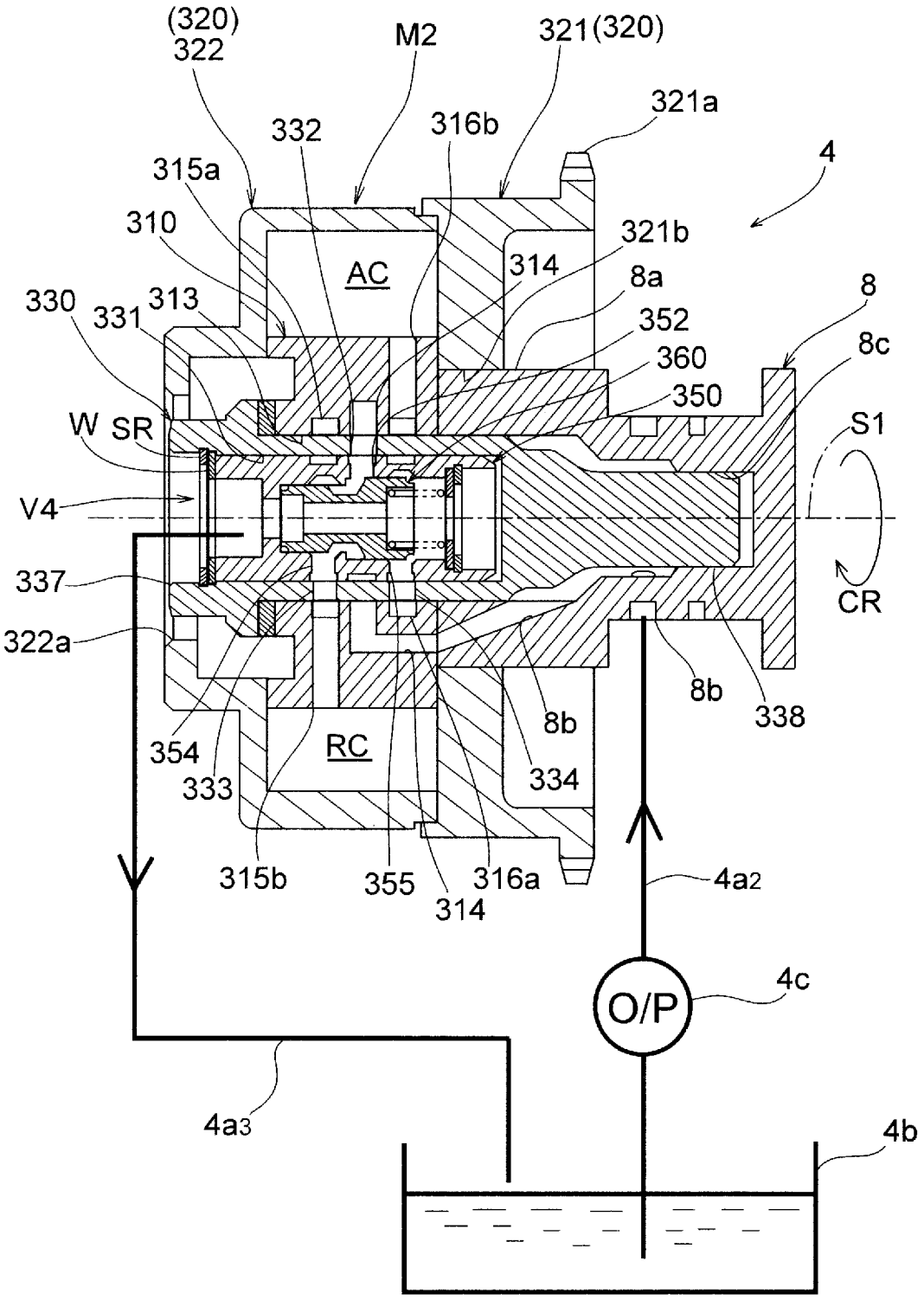
FIG. 29 is a cross-sectional view in a surface which includes the axis of a camshaft and passes along the oil passage in the valve timing changing apparatus shown in FIG. 25.

Here, the camshaft 8 replaces the camshaft 4*d* in the engine 4 and, as shown in FIGS. 26 and 29, includes a cylindrical part 8*a* that rotatably supports the rotation of the housing rotor 320 on the axis S1, a supply oil passage 8*b* that supplies the operating oil, a female screw part 8*c* into which the fastening bolt 330 is screwed, and a position determining pore 8*d* that fits a position determining pin D.

As shown in FIGS. 26, 27, and 29, the vane rotor 310 includes a cylindrically shaped hub part 311, four vane parts 312, a through hole 313 through which the fastening bolt 330 passes, a supply oil passage 314, retard oil passages 315*a* and 315*b*, advance oil passages 316*a* and 136*b*, a fitting pore 317 that fits the lock mechanism 340, an oil passage 317*a* and an adjustment hole 317*b* in communication with the fitting pore 317, and a position determining pore 318 that fits the position determining pin D.

The supply oil passage 314 forms a communication hole in communication with the supply oil passage 8*b* of the camshaft 8 and an annular groove formed on the inner peripheral surface of the through hole 313.

The retard oil passages 315*a* and 315*b* form annular grooves on the inner peripheral surface of the through hole 313.

The retard oil passage 315*b* forms a through hole that communicates with the retard oil passage 315*a* to extend in the radial direction and penetrate through the hub part 311.

The advance oil passage 316*b* forms a through hole that communicates with the advance oil passage 316*a* to extend in the radial direction and penetrate through the hub part 311.

The housing rotor 320 has a two-part structure composed of a first housing rotor 321 that is substantially disc-shaped and a second housing rotor 322 that has a bottom and is cylindrically shaped, and the two parts are fastened to each other by screws b.

The first housing rotor 321 includes a sprocket 321*a*, an inner peripheral surface 321*b* rotatably fit with the cylindrical part 8*a* of the camshaft 8, an oil passage 321*c* formed as a groove on a surface in close contact with the vane rotor 310, and a lock pore 321*d* in communication with the oil passage 321*c*.

The second housing rotor 322 includes an opening part 322*a* and four shoe parts 322*b*.

The housing rotor 320 accommodates the vane rotor 310 to be relatively rotatable within a predetermined angle range, and is formed so that an accommodating chamber is divided into two, i.e., a retard chamber RC and an advance chamber AC, by the vane part 312 of the vane rotor 310. Then, the housing rotor 320 is linked with rotation of a crankshaft via a chain, etc., the oil passage switching valve V4 adjusts the operating oil in the retard chamber RC and the advance chamber AC, and the housing rotor 320 transmits the rotational drive force of the crankshaft to the camshaft 8 via the vane rotor 310.

As shown in FIGS. 26, 27, and 29, the fastening bolt 330 includes a fitting pore 331 that fits the oil passage switching valve V4, a supply oil passage 332, a retard oil passage 333, an advance oil passage 334, a receiving groove 335, a stop ring groove 336, an opening part 337 formed at an end part, and a male screw part 338.

The fitting pore 331 forms a cylindrical inner peripheral surface with the axis S1 as the center.

The supply oil passage 332 is in communication with the supply oil passage 314 and the fitting pore 331.

The retard oil passage 333 is in communication with the retard oil passage 315*a* and the fitting pore 331.

The advance oil passage 334 is in communication with the advance oil passage 316*a* and the fitting pore 331.

The lock mechanism 340 is configured by a lock pin 341, a cylindrical holder 342 fit with the fitting pore 317 of the vane rotor 310, and an urging spring disposed in the cylindrical holder 342 and applying an urging force so that the lock pin 341 protrudes.

The lock pin 341 is reciprocally movable in the direction of the axis S1 and protrudes from an end surface of the vane rotor 310 to detachably fit the lock pore 321*d* of the first housing rotor 321.

Figure 31:
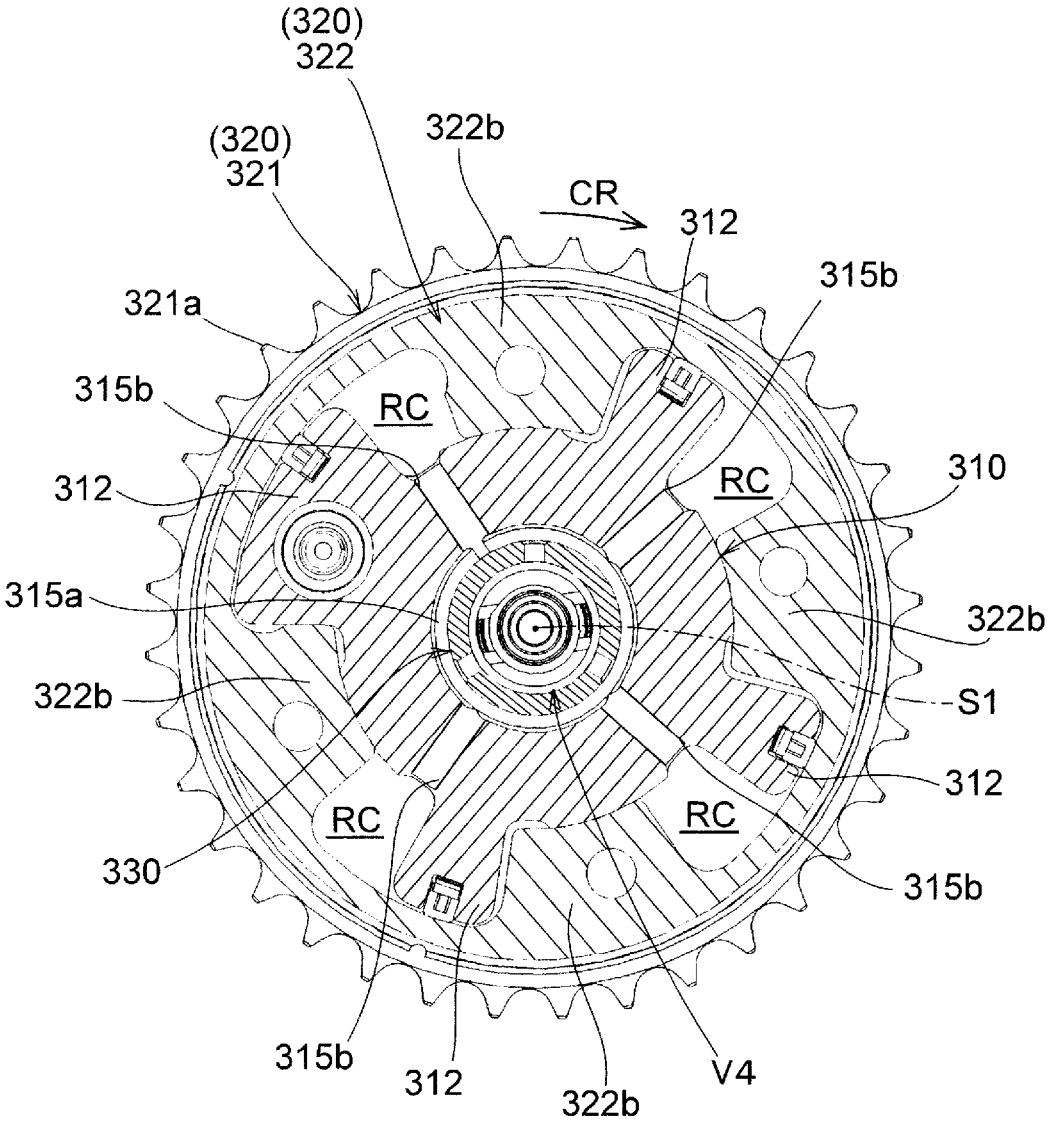
FIG. 31 is a cross-sectional view illustrating a position relation between a vane rotor and a housing rotor of the valve timing changing apparatus at the retard position.

In addition, the lock pin 341, at the retard position (pause position) shown in FIG. 31, is fit with the lock pore 321*d* to lock the vane rotor 310 with respect to the housing rotor 320. Meanwhile, the lock pin 314, at the retard position, when the retard chamber RC is filled with the operating oil, is pressed into the lock pore 321*d* by the operating oil supplied via the oil passage 317*a*, and is pressed into the cylindrical holder 342 by the operating oil supplied into the lock pore 321*d* via the advance oil passage 316*b* and the oil passage 321*c* to be detached from the lock pore 321*d* to unlock. The adjustment hole 317*b* adjusts the pressure difference at the time when the lock pin 341 moves reciprocally.

The pressing member W is formed as an annular-shaped circular disc, fit into the receiving groove 335 of the fastening bolt 330, and serves to press the oil passage switching valve V4 fit with the fitting pore 331.

The snap ring SR is a C-shaped ring, and is fit into the snap ring groove 336 of the fastening bolt 330 by snap fit to restrict the pressing member W from falling.

Figure 28:
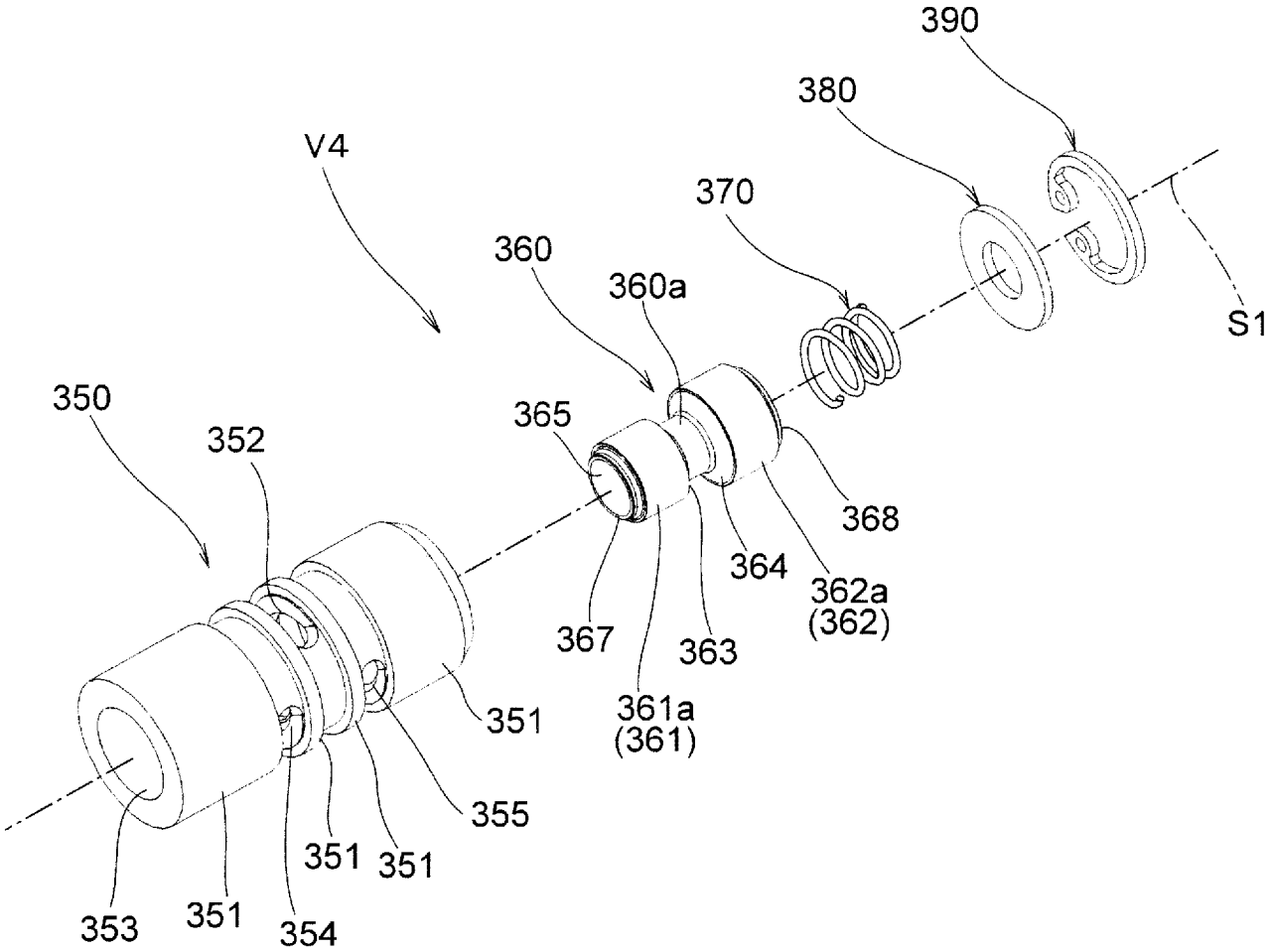
FIG. 28 is an exploded oblique view illustrating an oil passage switching valve according to a fourth embodiment included in the valve timing changing apparatus shown in FIG. 25.
Figure 30:
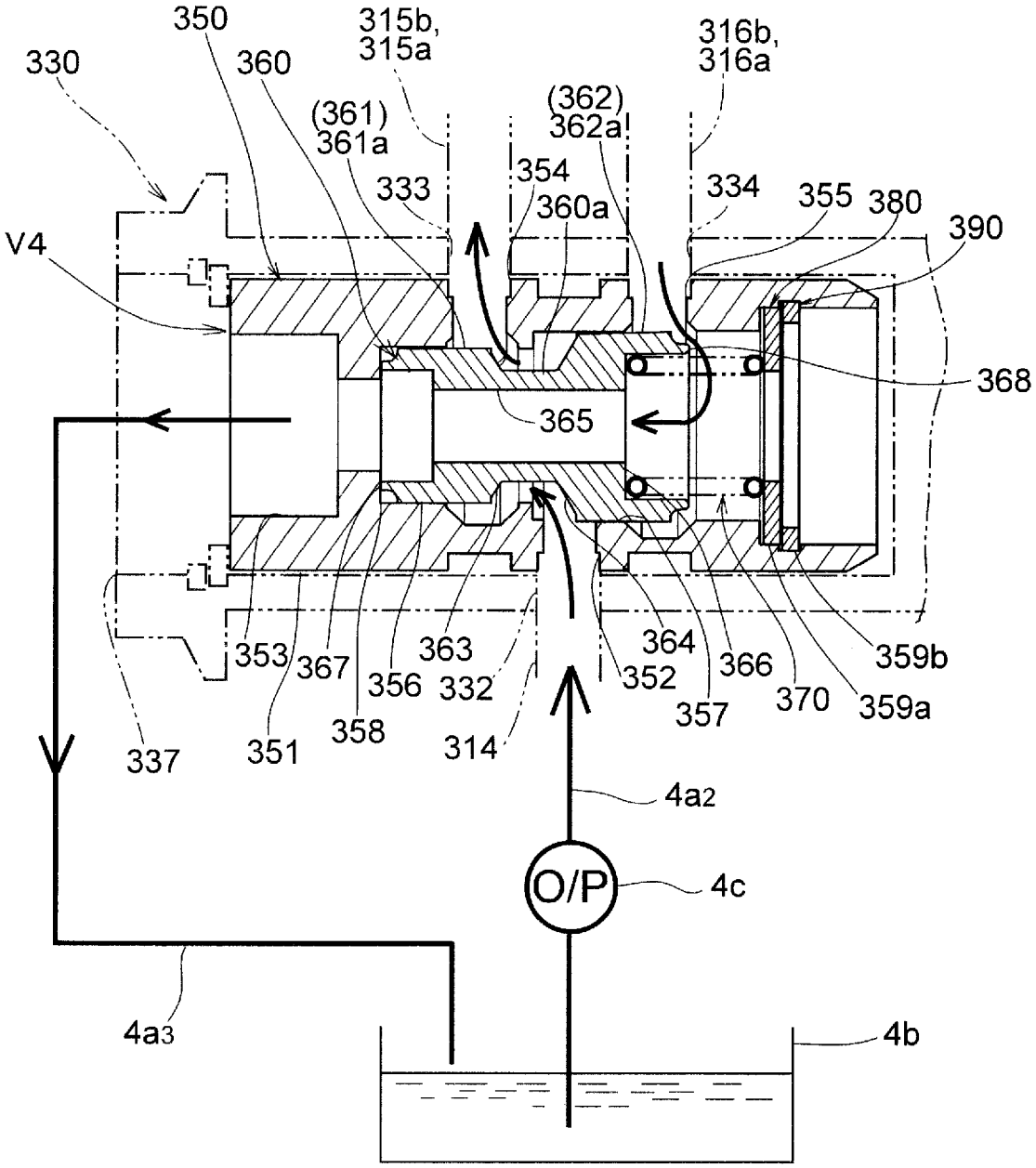
FIG. 30 is a view illustrating a state in which, in the oil passage switching valve according to the fourth embodiment, a valve body is at a position corresponding to a retard position (first angle position) and operating oil can be supplied to a retard chamber.
Figure 32:
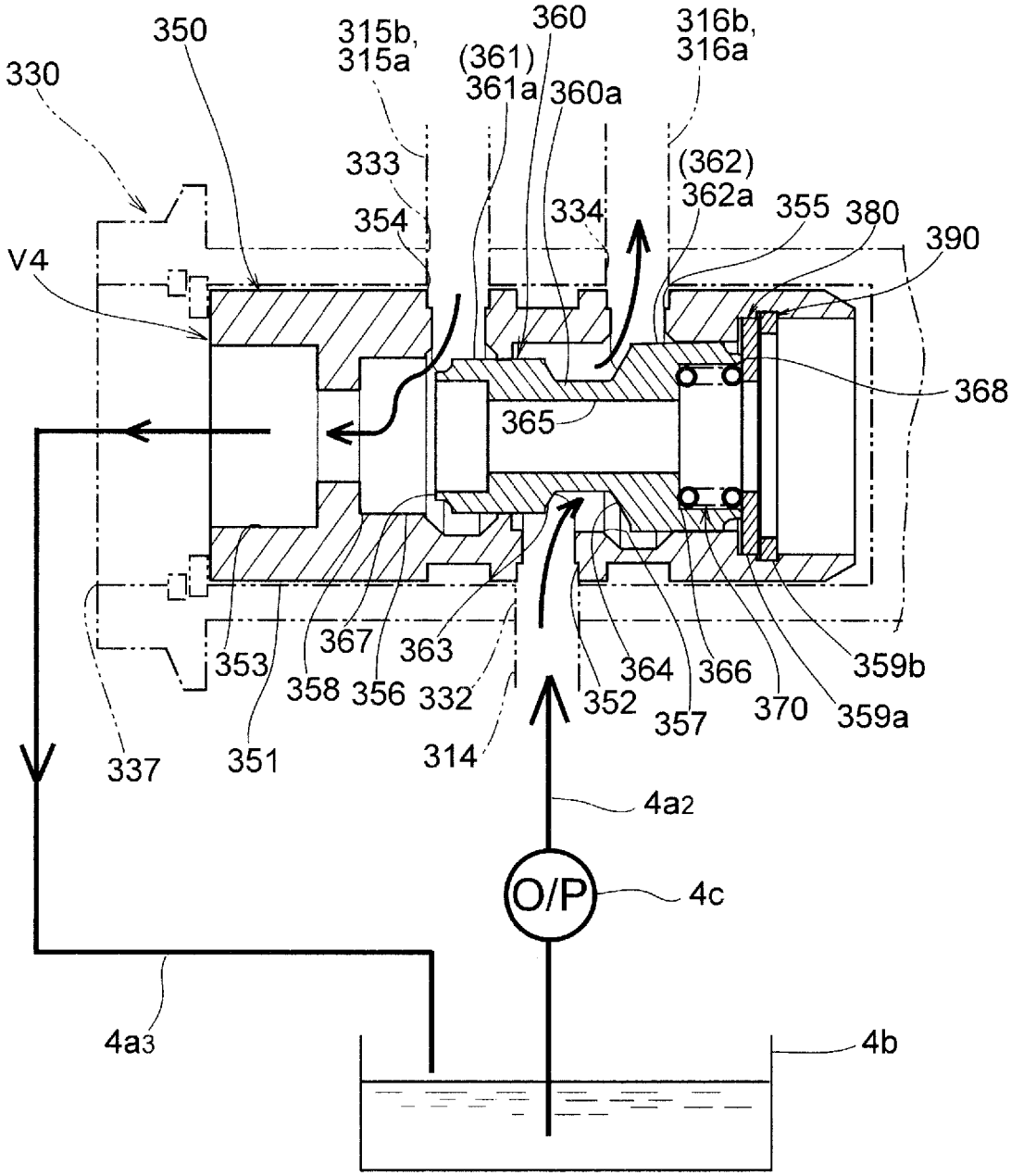
FIG. 32 is a view illustrating a state in which, in the oil passage switching valve according to the fourth embodiment, a valve body is at a position corresponding to an advance position (second angle position) and operating oil can be supplied to an advance chamber.

While the oil passage switching valve V4 is functionally the same as the oil passage switching valve V1 according to the first embodiment, the place where the oil passage switching valve V4 is disposed is different from the oil passage switching valve V1 according to the first embodiment. As shown in FIGS. 28, 30, and 32, the oil passage switching valve V4 includes a sleeve 350 in a substantially cylindrical shape elongated in the direction of the axis S1, a valve body 360 that is in a substantially cylindrical shape elongated in the direction of the axis S1, an urging spring 370, a receiving member 380, and a snap ring 390.

The sleeve 350 includes an outer peripheral surface 351, a supply port 352, a discharge port 353, a retard port 354, an advance port 355, an inner peripheral surface 356 with a small diameter, an inner peripheral surface 357 with a large diameter, a receiving part 358, a receiving groove 359*a*, and a snap ring groove 359*b*.

The outer peripheral surface 351 is formed as a cylindrical surface with the axis S1 as the center, and is in close contact to be fit with the fitting pore 331 of the fastening bolt 330.

The supply port 352 is in communication with the supply oil passage 332 of the fastening bolt 330.

The discharge port 353 is in communication with the opening part 337 of the fastening bolt 330.

The retard port 354 is in communication with the retard oil passage 333 of the fastening bolt 330 and in communication with the retard chamber RC through the retard oil passages 315*a* and 315*b* of the vane rotor 310.

The advance port 355 is in communication with the advance oil passage 334 of the fastening bolt 330 and in communication with the advance chamber AC through the advance oil passages 316*a* and 316*b* of the vane rotor 310.

The inner peripheral surface 356 is formed as a cylindrical surface with the axis S1 as the center, and is in close contact with the first valve part 361 of the valve body 360 to guide slidably.

The inner peripheral surface 357 is formed as a cylindrical surface with the axis S1 as the center, and is in close contact with the second valve part 362 of the valve body 360 to guide slidably.

The receiving part 358 serves to receive the first end part 367 of the valve body 360 to stop the valve body 360 in the position of the pause state.

The receiving groove 359*a* is formed to receive the receiving member 380 to restrict the movement toward the side of the valve body 360.

The snap ring groove 359*b* is formed to receive the snap ring 390 by snap fit in the state in which the receiving member 380 is fit into the receiving groove 359*a*.

The valve body 360 includes a cylindrical part 360*a*, the first valve part 361 with a small diameter, the second valve part 362 with a large diameter, a first pressure receiving part 363 and a second pressure receiving part 364 as the pressure receiving part, a through hole 365 as the discharge oil passage, a receiving part 366, a first end part 367, and a second end part 368.

The first valve part 361 is formed in a cylindrical shape with the axis S1 as the center to slide on the inner peripheral surface 356 of the sleeve 350, defines an outer peripheral surface 361*a* having an outer diameter that is substantially equal to or slightly smaller than the inner diameter of the inner peripheral surface 356, and opens and closes the oil passage between the retard port 354 and the supply port 352.

The second valve part 362 is formed in a cylindrical shape with the axis S1 as the center to slide on the inner peripheral surface 357 of the sleeve 350, defines an outer peripheral surface 362*a* having an outer diameter that is substantially equal to or slightly smaller than the inner diameter of the inner peripheral surface 357, and opens and closes the oil passage between the advance port 355 and the supply port 352.

The first pressure receiving part 363 is formed as an annular inclined surface adjacent to the first valve part 361, and receives the pressure of the operating oil in the direction toward opening the first valve part 41 in the direction of the axis S1.

The second pressure receiving part 364 faces the first pressure receiving part 363 in the direction of the axis S1 and is formed as an annular inclined surface adjacent to the second valve part 362 to define a pressure receiving area greater than the pressure receiving area of the first pressure receiving part 363, and receives the pressure of the operating oil in the direction toward opening the second valve part 362 in the direction of the axis S1.

That is, the first pressure receiving part 363 and the second pressure receiving part 364 are connected by the cylindrical part 360*a* whose outer diameter is smaller than the first valve part 361 and the second valve part 362.

Then, the first pressure receiving part 363 and the second pressure receiving part 364, as the pressure receiving part, function as a switching element that switches the position of the valve body 360 in response to the pressure P as the state quantity of the operating oil, while resisting the urging force of the urging spring 370.

The through hole 365, as shown in FIG. 30, serves to discharge the operating oil in the advance chamber AC from the advance port 355 toward the discharge port 353 in the state in which the second valve part 362 closes the oil passage between the advance port 355 and the supply port 352. By enlarging a portion of the inner diameter of the through hole 365 toward the inner side in the direction of the axis S1 from the second end part 368, the receiving part 366 is formed as an annular surface defined in an inner side region of the second valve part 362 to receive an end part of the urging spring 370.

The first end part 367 detachably abuts against the receiving part 358 of the sleeve 350.

The second end part 368 detachably abuts against the receiving member 380 attached to the receiving groove 359*a* of the sleeve 350.

The urging spring 370 is a compression type coil spring, and is assembled so that one end part abuts against the receiving part 366 of the valve body 360, and the other end part abuts against the receiving member 380.

Then, at the time of the pause state and that the pressure P of the operating oil is in the first pressure range P1, the urging spring 370 applies an urging force that stops the valve body 360 at the position at which the first end part 367 of the valve body 360 abuts against the receiving part 358 of the sleeve 350, that is, the position corresponding to the retard position as the first angle position.

The receiving member 380 is formed as an annular-shaped circular disc, receives the other end part of the urging spring 370, and serves to receive the second end part 368 of the valve body 360 to stop the valve body 360 at the position of the maximum valve opening stroke.

The snap ring 390 is a C-shaped ring, and is fit into the snap ring groove 359 of the sleeve 350 by snap fit to restrict the receiving member 380 from falling.

Then, in the case of starting the engine 4 mounted in the range extender vehicle EV, the operation of the valve timing changing apparatus M2 using the oil passage switching valve V4 will be described based on FIGS. 30 to 33.

Firstly, in the stopped state of the engine 4, the oil passage switching valve V4 is in the pause state. At this time, as shown in FIG. 30, the valve body 360 is urged toward a direction by the urging force of the urging spring 370, the first valve part 361 is in the open-valve state in which the oil passage between the retard port 354 and the supply port 352 is opened, and the second valve part 362 is in the close-valve state in which the oil passage between the advance port 355 and the supply port 352 is closed. At this time, the retard chamber RC is in the state in which the operating oil is supplied, and the advance chamber AC is in the state in which the operating oil is discharged.

In addition, in the stopped state of the engine 4, the valve timing, as shown in FIG. 31, is maintained at the retard position (here, the most retard position) as the first angle position. Here, in the stopped state of the engine 4, the valve timing is maintained at the retard position by the lock mechanism 340. At the time when the engine 4 is transitioned from the state in which the valve timing is at the intermediate position to the advance position when the engine 4 is operating to the stopped state, the valve timing is automatically returned to the retard position by a fluctuation torque and a friction torque transmitted from the camshaft 8.

Then, when the engine 4 is started, via the oil pump 4*c*, the pressure P of the operating oil is gradually increased, as shown in FIG. 9.

During the light load mode at the time of starting or low rotation speed of the engine 4, as shown in FIG. 9, the pressure P of the operating oil is within the range of the first pressure range P1 as a first range smaller than a switching pressure Pc.

At this time, the urging force of the urging spring 370 is greater than the difference between the pressures of the operating oil received by the second pressure receiving part 364 and the first pressure receiving part 363, i.e., the pressure that the pressure receiving part receives, and the valve body 360 is in the state in which the first valve body 361 is opened and the second valve body 362 is closed, as shown in FIG. 30.

Therefore, the operating oil supplied through the supply oil passages 314 and 332 and the supply port 352 is guided to the retard chamber RC through the retard port 354 and the retard oil passages 333, 315*a*, and 315*b*. Accordingly, the valve timing is maintained at the retard position shown in FIG. 31. The lock mechanism 340 is unlocked by the operating oil guided into the retard chamber RC.

Meanwhile, during the intermediate/high load mode of the engine 4, as shown in FIG. 9, the pressure P of the operating oil is transitioned to the range of the second pressure range P2 as a second range greater than the switching pressure Pc.

Figure 33:
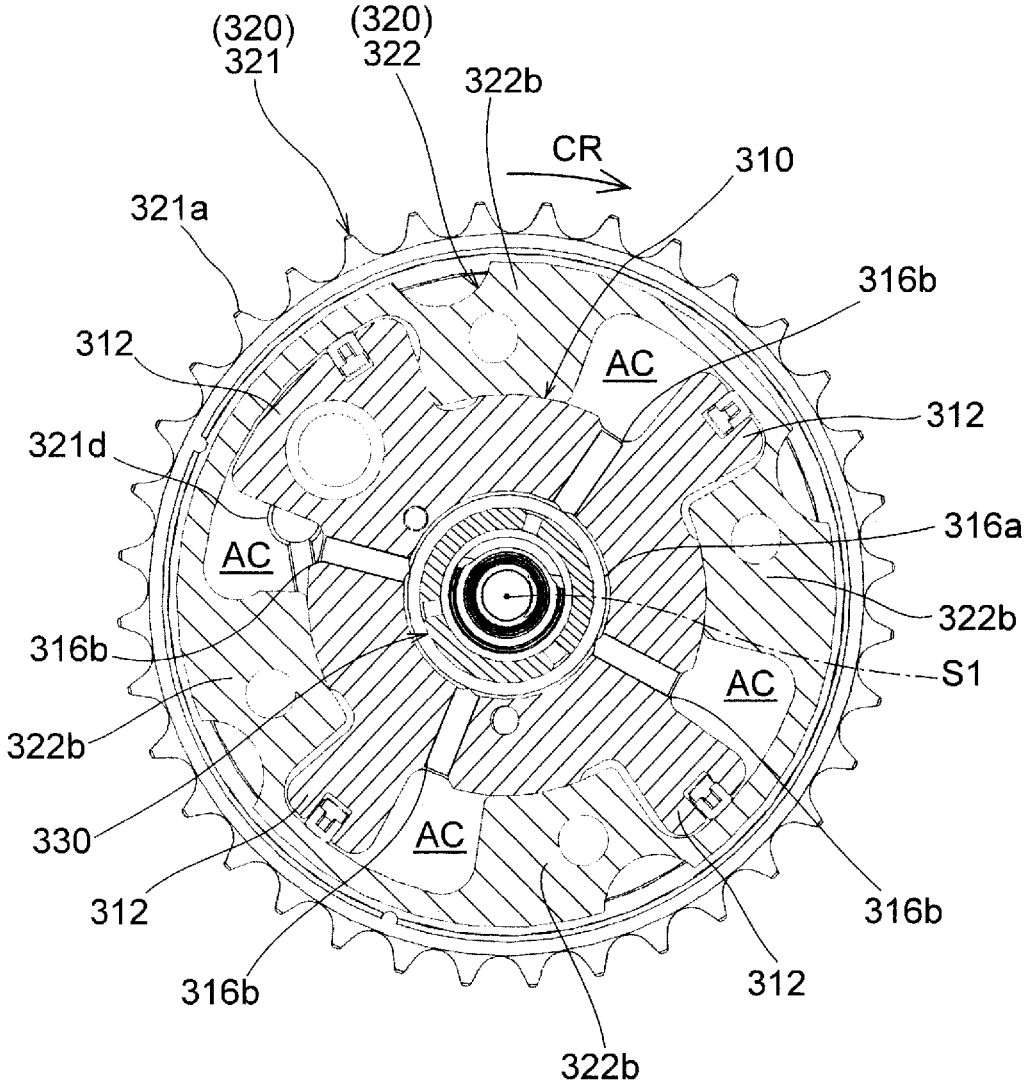
FIG. 33 is a cross-sectional view illustrating a position relation between the vane rotor and the housing rotor of the valve timing changing apparatus at the advance position.

At this time, the difference between the pressures of the operating oil received by the second pressure receiving part 364 and the first pressure receiving part 363, i.e., the pressure that the pressure receiving part receives, overcomes the urging force of the urging spring 370, and the valve body 360 is moved toward the direction of contracting the urging spring 370. As shown in FIG. 32, the first valve body 361 is changed to the close-valve state in which the oil passage between the retard port 354 and the supply port 352 is closed, and the second valve part 362 is in the open-valve state in which the oil passage between the advance port 355 and the supply port 352 is opened. Therefore, the operating oil supplied through the supply oil passages 314 and 332 and the supply port 352 is guided to the advance chamber AC through the advance port 355 and the advance oil passages 334, 316*a*, and 316*b*. Meanwhile, the operating oil in the retard chamber RC is guided to the discharge port 353 through the retard oil passages 315*b*, 315*a*, and 333, and the retard port 354, and is returned to the oil pump 4*b* from the opening part 337 through the discharge oil passage 4*a*3. Accordingly, as shown in FIG. 33, the valve timing is changed to and maintained at the advance position (here, the most advance position) as the second angle position. The lock mechanism 340 remains unlocked by the operating oil guided into the advance chamber AC.

Accordingly, with the first pressure receiving part 363 and the second pressure receiving part 364, as the switching element, disposed in the valve body 360 switching the position of the valve body 360 in response to the pressure P of the operating oil while resisting the urging force of the urging spring 370, the valve body 360 is positioned to the position corresponding to the retard position at the time when the pressure P of the operating oil is in the first pressure range P1, and the valve body 360 is positioned to the position corresponding to the advance position at the time when the pressure P of the operating oil is in the second pressure range P2 greater than the first pressure range P1.

According to the oil passage switching valve V4 with the above configuration, the driving force of the valve body 360 is not the conventional electromagnetic force, but a force according to the pressure P of the operating oil. Therefore, compared with the electromagnetically driven switching valve in the conventional technology, the simple structure, the low cost, the light weight, the small size, etc., can be attained.

Here, since the urging spring 370 is disposed in the sleeve 350, the oil passage switching valve V4 can be miniaturized by consolidating the components.

In addition, since the valve body 360 has the through hole 365 as the discharge oil passage that guides the operating oil to the discharge port 353, compared with the case where the discharge oil passage is arranged on another route, the valve body 360 can be miniaturized by consolidating the configuration.

In addition, according to the valve timing changing apparatus M2 with the above confirmation, since the oil passage switching valve V4 is fit with and assembled to the fitting pore 331 of the fastening bolt 330, compared with the case where the oil passage switching valve V4 is handled separately, the man hours required for assembling the engine 4 can be lowered, and the management cost can be reduced, etc. In addition, in the engine 4, the space for disposing the oil passage switching valve is not required, and the main body 4*a* can be simplified.

In the oil passage switching valve V4 according to the fourth embodiment, during the oil passage switching operation from the state shown in FIG. 30 to the state shown in FIG. 32, the valve body 360 may also be arranged to vibrate reciprocally to result in the cleaning mode.

Figure 34:
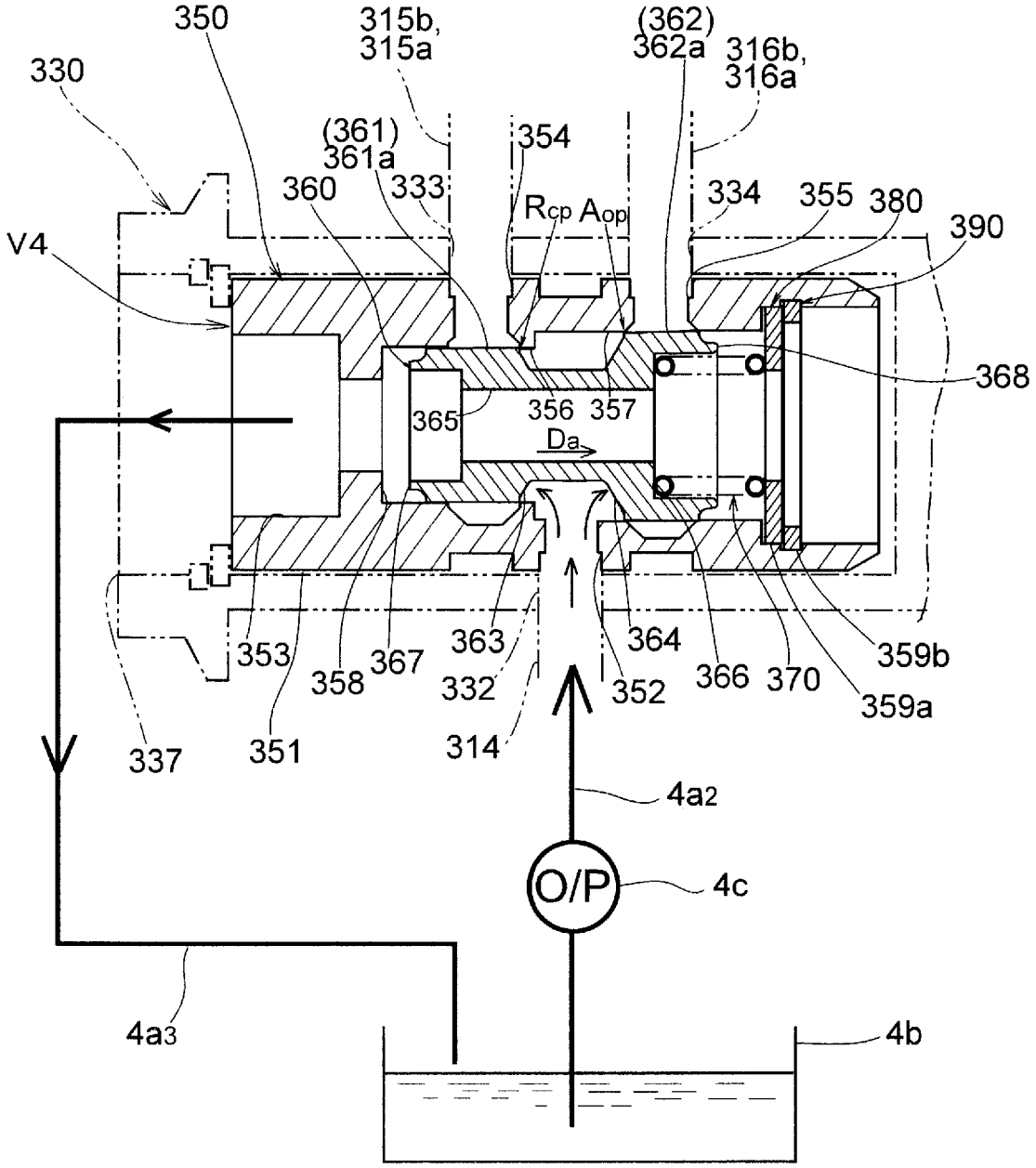
FIG. 34 is a cross-sectional view illustrating a state in which, in an oil passage switching valve according to a fourth embodiment, the valve closing timing of a first valve part and the valve opening timing of a second valve part are set to be as simultaneous.

Specifically, as shown in FIG. 34, at the time when the valve body 360 resists the urging force of the urging spring 370 to move in the sleeve 350, the lap margin between the outer peripheral surface 361*a* and the inner peripheral surface 356 and the lap margin between the outer peripheral surface 362*a* and the inner peripheral surface 357, etc., are set so that the timing Rcp at which the outer peripheral surface 361*a* of the first valve part 361 starts closely contacting the inner peripheral surface 356 of the sleeve 350 facing the first pressure receiving part 363 is simultaneous with the timing Aop at which the outer peripheral surface 362*a* of the second valve part 362 starts leaving the inner peripheral surface 357 of the sleeve 350 facing the second pressure receiving part 364. That is, the valve closing timing Rcp of the first valve part 361 is set as simultaneous with the valve opening timing Aop of the second valve part 362.

Figure 35:
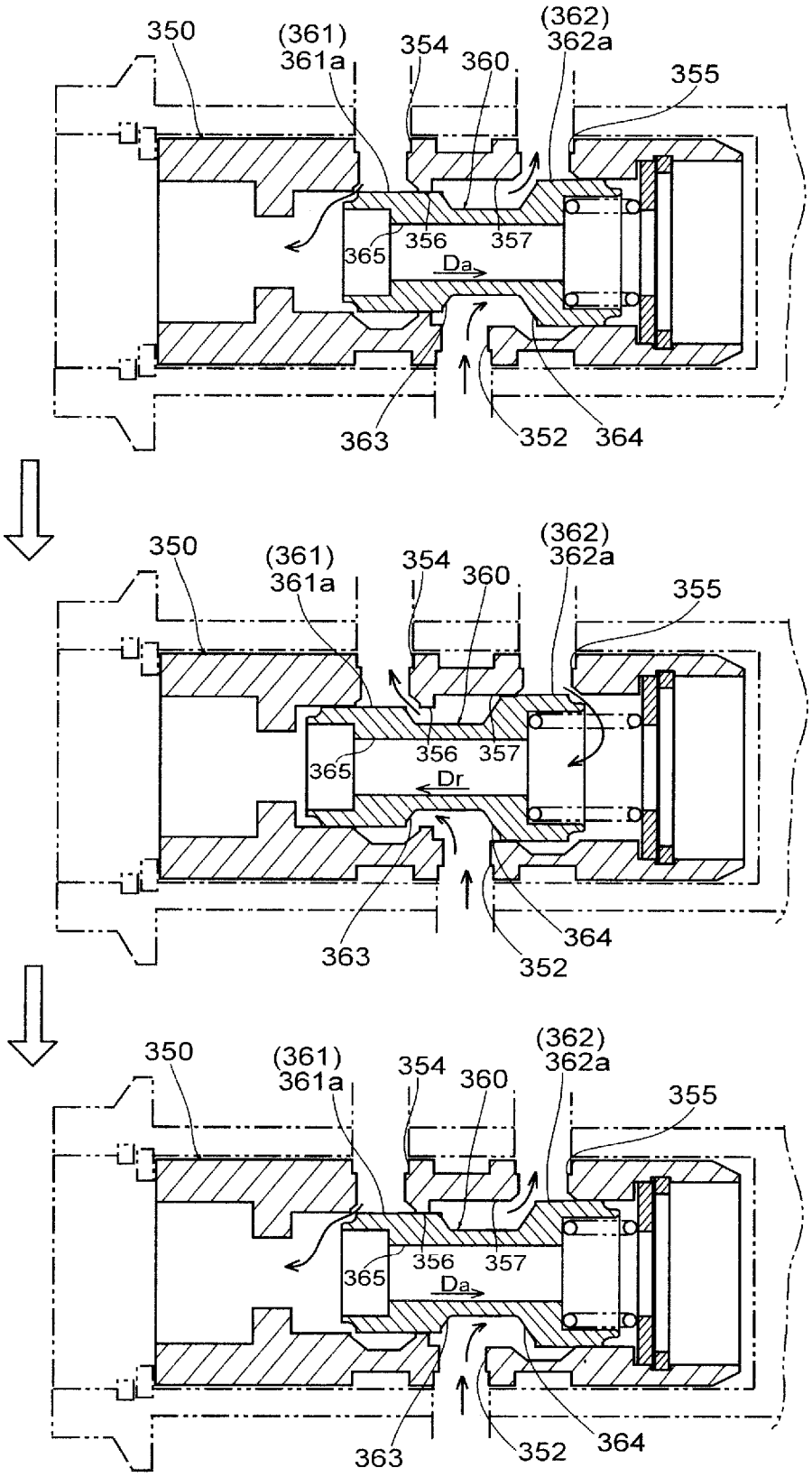
FIG. 35 is a view illustrating a state in which, in the oil passage switching valve according to the fourth embodiment, the valve body generates reciprocal vibrations.

According to the configuration, together with the rising of the pressure P of the operating oil guided through the supply oil passage 314, as shown in FIG. 35, when the valve body 360 resists the urging force of the urging spring 370 to move in the advance direction Da, the first valve 361 is closed to close the oil passage between the retard port 354 and the supply port 352 and the second valve 362 is opened to open the oil passage between the advance port 355 and the supply port 352, and the pressure of the operating oil acting on the second pressure receiving part 364 is temporarily lowered.

That is, with lowering of the pressure Pv of the operating oil acting on the valve body 360, the valve body 360 is moved toward the retard direction Dr due to the urging force of the urging spring 370 to the position at which the pressure Pv of the operating oil and the urging force of the urging spring 370 are balanced, the first valve body 361 is opened to release the oil passage between the retard port 354 and the supply port 352, and the second valve part 362 is closed to close the oil passage between the advance port 355 and the supply port 352.

Together with that the pressure Pv of the operating oil acting on the valve body 360 rises again, the valve body 360 resists the urging force of the urging spring 370 to move in the advance direction Da, the first valve body 361 is closed to close the oil passage between the retard port 354 and the supply port 352, the second valve part 362 is opened to open the oil passage between the advance port 355 and the supply port 352, and the pressure of the operating oil acting on the second pressure receiving part 364 is temporarily lowered.

Accordingly, at the time when the valve body 360 is switched to the position corresponding to the advance position from the position corresponding to the retard position, as shown in FIG. 13, the reciprocal movement toward the advance direction Da and the retard direction Dr is repeated several times with the fluctuations of the pressure Pv of the operating oil acting on the valve body 360. That is, since the valve 360 slides in the sleeve 350 in the form of a spool valve, the reciprocal vibration is generated without a hitting sound, a shock, etc.

Then, when the pressure P of the operating oil exceeds a predetermined level, the reciprocal vibration is ceased from occurring, and the valve body 360 reaches the maximal opening stroke and stops, as shown in FIG. 32. At this time, as shown in FIGS. 33 and 13, the valve timing is maintained at the advance position (here, the most advance position) as the second angle position. Meanwhile, at the time when the valve body 360 is moved from the advance position to the retard position, the valve body 360 is moved smoothly without generating reciprocal vibration.

Figure 36:
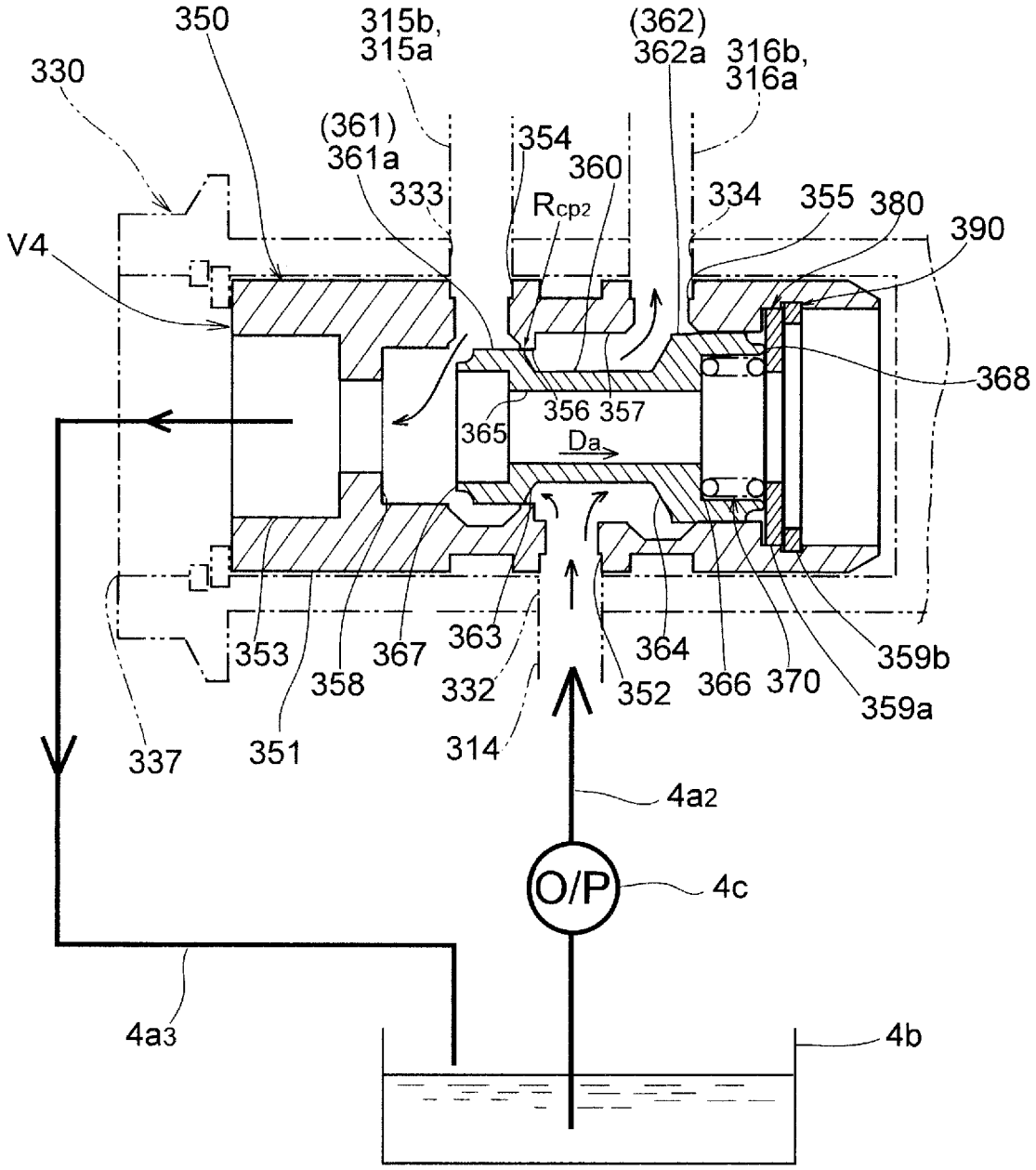
FIG. 36 is a cross-sectional view illustrating a state in which, in the oil passage switching valve according to the fourth embodiment, the valve closing timing of the first valve part is set as later than the valve opening timing of the second valve part and before the second valve part reaches a maximum valve opening stroke.

Besides, the valve closing timing of the first valve part 361 may also be set as later than the valve opening timing Aop of the second valve part 362. For example, as shown in FIG. 36, a valve closing timing Rcp2 of the first valve part 361 may also be set, at the latest, as before the second valve part 362 abuts against the receiving member 380 to reach the maximum valve opening stroke.

Even in such configuration, as described above, the reciprocal vibration of the valve body 360 can be generated without a hitting sound, a shock, etc.

In addition, the amplitude of the reciprocal vibration can be adjusted by appropriately choosing the lap margin between the outer peripheral surface 361*a* and the inner peripheral surface 356 and the lap margin between the outer peripheral surface 362*a* and the inner peripheral surface 35 in the relation between the valve body 360 and the sleeve 350.

As described above, by generating reciprocal vibration in the valve body 360, foreign matters in the valve body 360 can be discharged or crushed, and the cleaning mode for preventing an operation failure due to entrapment of the foreign matters, etc., can be provided.

Accordingly, even if there is no electromagnetic driving source that drives the valve body as in the conventional art, the cost, etc., can be reduced, and the reliability of the oil passage switching valve V4 can be increased.

In the above embodiment, as the valve timing of the engine, while the case in which the first angle position corresponds to the retard position and the second angle position corresponds to the advance position is shown, the valve timing of the engine is not limited thereto. The required angle position can be selected in response to the operation mode of the engine. For example, a case in which the first angle position corresponds to the advance position and the second angle position corresponds to the retard position may also be applied.

While the oil passage switching valve disposed in the fastening bolt 330 of the valve timing changing apparatus M2 according to the second embodiment is shown as the oil passage switching valve V4 according to the fourth embodiment, the invention is not limited thereto. The oil passage switching valve V2 according to the second embodiment or the oil passage switching valve V3 according to the third embodiment may also be used.

While the lock mechanism 340 is adopted in the valve timing changing apparatus M2 according to the second embodiment, the invention is not limited thereto. The lock mechanism 340 may also be omitted to reduce the cost.

While the urging member 26 formed by a memory alloy is shown as the urging member in the oil passage switching valve V3 according to the third embodiment, the invention is not limited thereto. As one whose the urging force that urges the valve body changes in response to the temperature of the operating oil, a thermo-element containing paraffin wax that expands and contracts in response to temperature, a bimetal that deforms in response to temperature, etc., may also be applied.

In the above embodiment, as the oil passage switching valve, while the oil passage switching valves V1, V2 and V4 that use the pressure of the operating oil and the oil passage switching valve V3 that use the temperature of the operating oil are shown separately, the invention is not limited thereto. An oil passage switching valve that uses the pressure as well as the temperature of the operating oil may also be adopted.

As described above, since the simple structure, the lost cost, the light weight, and the small size, etc., can be attained according to the oil passage switching valve and the valve timing changing apparatus of the invention, the oil passage switching valve and the valve timing changing apparatus of the invention can not only be applied to the engine mounted in a range extender vehicle, but can also be applied to the engine mounted in a vehicle such as a motorcycle.

What is claimed is:

1. An oil passage switching valve, suitable for a valve timing changing apparatus to switch an oil passage for supplying or discharging operating oil with respect to a retard chamber and an advance chamber to change a valve timing of an engine to a first angle position or a second angle position, wherein the oil passage switching valve comprises:

a valve body, opening or closing an oil passage of the operating oil;

an urging spring, urging to position the valve body to a position corresponding to the first angle position in a pause state; and a switching element, switching a position of the valve body in response to a state quantity of the operating oil while resisting an urging force of the urging spring to position the valve body to the position corresponding to the first angle position when the state quantity of the operating oil is in a first range, and to position the valve body to a position corresponding to the second angle position when the state quantity of the operating oil is in a second range greater than the first range, wherein the oil passage switching valve comprises a sleeve that defines a supply port that supplies the operating oil, a discharge port that discharges the operating oil, a retard port that communicates with the retard chamber, and an advance port that communicates with the advance chamber, the valve body is slidably inserted into the sleeve to open or close oil passages between the supply port and each of the retard port and the advance port, and the urging spring is disposed in the sleeve to urge the valve body in a direction wherein the state quantity of the operating oil is pressure, the first range is a first pressure range, the second range is a second pressure range, and the switching element is a pressure receiving part disposed in the valve body to receive a pressure of the operating oil, wherein the valve body comprises a first valve part that opens or closes an oil passage between the retard port and the supply port and a second valve part that opens or closes an oil passage between the advance port and the supply port, and the pressure receiving part comprises a first pressure receiving part adjacent to the first valve part and a second pressure receiving part facing the first valve part, having a pressure receiving area greater than the first valve part, and adjacent to the second valve part.

2. The oil passage switching valve as claimed in claim 1, wherein the first angle position is a retard position, and the second angle position is an advance position.

3. The oil passage switching valve as claimed in claim 1, wherein the valve body has a discharge oil passage that guides the operating oil to the discharge port.

4. The oil passage switching valve as claimed in claim 1, wherein a valve closing timing of the first valve part is set as simultaneous with a valve opening timing of the second valve part or later than the valve opening timing of the second valve part.

5. The oil passage switching valve as claimed in claim 4, wherein the valve closing timing of the first valve part is set as before the second valve part reaches a maximum valve opening stroke.

6. The oil passage switching valve as claimed claim 1, wherein the sleeve is formed to be fit with a member defining an oil passage through which operating oil of the engine passes.

7. A valve timing changing apparatus of an engine that changes opening and closing timings of an intake valve or an exhaust valve driven by a camshaft, the valve timing changing apparatus comprising:

a housing rotor, rotating on an axis of the camshaft;

a vane rotor, rotating on the axis and cooperating with the housing rotor to define a retard chamber and an advance chamber;

a fastening bolt, integrally fastening the vane rotor to the camshaft; and an oil passage switching valve, switching an oil passage that supplies or discharges operating oil with respect to the retard chamber and the advance chamber, wherein the oil passage switching valve is the oil passage switching valve as claimed in claim 1.

8. The valve timing changing apparatus as claimed in claim 7, wherein the fastening bolt comprises a fitting pore that fits the sleeve of the oil passage switching valve and an oil passage through which the operating oil passes.

9. An oil passage switching valve, suitable for a valve timing changing apparatus to switch an oil passage for supplying or discharging operating oil with respect to a retard chamber and an advance chamber to change a valve timing of an engine to a first angle position or a second angle position, wherein the oil passage switching valve comprises:

a valve body, opening or closing an oil passage of the operating oil;

an urging spring, urging to position the valve body to a position corresponding to the first angle position in a pause state; and a switching element, switching a position of the valve body in response to a state quantity of the operating oil while resisting an urging force of the urging spring to position the valve body to the position corresponding to the first angle position when the state quantity of the operating oil is in a first range, and to position the valve body to a position corresponding to the second angle position when the state quantity of the operating oil is in a second range greater than the first range, wherein the oil passage switching valve comprises a sleeve that defines a supply port that supplies the operating oil, a discharge port that discharges the operating oil, a retard port that communicates with the retard chamber, and an advance port that communicates with the advance chamber, the valve body is slidably inserted into the sleeve to open or close oil passages between the supply port and each of the retard port and the advance port, and the urging spring is disposed in the sleeve to urge the valve body in a direction wherein the state quantity of the operating oil is pressure, the first range is a first pressure range, the second range is a second pressure range, and the switching element is a pressure receiving part disposed in the valve body to receive a pressure of the operating oil, wherein in the valve body, an auxiliary pressure receiving part is disposed to receive an engine cold condition pressure greater than the second pressure range to position the valve body to a position deviated from the position corresponding to the second angle position, so as to select the first angle position when the pressure of the operating oil is the engine cold condition pressure.

10. The oil passage switching valve as claimed in claim 9, wherein the valve body comprises a first valve part that opens or closes an oil passage between the retard port and the supply port and a second valve part that opens or closes an oil passage between the advance port and the supply port, the pressure receiving part comprises a first pressure receiving part adjacent to the first valve part and a second pressure receiving part facing the first valve part, having a pressure receiving area greater than the first valve part, and adjacent to the second valve part, and the auxiliary pressure receiving part has the same pressure receiving area with the second pressure receiving part, and is disposed between the first pressure receiving part and the second pressure receiving part to close the oil passage between the supply port and the advance port when receiving the engine cold condition pressure.

11. The oil passage switching valve as claimed in claim 10, wherein a valve closing timing of the first valve part is set as simultaneous with a valve opening timing of the second valve part or later than the valve opening timing of the second valve part.

12. The oil passage switching valve as claimed in claim 11, wherein the valve closing timing of the first valve part is set as before a timing at which the auxiliary pressure receiving part closes the oil passage between the supply port and the advance port.

13. An oil passage switching valve, suitable for a valve timing changing apparatus to switch an oil passage for supplying or discharging operating oil with respect to a retard chamber and an advance chamber to change a valve timing of an engine to a first angle position or a second angle position, wherein the oil passage switching valve comprises:

a valve body, opening or closing an oil passage of the operating oil;

an urging spring, urging to position the valve body to a position corresponding to the first angle position in a pause state; and a switching element, switching a position of the valve body in response to a state quantity of the operating oil while resisting an urging force of the urging spring to position the valve body to the position corresponding to the first angle position when the state quantity of the operating oil is in a first range, and to position the valve body to a position corresponding to the second angle position when the state quantity of the operating oil is in a second range greater than the first range, wherein the oil passage switching valve comprises a sleeve that defines a supply port that supplies the operating oil, a discharge port that discharges the operating oil, a retard port that communicates with the retard chamber, and an advance port that communicates with the advance chamber, the valve body is slidably inserted into the sleeve to open or close oil passages between the supply port and each of the retard port and the advance port, and the urging spring is disposed in the sleeve to urge the valve body in a direction, wherein the state quantity of the operating oil is temperature, the first range is a first temperature range, the second range is a second temperature range, and the switching element is an urging member whose urging force that urges the valve body changes in response to a temperature of the operating oil.

14. The oil passage switching valve as claimed in claim 13, wherein the urging member is disposed in the sleeve to resist the urging spring and apply the urging force to the valve body.

15. The oil passage switching valve as claimed in claim 13, wherein the urging member is formed by a memory alloy that contracts in the first temperature range and expands in the second temperature range to return to a memorized form.

* * * * *